US008308497B2

(12) United States Patent
Zayas et al.

(10) Patent No.: US 8,308,497 B2
(45) Date of Patent: Nov. 13, 2012

(54) END CAP, SOCKET, AND ADAPTORS FOR USE WITH A LAMP

(75) Inventors: Betty Jean Zayas, Bridgeport, CT (US); Christian L. Sauska, Fairfield, CT (US); Laszlo Marko, Dunakeszi (HU)

(73) Assignee: Light Sources, Inc., Orange, CT (US)

( * ) Notice: Subject to any disclaimer, the term of this patent is extended or adjusted under 35 U.S.C. 154(b) by 0 days.

(21) Appl. No.: 12/483,834

(22) Filed: Jun. 12, 2009

(65) Prior Publication Data

US 2010/0015843 A1 Jan. 21, 2010

Related U.S. Application Data

(60) Provisional application No. 61/060,983, filed on Jun. 12, 2008, provisional application No. 61/116,336, filed on Nov. 20, 2008.

(51) Int. Cl.
*H01R 33/02* (2006.01)

(52) U.S. Cl. ..... 439/236; 439/240; 439/612

(58) Field of Classification Search ..... 439/236, 439/239–241, 612, 617, 618; 313/318.02, 313/318.05

See application file for complete search history.

(56) References Cited

U.S. PATENT DOCUMENTS 1,157,026 A 10/1915 Meschenmoser
1,937,537 A * 12/1933 Walthor ..... 313/318.05
2,137,174 A * 11/1938 Marshaus ..... 439/241
2,248,987 A * 7/1941 Green ..... 313/239
2,259,378 A 10/1941 Heidkamper
2,262,091 A 11/1941 Bryant
2,284,367 A 5/1942 Bryant et al.
2,288,376 A 6/1942 Tuppen
2,295,757 A 9/1942 Russell (Continued)

FOREIGN PATENT DOCUMENTS

GB 461912 2/1937

(Continued)

OTHER PUBLICATIONS

International Search Report and Written Opinion; PCT US2009/047200; Feb. 17, 2010.

(Continued)

*Primary Examiner* — Neil Abrams
(74) *Attorney, Agent, or Firm* — Cantor Colburn LLP

(57) ABSTRACT

An end cap and socket system for use with a lamp bulb may include an end cap and a socket body. The end cap may include a first cylindrical portion with a first diameter, and a second cylindrical portion with a second diameter smaller than the first cylindrical portion. The socket may a key portion projecting from a front face of the socket. A adaptor for use with a socket may include a key portion. Alternatively, the end can may include a key disk with a key groove cut into the key disk, and the socket may include a key piece with a key rib structured to couple with the key groove. An adaptor for use with an end cap may include an adaptor body portion and a whole, wherein a contact pin can be inserted through the hole. These keying features are intended to prevent improper coupling between mismatched lamps and sockets or insure that the lamp, when mated to the socket, may be rotated in only one direction.

35 Claims, 59 Drawing Sheets

U.S. PATENT DOCUMENTS

| | | | | | |
|---|---|---|---|---|---|
| 2,324,683 | A | | 7/1943 | Despard | |
| 2,356,601 | A | * | 8/1944 | MacCarthy | 439/236 |
| 2,451,900 | A | * | 10/1948 | Zambakian et al. | 313/35 |
| 2,473,925 | A | | 6/1949 | Webster | |
| 2,505,112 | A | * | 4/1950 | Hallman | 439/232 |
| 2,596,056 | A | | 5/1952 | Tinnerman | |
| 2,659,058 | A | * | 11/1953 | Russell | 439/241 |
| 3,297,977 | A | | 1/1967 | Smith | |
| 3,446,954 | A | * | 5/1969 | Spiteri | 362/650 |
| 3,716,816 | A | * | 2/1973 | Johnson, Jr. | 439/241 |
| 3,975,073 | A | | 8/1976 | McLaughlin | |
| 4,084,873 | A | | 4/1978 | Grate | |
| 4,275,325 | A | * | 6/1981 | Guim | 313/51 |
| 4,633,132 | A | * | 12/1986 | Marks et al. | 313/477 R |
| 4,803,600 | A | * | 2/1989 | Pepping | 362/217.16 |
| 4,854,888 | A | | 8/1989 | Cannon | |
| 4,878,854 | A | | 11/1989 | Cannon | |
| 5,320,548 | A | * | 6/1994 | Schadhauser | 439/236 |
| 5,422,487 | A | | 6/1995 | Sauska et al. | |
| 5,489,813 | A | * | 2/1996 | Jung | 313/25 |
| 5,634,820 | A | * | 6/1997 | Vakil | 439/646 |
| 5,816,837 | A | | 10/1998 | Henrici et al. | |
| 5,904,415 | A | * | 5/1999 | Robertson et al. | 362/260 |
| 6,290,522 | B1 | | 9/2001 | Campolo et al. | |
| 6,558,020 | B1 | | 5/2003 | Holzer | |
| 6,582,253 | B1 | * | 6/2003 | Lau | 439/646 |
| D487,252 | S | | 3/2004 | Schweitzer | |
| 6,773,130 | B1 | * | 8/2004 | Richardson | 362/92 |
| 6,790,093 | B2 | | 9/2004 | Tanaka et al. | |
| 6,884,103 | B1 | | 4/2005 | Kovacs | |
| D521,451 | S | * | 5/2006 | Wiskerke | D13/134 |
| 7,097,327 | B1 | | 8/2006 | Barton | |
| 7,125,159 | B2 | * | 10/2006 | Hirsch et al. | 362/651 |
| D537,414 | S | * | 2/2007 | Saito | D13/146 |
| 7,247,040 | B2 | * | 7/2007 | Lingemann et al. | 439/239 |
| 7,275,854 | B2 | | 10/2007 | Dorleijn et al. | |
| 7,604,505 | B2 | * | 10/2009 | Zayas | 439/617 |
| 7,619,352 | B2 | * | 11/2009 | Jeurissen et al. | 313/485 |
| 7,714,494 | B2 | * | 5/2010 | Foo | 313/318.01 |
| 8,021,189 | B2 | * | 9/2011 | Zayas et al. | 439/617 |
| 2004/0150998 | A1 | | 8/2004 | Fan | |
| 2007/0037427 | A1 | | 2/2007 | Miyazono | |
| 2007/0298639 | A1 | | 12/2007 | Elku et al. | |
| 2010/0015843 | A1 | * | 1/2010 | Zayas et al. | 439/375 |

FOREIGN PATENT DOCUMENTS

| | | |
|---|---|---|
| GB | 536273 | 5/1941 |
| JP | 2006310145 | 11/2006 |

OTHER PUBLICATIONS

1000 Bulbs online, 4 ft. T12 Colored Tube Guards retrieved online on Jun. 12, 2009 from: http://www.1000bulbs.com/4-ft.-T12-Colored-Tube-Guards/.

Service Lighting, Medium Bi Pin Turn Type Fluorescent Westinghouse Lamp Holder Socket, retrieved online on Jun. 11, 2009 from: http://www.servicelighting.com/catalog_product.cfm?prod=AX22453.

GE Lighting, GE Cool White Watt-Miser, Power Groove PG17, 42666-F96PG17/CW/WM, retrieved online on Jun. 11, 2009 from: http://genet.gelighting.com/LightProducts/Dispatcher?REQUEST=CONSUMERSPECPAGE&PRODUCTCODE=42666.

General 00390 FE226 BI Pin Socket (L390) Socket Lamp holder, retrieved online on Jun. 12, 2009 from: http://www.amazon.com/Medium-Pedestal-Fluorescent-Leviton-Terminals/dp/B000UX3O4Q/ref=sr_1_2?ie=UTF8&s=hi&qid=1213394501&sr=1-2.

GE Ballast 80628 Fluorescent Lampholer, retrieve online on Jun. 12, 2009 from: http://www.amazon.com/G-Ballast-80628-Fluorescent-Lampholder/dp/B000HMBPXM/ref=sr_1_1?ie=UTF8&qid=1244750205&sr=8-1.

GE Lighting, GE Cool White T12, 10117-F14T12/CW 6PK, retrieved online on Jun. 12, 2009 from: http://genet.gelighting.com/LightProducts/Dispatcher?REQUEST=CONSUMERSPECPAGE&PRODUCTCODE=10117&BreadCrumbValues=Fluorescent_Standard_,0&ModelSelectionFilter=FT0010:Fluorescent_Standard.

Osram, SFc 10-4 Pre-Focus Socket, SharXS, retrieve online on Jun. 12, 2009 from: http://www.osram.de/_global/pdf/osram_de/produkte/display_optic/display_optik/1_Broschueren2/SFC10-4_Benefits_Brochure.pdf.

* cited by examiner

END CAP, SOCKET, AND ADAPTORS FOR USE WITH A LAMP

CROSS REFERENCE TO RELATED APPLICATIONS

This application claims the benefit of the date of the earlier filed provisional applications, U.S. Provisional Application No. 61/060,983, filed on Jun. 12, 2008; and U.S. Provisional Application No. 61/116,336, filed Nov. 20, 2008, the contents of each which are herein incorporated by reference.

FIELD OF THE INVENTION

The invention relates to end caps and sockets used for lamps.

BACKGROUND

Lamps and sockets with a twist-lock mechanism are conventionally known. For example, U.S. Pat. No. 6,290,522 to Campolo, the entire contents of which are incorporated herein by reference, show a conventional twist-lock socket. U.S. Pat. No. 5,816,837 to Henrici and U.S. Pat. No. 7,097,327 to Barton, the entire contents of each of which are hereby incorporated by reference, also show examples of conventional twist-lock sockets. In a conventional twist-lock socket as shown in the above reference, contact pins provided on an end cap of a lamp are slid into a groove in the socket. Once inserted into the socket, the lamp is rotated about its long axis, which brings the pins of the lamp into contact with electrical terminals provided within the socket.

In the field of lamps and lamp bulbs, it will be appreciated that certain lamps may be used with or rated for certain magnitude power supplies. Accordingly, if a lamp is coupled with a socket connected to an inappropriate power supply, it is possible that damage can be caused to the lamp and/or socket, and there could be a risk of fire and sparking that could cause damage to property or injury to persons. In conventional devices there is no mechanism to prevent improper coupling between mismatched lamps and sockets. Thus, conventional sockets and lamp end caps can pose safety risks to users and property.

Therefore, it is desirable to develop a twist-lock socket structured to prevent or "lock out" certain end caps from coupling with the socket, thus helping to ensure that an appropriate lamp bulb can be coupled with a particular socket.

SUMMARY OF THE INVENTION

An embodiment of an end cap and socket system for use with a lamp bulb may include an end cap and a socket having a front face, a pin-receiving end, and a base end, the socket comprising. The end cap may include a cylindrical portion; an end face formed at a first end of the cylindrical portion; a key disk provided on the end face and having a key groove cut into the key disk; and a plurality of contact pins extending from the key disk; wherein the plurality of contact pins is structured to provide electrical to the lamp bulb. The socket may include an insertion groove structured to receive the contact pins therein, wherein the insertion groove begins at the pin-receiving end and extends in a direction toward the base end; a rotation groove cut into the front face of the socket, wherein the rotation groove intersects with the insertion groove; a plurality of electrical contacts positioned within the rotation groove; and a key piece inserted into the rotation groove and being rotatable within the rotation groove, the key piece being provided with a key rib; wherein the key groove and the key rib are configured such that when the end cap is inserted into the socket, the key groove and the key rib are aligned so that the key rib can slide into the key groove.

An embodiment of end cap for use with a lamp bulb may include a cylindrical portion; an end face formed at a first end of the cylindrical portion; a key disk provided on the end face and having a key groove cut into the key disk; and a plurality of contact pins extending from the key disk; wherein the contact pins are structured to provide electrical to the lamp bulb.

An embodiment of an end cap adaptor for use with an end cap may include a body portion; and a hole extending through the body portion; wherein the hole is arranged such that one of the plurality of contact pins can be inserted through the hole.

An embodiment of a socket structured to couple with an end cap having a key groove may include a socket body having a front face, a pin-receiving end, and a base end; an insertion groove structured to receive the contact pins therein, wherein the insertion groove begins at the pin-receiving end and extends in a direction toward the base end; a rotation groove cut into the front face of the socket, wherein the rotation groove intersects with the insertion groove; a plurality of electrical contacts positioned within the rotation groove; and a key piece inserted into the rotation groove and being rotatable within the rotation groove, the key piece being provided with a key rib; wherein the key rib is configured such that when the end cap is inserted into the socket, the key groove and the key rib are aligned so that the key rib can slide into the key groove.

An embodiment of an end cap and socket system for use with a lamp bulb may include an end cap and a socket having a front face, a pin-receiving end, and a base end. The end cap may include a first cylindrical portion having a first diameter; a second cylindrical portion having a second diameter different than the first diameter, the second cylindrical portion being positioned adjacent to the first cylindrical portion in an axial direction; an end face formed at a first end of the end cap; and a plurality of contact pins extending perpendicular to the end face; wherein the plurality contact pins is structured to provide electrical connections to the lamp bulb. The socket may include an insertion groove structured to receive the plurality of contact pins therein, wherein the insertion groove begins at the pin-receiving end and extends in a direction toward the base end; a rotation groove cut into the front face of the socket, wherein the rotation groove intersects with the insertion groove; a plurality of electrical contacts positioned within the rotation groove; and a key portion projecting from the front face, the key portion structured to couple with the second cylindrical portion of the end cap.

An embodiment of an end cap for use with a lamp bulb may include a first cylindrical portion having a first diameter; a second cylindrical portion having a second diameter different than the first diameter, the second cylindrical portion being positioned adjacent to the first cylindrical portion in an axial direction; an end face formed at a first end of the end cap; and a plurality of contact pins extending perpendicular to the end face; wherein the plurality contact pins is structured to provide electrical connections to the lamp bulb.

An embodiment of a socket structured to couple with an end cap may include a socket body having a front face, a pin-receiving end, and a base end; an insertion groove structured to receive the plurality of contact pins therein, wherein the insertion groove begins at the pin-receiving end and extends in a direction toward the base end; a rotation groove cut into the front face of the socket, wherein the rotation groove intersects with the insertion groove; a plurality of electrical contacts positioned within the rotation groove; and a key portion projecting from the front face.

An embodiment of a socket adaptor structured to fit over a socket comprising a rotation groove cut into a front face of the socket may include a hollow adaptor body; an adaptor front face that sits adjacent to the front face of the socket; and a key portion provided on the adaptor front face.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 119 shows an exploded perspective view of an end cap with an adaptor according to at least an embodiment.

FIG. 120 shows a perspective view of an end cap with an adaptor according to at least an embodiment.

FIG. 121 shows an exploded perspective view of an end cap and adaptor according to at least an embodiment.

FIG. 122 shows a perspective view of an end cap and adaptor according to at least an embodiment.

DETAILED DESCRIPTION OF PREFERRED EMBODIMENTS

Figure 1:
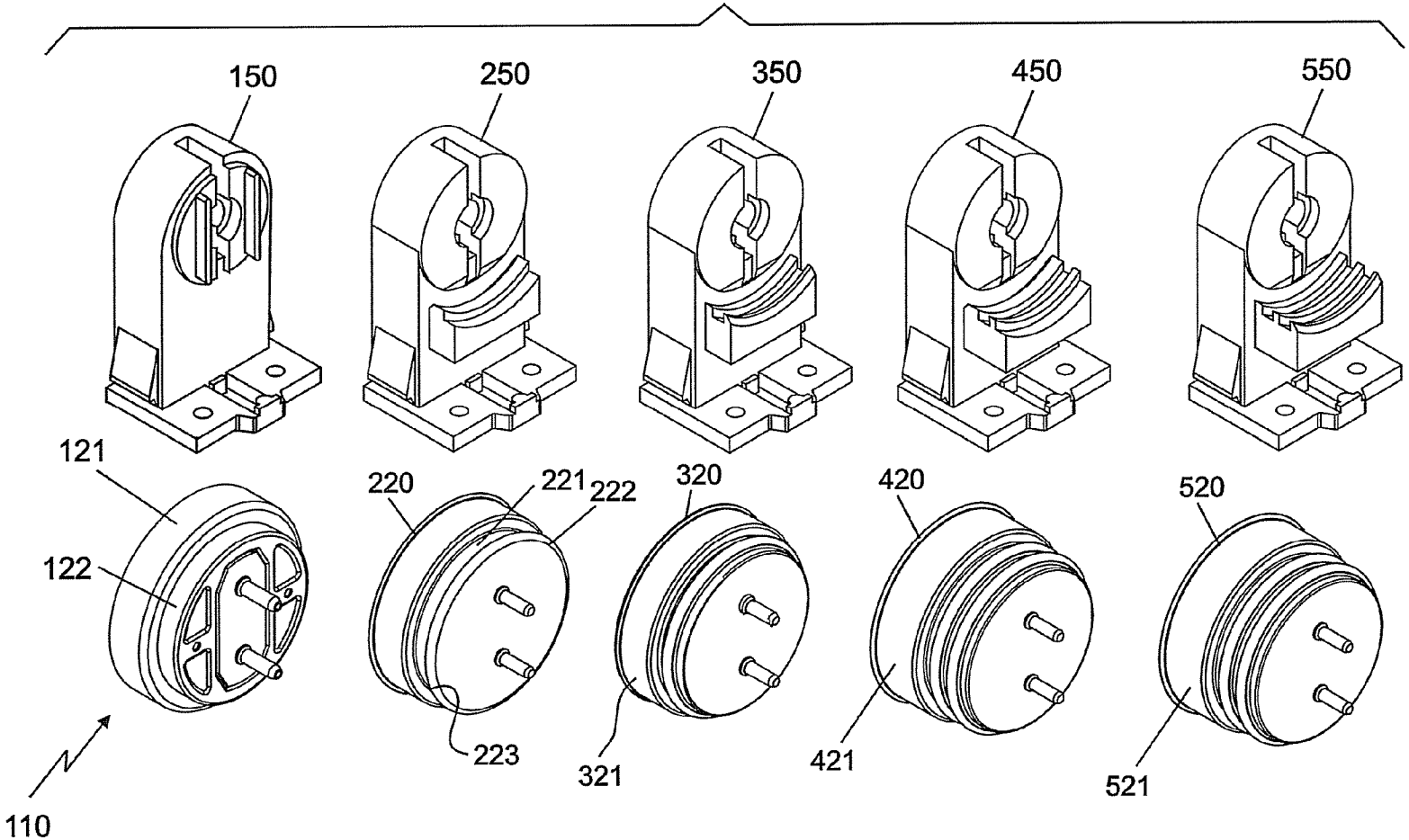
FIG. 1 shows perspective views of end caps and sockets according to various embodiments.
Figure 2:
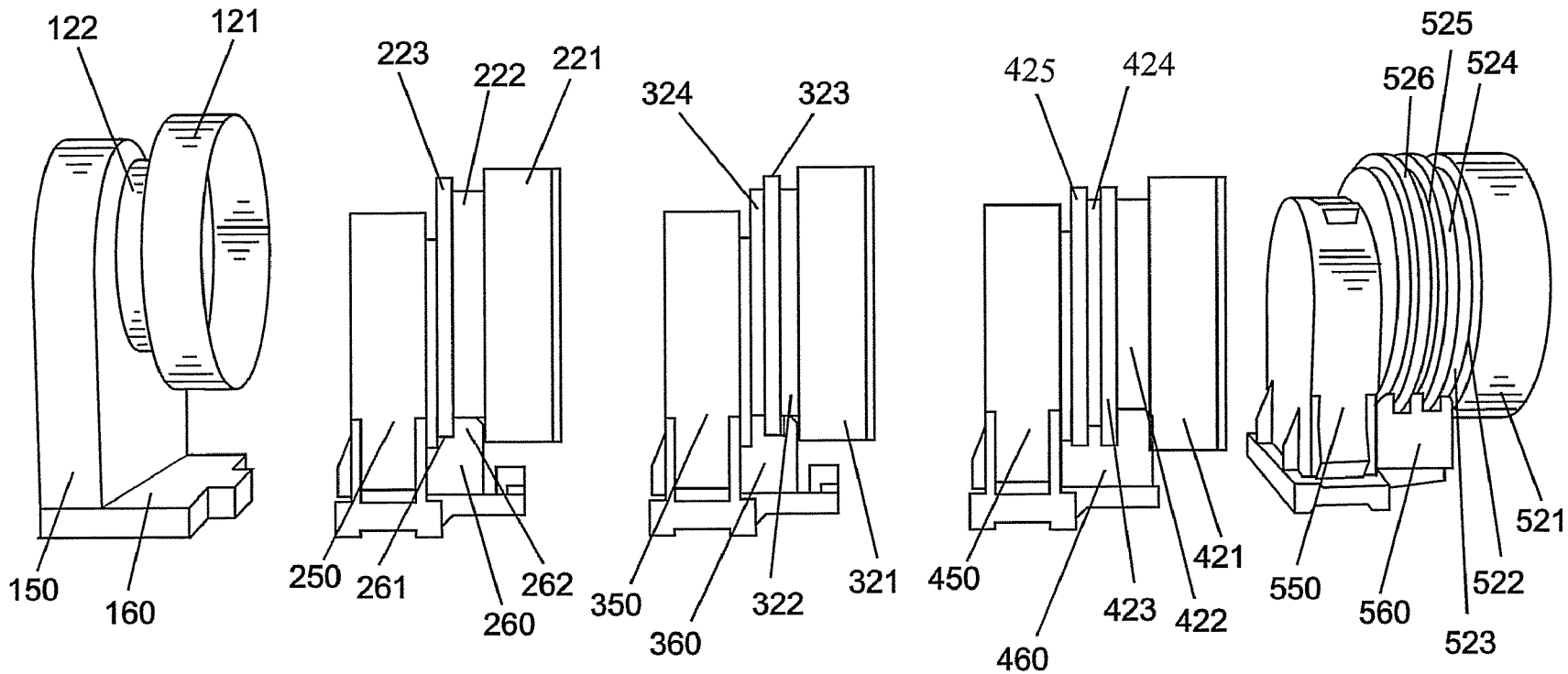
FIG. 2 shows perspective views of end caps coupled with sockets according to various embodiments.
Figure 4:
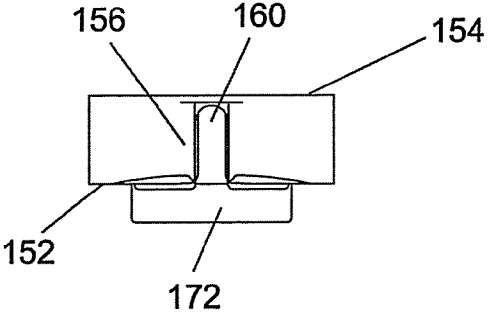
FIG. 4 is a top view of a socket according to at least an embodiment.
Figure 6:
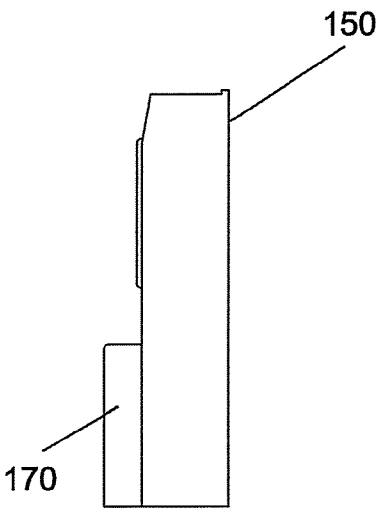
FIG. 6 is a side view of a socket according to at least an embodiment.
Figure 5:
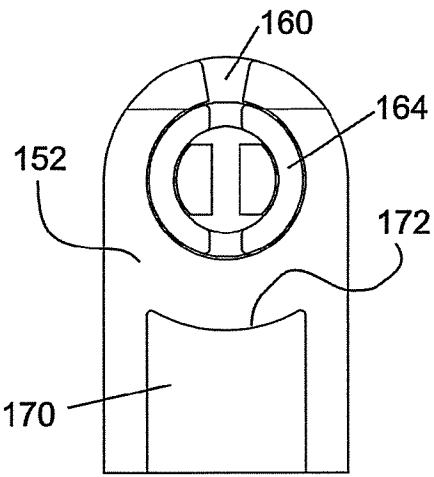
FIG. 5 is a front view of a socket according to at least an embodiment.

FIGS. 1-2 illustrate sockets and embodiments according to various embodiments.

In particular, FIGS. 1-10 illustrate end cap 110 and socket 150 according to at least one embodiment. End cap 110 may include a first cylindrical portion 121 and a second cylindrical portion 122. First cylindrical portion 121 has a given length and diameter and is open on one end to receive a lamp bulb (not shown) therein. Second cylindrical portion 122 is positioned adjacent to first cylindrical portion in an axial direction. Second cylindrical portion 122 also has a diameter that is different than the diameter of first cylindrical portion 121. While FIGS. 1-2 and 7-10 show that the diameter of second cylindrical portion 122 is smaller than the diameter of first cylindrical portion 121, it will be readily understood that the diameter of the second cylindrical portion may be larger than that of the first cylindrical portion in other embodiments, to be used with a socket having an appropriately sized key portion.

End cap 110 may also include an end face 112 that is positioned at an end of second cylindrical portion 122 away from first cylindrical portion 121. Contact pins 114 may extend from end face 112 of the end cap 110, extending in a direction perpendicular to end face 112. Contact pins 114 may be structured to provide electrical connections to the lamp bulb. FIGS. 7-10 show contact pins 114 arranged in a medium bi-pin configuration, but it will be understood that other pin spacings can also be easily substituted.

As seen in FIGS. 3-6, socket 150 has a front face 152, a back face 154, a pin-receiving end 156, and a base end 158. Socket 150 may include an insertion groove 160 structured to receive the contact pins 114 of end cap 110. Insertion groove 160 begins at the pin-receiving end 156 and extends in a direction toward base end 158.

Socket 150 may also include a rotation groove 164 that is generally circular in shape. Rotation groove 164 is cut into the front face of the socket body and intersects with insertion groove 160. Socket 150 may also include electrical contacts that are positioned within rotation groove 164. When contact pins 114 of end cap 110 are rotated in rotation groove 164, contact pins 114 can come in contact with the electrical contacts, thus creating an electrical connection between the lamp bulb and the socket 150.

Socket 150 may also include a key portion 170 that projects from front face 152. A top surface 172 of key portion 170 is proximate to rotation groove 164 and may be shaped as a circular arc. It is noted that the word "top" is only used as a point of reference, and is not meant to indicate that socket 150 must be oriented in a particular way.

Key portion 170 has a height and depth so that it can be mated with end cap 110. For example, as seen in FIG. 2, second cylindrical portion 122 of end cap 110 aligns with key portion 170. The height of key portion 170 is also configured such that when second cylindrical portion 122 rests on key portion 170, contacts pins 114 are in position to be rotated through rotation groove 164. It will be understood that the dimensions of key portion 170 and second cylindrical portion 122 can be varied to create many possible combinations of mated pairs of sockets 150 and end caps 170.

Figure 63:
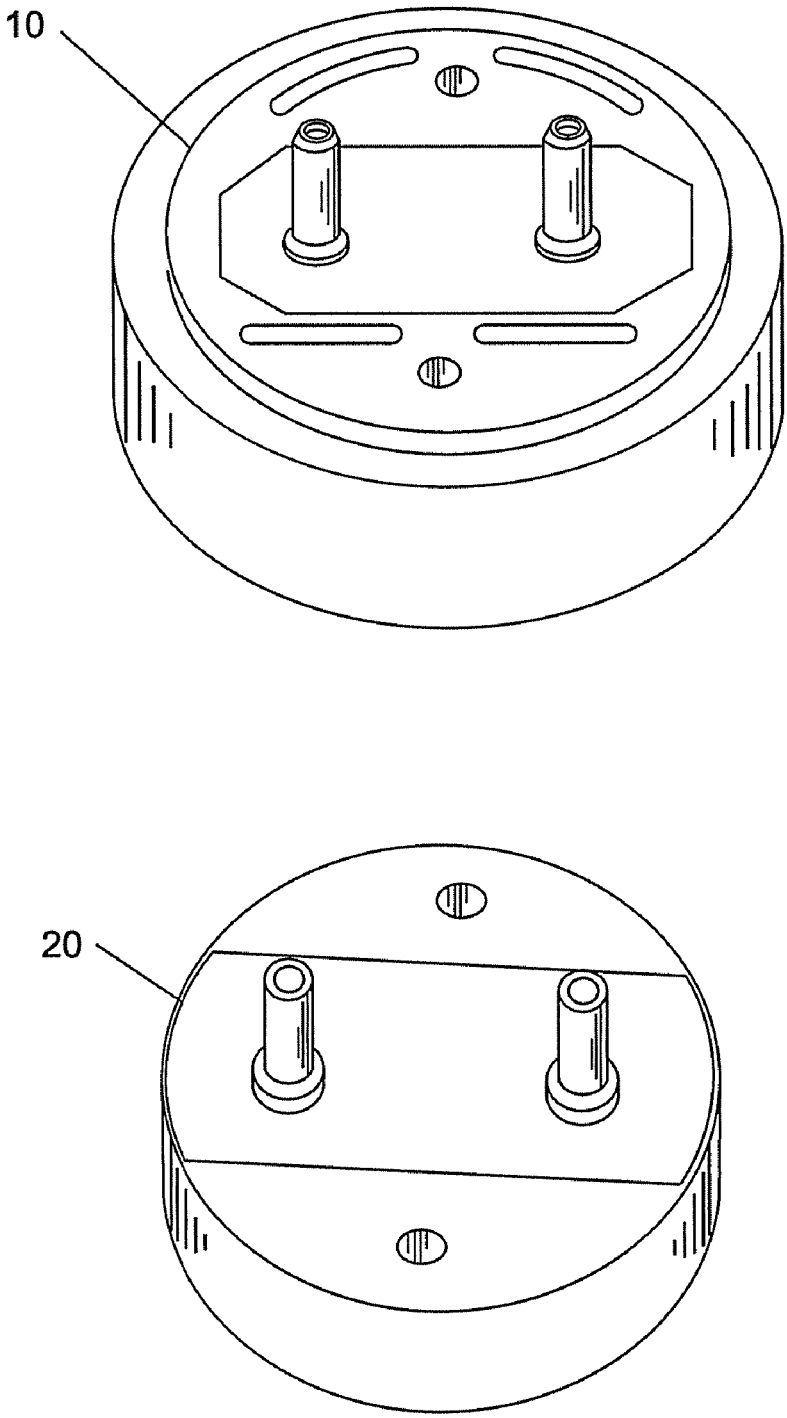
FIG. 63 Prior Art
FIG. 63 is a perspective view of conventional end caps.

These features of key portion 170 help to prevent other end caps from being coupled with socket 150. For example, if conventional end cap 10 (seen in FIG. 63) were used with socket 150, the body of end cap 10 would abut with key portion 170, and contact pins of end cap 10 would not be inserted far enough into insertion groove 160 to be rotated through rotation groove 164. This can also be seen in FIG. 56, which shows a conventional end cap 20 that does not properly couple with socket 650 because it abuts with key portion 670.

This ability of socket 150 to prevent coupling with conventional end caps is an important safety feature. For example, a socket may be connected to a power supply of a certain magnitude. If a user inserts a bulb and end cap into the socket that is not compatible with the power supply, then the bulb and/or socket could be damaged, and there is a risk of electrical shock to the user or a risk of sparking and fire. Thus, a socket 150 with key portion 170 can be configured to only accept bulbs with end caps 110 having a properly sized second cylindrical portion 122, thereby helping to ensure that only a properly selected bulb is inserted, and thereby preventing damage to property and ensuring the safety of workers.

FIGS. 1-2 and 57-58 illustrate end cap 210 and socket 250 according to at least another embodiment.

Figure 58:
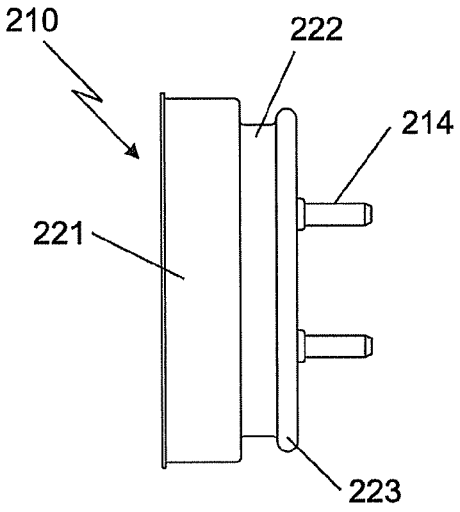
FIG. 58 is a side view of an end cap according to at least an embodiment.

End cap 210 may include a first cylindrical portion 221, a second cylindrical portion 222, and a third cylindrical portion 223. First cylindrical portion 221 has a given length and diameter and is open on one end to receive a lamp bulb (not shown) therein. Second cylindrical portion 222 is positioned adjacent to first cylindrical portion in an axial direction. Second cylindrical portion 222 also has a diameter that is different than the diameter of first cylindrical portion 221. While FIG. 58 shows that the diameter of second cylindrical portion 222 is smaller than the diameter of first cylindrical portion 221, it will be readily understood that the diameter of the second cylindrical portion may be larger than that of the first cylindrical portion in other embodiments, to be used with a socket having an appropriately sized key portion.

End cap 210 may also include third cylindrical portion 223. Third cylindrical portion 223 is positioned adjacent to second cylindrical portion 222 in an axial direction, and has a diameter different than the diameter of second cylindrical portion 222. While FIG. 58 shows that the diameter of second cylindrical portion 222 is smaller than the diameter of third cylindrical portion 223, it will be readily understood that the diameter of the second cylindrical portion may be larger than that of the third cylindrical portion in other embodiments, to be used with a socket having an appropriately sized key portion.

End cap 210 may also include an end face 212 that is positioned at an end of third cylindrical portion 223 away from first cylindrical portion 221. Contact pins 214 may extend from end face 212 of the end cap 210, extending in a direction perpendicular to end face 212. Contact pins 214 may be structured to provide electrical connections to the lamp bulb. FIG. 58 show contact pins 214 arranged in a medium bi-pin configuration, but it will be understood that other pin spacings can also be easily substituted.

Socket 250 is of similar structure to socket 150 described above, but has a different key portion 270. Key portion 270 projects from a front face 252 of socket 250. Key portion 270 may include a first key segment 271 adjacent to front face 252 and a second key segment 272 positioned adjacent to first key segment 271 in a direction away from front face 252. In the particular embodiment seen in FIG. 57, first key segment 271 is in the form of a groove, and second key segment 272 is in the form of a ridge. As seen in FIG. 2, when end cap 210 couples with socket 250, third cylindrical portion 223 can couple with first key segment 271 and second cylindrical portion 222 can couple with second key segment 272. End cap 210 can then be rotated to lock contact pins 214 into place.

It will be understood that key portion 270 of socket 250 can prevent coupling with unmatched end caps. For example, if a conventional end cap were inserted into socket 250, the end cap would abut with key portion 270 and it would not be able to rotate the conventional end cap to lock the contact pins into place. As noted in detail above, this ability to prevent coupling with non-mated end caps is an important safety feature.

FIGS. 11-18 illustrate an end cap 310 and socket 350 according to at least another embodiment. End cap 310 may include a first cylindrical portion 321 and a second cylindrical portion 322. First cylindrical portion 321 has a given length and diameter and is open on one end to receive a lamp bulb (not shown) therein. Second cylindrical portion 322 is positioned adjacent to first cylindrical portion in an axial direction. Second cylindrical portion 322 also has a diameter that is different than the diameter of first cylindrical portion 321. While FIGS. 15-18 show that the diameter of second cylindrical portion 322 is smaller than the diameter of first cylindrical portion 321, it will be readily understood that the diameter of the second cylindrical portion may be larger than that of the first cylindrical portion in other embodiments, to be used with a socket having an appropriately sized key portion.

End cap 310 may also include third cylindrical portion 323. Third cylindrical portion 323 is positioned adjacent to second cylindrical portion 322 in an axial direction, and has a diameter different than the diameter of second cylindrical portion 322. While FIGS. 15-18 show that the diameter of second cylindrical portion 322 is smaller than the diameter of third cylindrical portion 323, it will be readily understood that the diameter of the second cylindrical portion may be larger than that of the third cylindrical portion in other embodiments, to be used with a socket having an appropriately sized key portion.

End cap 310 may also include fourth cylindrical portion 324. Fourth cylindrical portion 324 is positioned adjacent to third cylindrical portion 323 in an axial direction, and has a diameter different than the diameter of third cylindrical portion 323. While FIGS. 15-18 show that the diameter of fourth cylindrical portion 324 is smaller than the diameter of third cylindrical portion 323, it will be readily understood that the diameter of the fourth cylindrical portion may be larger than that of the third cylindrical portion in other embodiments, to be used with a socket having an appropriately sized key portion.

End cap 310 may also include an end face 312 that is positioned at an end of fourth cylindrical portion 324 away from first cylindrical portion 321. Contact pins 314 may extend from end face 312 of the end cap 310, extending in a direction perpendicular to end face 312. Contact pins 314 may be structured to provide electrical connections to the lamp bulb. FIGS. 15-18 show contact pins 314 arranged in a medium bi-pin configuration, but it will be understood that other pin spacings can also be easily substituted.

As seen in FIGS. 11-14, socket 350 has a front face 352, a back face 354, a pin-receiving end 356, and a base end 358. Socket 350 may include an insertion groove 360 structured to receive the contact pins 314 of end cap 310. Insertion groove 360 begins at the pin-receiving end 356 and extends in a direction toward base end 358.

Socket 350 may also include a rotation groove that is generally circular in shape. Rotation groove is cut into the front face of the socket body and intersects with insertion groove 360. Socket 350 may also include electrical contacts that are positioned within the rotation groove. When contact pins 314 of end cap 310 are rotated in rotation groove, contact pins 314 can come in contact with the electrical contacts, thus creating an electrical connection between the lamp bulb and the socket 350.

Socket 350 may also include key portion 370. Key portion 370 projects from a front face 352 of socket 350. Key portion 370 may include a first key segment 381 adjacent to front face 352, a second key segment 382 positioned adjacent to first key segment 381 in a direction away from front face 352, and a third key segment 383 positioned adjacent to second key segment 382 in a direction away from front face 352. In the particular embodiment seen in FIGS. 11-14, first key segment 381 is in the form of a ridge, second key segment 382 is in the form of a groove, and third key segment 383 is in the form of a ridge. As seen in FIG. 2, when end cap 310 couples with socket 350, fourth cylindrical portion 324 can couple with first key segment 381, third cylindrical portion 323 can couple with second key segment 382, and second cylindrical portion 322 can couple with third key segment 383. End cap 310 can then be rotated to lock contact pins 314 into place.

It will be understood that key portion 370 of socket 350 can prevent coupling with unmatched end caps. For example, if a conventional end cap were inserted into socket 350, the end cap would abut with key portion 370 and it would not be able to rotate the conventional end cap to lock the contact pins into place. As noted in detail above, this ability to prevent coupling with non-mated end caps is an important safety feature.

FIGS. 1-2 and 59-60 illustrate end cap 410 and socket 450 according to at least another embodiment.

Figure 60:
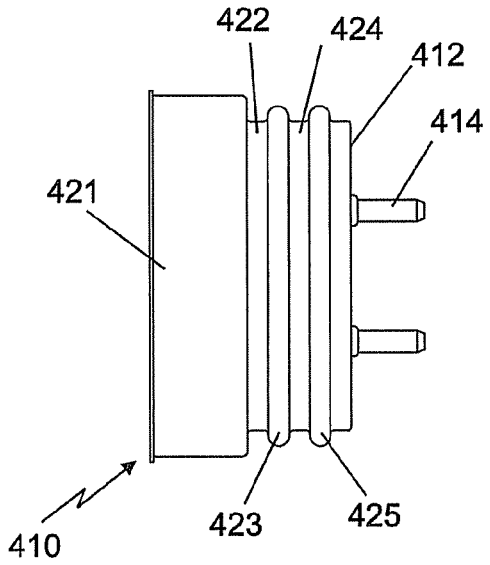
FIG. 60 is a side view of an end cap according to at least an embodiment.

End cap 410 may include a first cylindrical portion 421, a second cylindrical portion 422, a third cylindrical portion 423, a fourth cylindrical portion 424, and a fifth cylindrical portion 425. First cylindrical portion 421 has a given length and diameter and is open on one end to receive a lamp bulb (not shown) therein. Second cylindrical portion 422 is positioned adjacent to first cylindrical portion in an axial direction. Second cylindrical portion 422 also has a diameter that is different than the diameter of first cylindrical portion 421. While FIG. 60 shows that the diameter of second cylindrical portion 422 is smaller than the diameter of first cylindrical portion 421, it will be readily understood that the diameter of the second cylindrical portion may be larger than that of the first cylindrical portion in other embodiments, to be used with a socket having an appropriately sized key portion.

End cap 410 may also include third cylindrical portion 423. Third cylindrical portion 423 is positioned adjacent to second cylindrical portion 422 in an axial direction, and has a diameter different than the diameter of second cylindrical portion 422. While FIG. 60 shows that the diameter of second cylindrical portion 422 is smaller than the diameter of third cylindrical portion 423, it will be readily understood that the diameter of the second cylindrical portion may be larger than that of the third cylindrical portion in other embodiments, to be used with a socket having an appropriately sized key portion.

End cap 410 may also include fourth cylindrical portion 424. Fourth cylindrical portion 424 is positioned adjacent to third cylindrical portion 423 in an axial direction, and has a diameter different than the diameter of third cylindrical portion 423. While FIG. 60 shows that the diameter of fourth cylindrical portion 424 is smaller than the diameter of third cylindrical portion 424, it will be readily understood that the diameter of the fourth cylindrical portion may be larger than that of the third cylindrical portion in other embodiments, to be used with a socket having an appropriately sized key portion.

End cap 410 may also include fifth cylindrical portion 425. Fifth cylindrical portion 425 is positioned adjacent to fourth cylindrical portion 424 in an axial direction, and has a diameter different than the diameter of fourth cylindrical portion 424. While FIG. 60 shows that the diameter of fourth cylindrical portion 424 is smaller than the diameter of fifth cylindrical portion 425, it will be readily understood that the diameter of the fourth cylindrical portion may be larger than that of the fifth cylindrical portion in other embodiments, to be used with a socket having an appropriately sized key portion.

End cap 410 may also include an end face 412 that is positioned at an end of fifth cylindrical portion 425 away from first cylindrical portion 421. Contact pins 414 may extend from end face 412 of the end cap 410, extending in a direction perpendicular to end face 412. Contact pins 414 may be structured to provide electrical connections to the lamp bulb. FIG. 60 show contact pins 414 arranged in a medium bi-pin configuration, but it will be understood that other pin spacings can also be easily substituted.

Socket 450 is of similar structure to other sockets described above, but has a different key portion 470. Key portion 470 projects from a front face 452 of socket 450. Key portion 470 may include a first key segment 481 adjacent to front face 452, a second key segment 482 positioned adjacent to first key segment 481 in a direction away from front face 452, a third key segment 483 positioned adjacent to first key segment 482 in a direction away from front face 452, and a fourth key segment 484 positioned adjacent to first key segment 481 in a direction away from front face 452. In the particular embodiment seen in FIG. 58, first key segment 481 is in the form of a groove, second key segment 482 is in the form of a ridge, third key segment 483 is in the form of a groove, and fourth key segment 483 is in the form of a ridge. As seen in FIG. 2, when end cap 410 couples with socket 450, third cylindrical portion fifth cylindrical portion 425 can couple with first key segment 481, fourth cylindrical portion 424 can couple with second key segment 482, third cylindrical portion 423 can couple with third key segment 483, and second cylindrical portion 422 can couple with fourth key segment 484. End cap 410 can then be rotated to lock contact pins 414 into place.

It will be understood that key portion 470 of socket 450 can prevent coupling with unmatched end caps. For example, if a conventional end cap were inserted into socket 450, the end cap would abut with key portion 470 and it would not be able to rotate the conventional end cap to lock the contact pins into place. As noted in detail above, this ability to prevent coupling with non-mated end caps is an important safety feature.

FIGS. 27-34 illustrate an end cap 510 and socket 550 according to at least another embodiment. End cap 510 may include a first cylindrical portion 521 and a second cylindrical portion 522. First cylindrical portion 521 has a given length and diameter and is open on one end to receive a lamp bulb (not shown) therein. Second cylindrical portion 522 is positioned adjacent to first cylindrical portion in an axial direction. Second cylindrical portion 522 also has a diameter that is different than the diameter of first cylindrical portion 521. While FIGS. 31-34 show that the diameter of second cylindrical portion 522 is smaller than the diameter of first cylindrical portion 521, it will be readily understood that the diameter of the second cylindrical portion may be larger than that of the first cylindrical portion in other embodiments, to be used with a socket having an appropriately sized key portion.

End cap 510 may also include third cylindrical portion 523. Third cylindrical portion 523 is positioned adjacent to second cylindrical portion 522 in an axial direction, and has a diameter different than the diameter of second cylindrical portion 522. While FIGS. 31-34 show that the diameter of second cylindrical portion 522 is smaller than the diameter of third cylindrical portion 523, it will be readily understood that the diameter of the second cylindrical portion may be larger than that of the third cylindrical portion in other embodiments, to be used with a socket having an appropriately sized key portion.

End cap 510 may also include fourth cylindrical portion 524. Fourth cylindrical portion 524 is positioned adjacent to third cylindrical portion 523 in an axial direction, and has a diameter different than the diameter of third cylindrical portion 523. While FIGS. 31-34 show that the diameter of fourth cylindrical portion 524 is smaller than the diameter of third cylindrical portion 524, it will be readily understood that the diameter of the fourth cylindrical portion may be larger than that of the third cylindrical portion in other embodiments, to be used with a socket having an appropriately sized key portion.

End cap 510 may also include fifth cylindrical portion 525. Fifth cylindrical portion 525 is positioned adjacent to fourth cylindrical portion 524 in an axial direction, and has a diameter different than the diameter of fourth cylindrical portion 524. While FIGS. 31-34 show that the diameter of fourth cylindrical portion 524 is smaller than the diameter of fifth cylindrical portion 525, it will be readily understood that the diameter of the fourth cylindrical portion may be larger than that of the fifth cylindrical portion in other embodiments, to be used with a socket having an appropriately sized key portion.

End cap 510 may also include sixth cylindrical portion 526. Sixth cylindrical portion 526 is positioned adjacent to fifth cylindrical portion 525 in an axial direction, and has a diameter different than the diameter of fifth cylindrical portion 525. While FIGS. 31-34 show that the diameter of sixth cylindrical portion 526 is smaller than the diameter of fifth cylindrical portion 525, it will be readily understood that the diameter of the sixth cylindrical portion may be larger than that of the fifth cylindrical portion in other embodiments, to be used with a socket having an appropriately sized key portion.

End cap 510 may also include an end face 512 that is positioned at an end of sixth cylindrical portion 526 away from first cylindrical portion 521. Contact pins 514 may extend from end face 512 of the end cap 510, extending in a direction perpendicular to end face 512. Contact pins 514 may be structured to provide electrical connections to the lamp bulb. FIGS. 31-34 show contact pins 514 arranged in a medium bi-pin configuration, but it will be understood that other pin spacings can also be easily substituted.

As seen in FIGS. 27-30, socket 550 has a front face 552, a back face 554, a pin-receiving end 556, and a base end 558. Socket 550 may include an insertion groove 560 structured to receive the contact pins 514 of end cap 510. Insertion groove 560 begins at the pin-receiving end 556 and extends in a direction toward base end 558.

Socket 550 may also include a rotation groove that is generally circular in shape. Rotation groove is cut into the front face of the socket body and intersects with insertion groove 560. Socket 550 may also include electrical contacts that are positioned within the rotation groove. When contact pins 514 of end cap 510 are rotated in rotation groove, contact pins 514 can come in contact with the electrical contacts, thus creating an electrical connection between the lamp bulb and the socket 550.

Socket 550 may also include key portion 570. Key portion 570 projects from a front face 552 of socket 550. Key portion 570 may include a first key segment 581 adjacent to front face 552, a second key segment 582 positioned adjacent to first key segment 581 in a direction away from front face 552, a third key segment 583 positioned adjacent to second key segment 582 in a direction away from front face 552, a fourth key segment 584 positioned adjacent to third key segment 583 in a direction away from front face 552, and a fifth key segment 585 positioned adjacent to fourth key segment 584 in a direction away from front face 552. In the particular embodiment seen in FIGS. 11-14, first key segment 581 is in the form of a ridge, second key segment 582 is in the form of a groove, third key segment 583 is in the form of a ridge, fourth key segment 584 is in the form of a groove, and fifth key segment 585 is in the form of a ridge.

As seen in FIG. 2, when end cap 510 couples with socket 550, sixth cylindrical portion 526 can couple with first key segment 581, fifth cylindrical portion 525 can couple with second key segment 582, fourth cylindrical portion 524 can couple with third key segment 583, third cylindrical portion 523 can couple with fourth key segment 584, and second cylindrical portion 522 can couple with fifth key segment 585. End cap 510 can then be rotated to lock contact pins 514 into place.

It will be understood that key portion 570 of socket 550 can prevent coupling with unmatched end caps. For example, if a conventional end cap were inserted into socket 550, the end cap would abut with key portion 570 and it would not be able to rotate the conventional end cap to lock the contact pins into place. As noted in detail above, this ability to prevent coupling with non-mated end caps is an important safety feature.

The embodiments described above have included key portions with a particular arrangement of grooves and ridges. However, it will be understood that the particular sequence of grooves and ridges can be modified so that many different specific configurations of key portions can be possible. For example, FIGS. 19-22 and 35-38 show at least some possible embodiments of other possible key configurations on socket 50.

Figure 61:
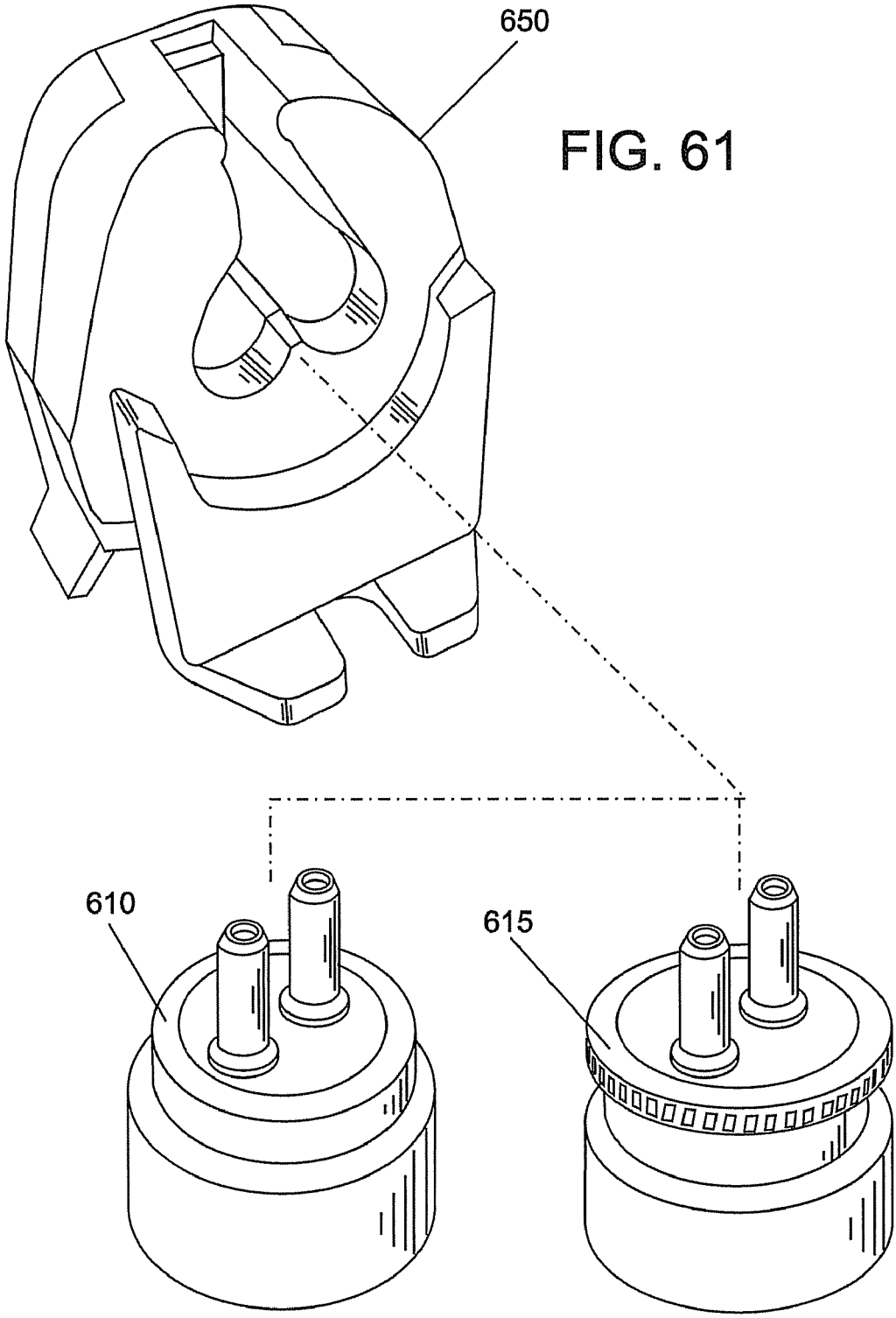
FIG. 61 is a perspective view of end caps and a socket according to various embodiments.
Figure 62:
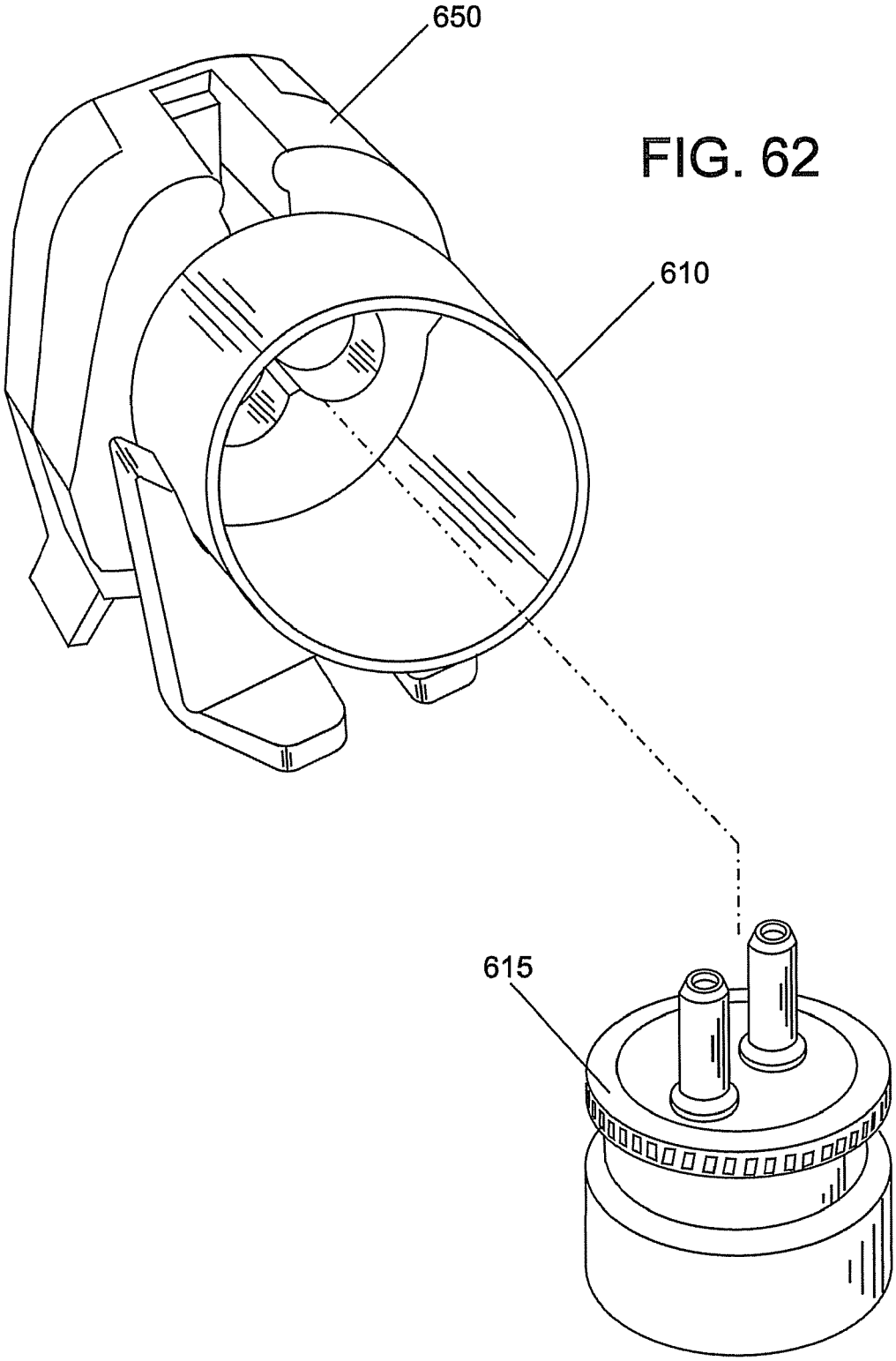
FIG. 62 is a perspective view of end caps and a socket according to various embodiments.

Additionally, the Figures described above show an end cap of size T12. However, it will be understood that other embodiments are possible with different sized end caps. For example, FIGS. 56 shows an embodiment with a T5 end cap 610 having a first cylindrical portion 621 and a second cylindrical portion 622. FIG. 56 further shows a socket 650 having key portion 670 for use with end cap 610. FIGS. 61-62 show at least some additional possible embodiments including end caps 610, 615 and socket 650.

Figure 44:
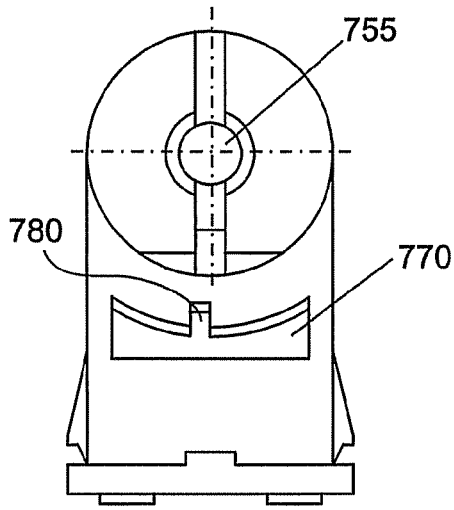
FIG. 44 is a front view of a socket according to at least an embodiment.
Figure 45:
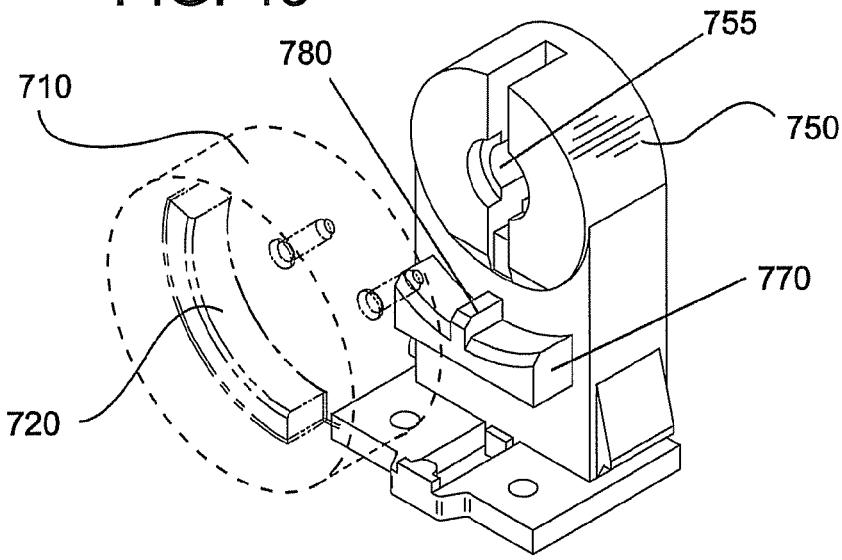
FIG. 45 is a perspective view of a socket and end cap according to at least an embodiment.
Figure 46:
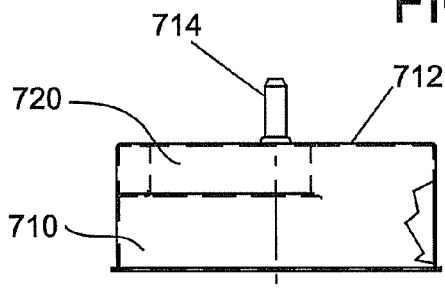
FIG. 46 is a side view of an end cap according to at least an embodiment.
Figure 47:
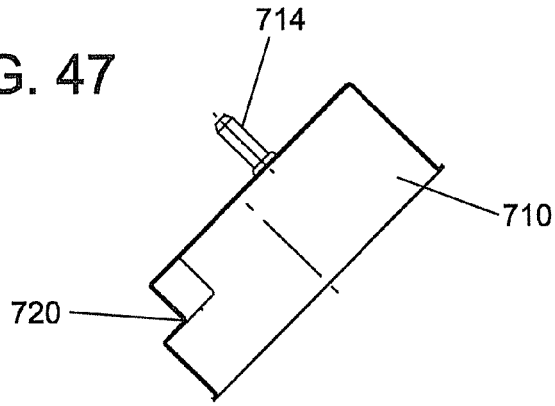
FIG. 47 is a side view of an end cap according to at least an embodiment.
Figure 48:
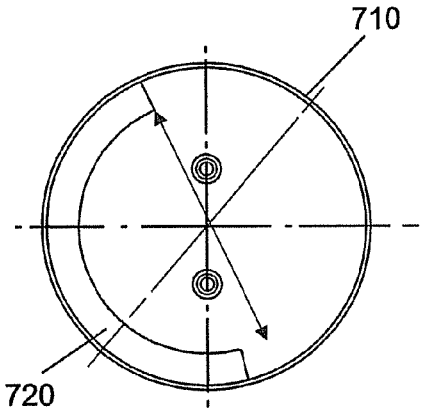
FIG. 48 is a front view of an end cap according to at least an embodiment.
Figure 49:
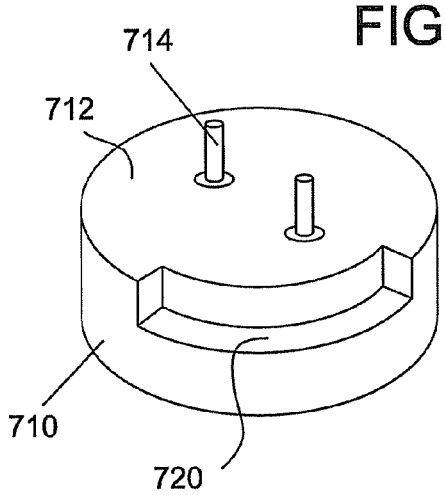
FIG. 49 is a perspective view of an end cap according to at least an embodiment.

FIGS. 43-49 show an end cap 710 and socket 750 according to at least another embodiment. Socket 750 is similar to the sockets discussed above in that a key portion 770 projects from a front face 752 of socket 750. However, as seen in FIGS. 44-45, key portion 770 has a key protrusion 780 projecting in a direction towards central hole 755.

End cap 710 may be a cylindrical body that is open on one end to receive a bulb therein. An end face 712 may be found on a second end of end cap 710, and contact pins 714 may extend perpendicularly from end face 712.

Additionally, end cap 710 may include a key groove 720. Key groove 720 is formed in the end face of end cap 710, and extends along the outer circumference of end face 712. In the embodiment shown in FIGS. 43-49, key groove 720 extends for at least 90 degrees of the circumference of end face 712, allowing for the end cap 710 to be rotated at least 90 degrees to lock contact pins 714 into place. The size of key groove 720 in a radial direction (i.e., a radial direction of end face 712) corresponds to a height of key protrusion 780.

Figure 50:
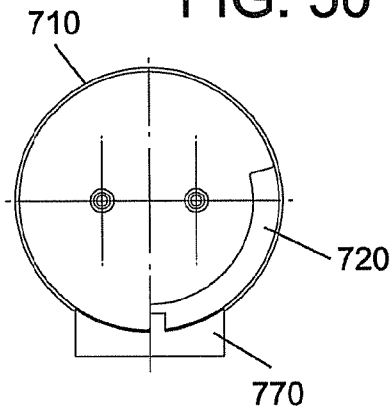
FIG. 50 is a front view of an end cap coupled with a socket key according to at least an embodiment.
Figure 51:
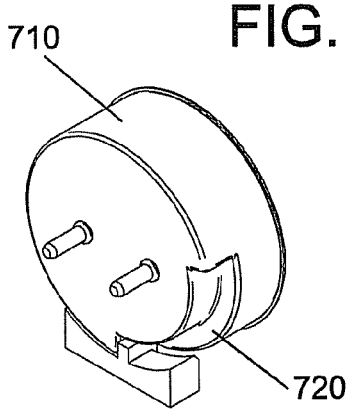
FIG. 51 is a perspective view of an end cap coupled with a socket key according to at least an embodiment.

Key protrusion 780 and key groove 720 are important features that help to insure proper coupling of end cap 710 with socket 750. For example, when end cap 710 is properly inserted into socket 750, key groove 720 aligns with key protrusion 780, and socket 710 can be rotated, as seen in FIGS. 50-51. However, if socket 710 is not properly inserted, then the cylindrical body of end cap 710 will abut with key protrusion 780 and contact pins 714 will not be properly aligned in socket 750, thus preventing end cap 710 from being rotated.

This is an important safety feature in that it helps to insure that a proper end cap and bulb is inserted into a particular socket. Additionally, this feature is important for applications in which it is necessary to insure that the contact pins of an end cap are connected to electrical contacts of a particular polarity. For example it may be necessary to insure that one of the contact pins is always connected to a positive voltage, and the other contact pin is connected to ground. In this situation, such an alignment can be insured because an end cap 710 with key groove 720 can only be inserted and rotated in a socket 750 with key protrusion 780 in one particular orientation. If a user tries to rotate end cap 710 in a direction opposite of the desired direction, one end of key groove 720 will abut with key protrusion 780, thus preventing rotation. Additionally, if end cap 710 was inserted opposite of the property orientation, the cylindrical body of end cap 710 would abut with key protrusion 780, thus preventing contact pins 714 from being fully inserted and rotated.

Figure 52:
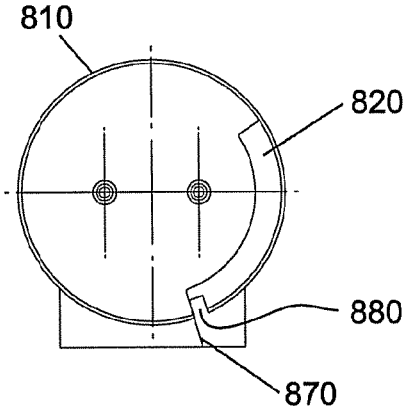
FIG. 52 is a front view of an end cap coupled with a socket key according to at least an embodiment.
Figure 53:
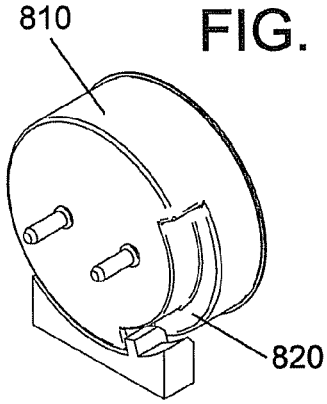
FIG. 53 is a perspective view of an end cap coupled with a socket key according to at least an embodiment.

FIGS. 43-51 show an embodiment in which key protrusion 780 is located at approximately the center of key portion 770. However, it will be understood that other orientations are possible. For example, FIGS. 52-53 show an embodiment where key protrusion 880 is positioned partway between the center of key portion 870 and an end of key portion 880. Accordingly, key groove 820 of end cap 810 is located at an appropriate circumferential position to fit the key protrusion 880.

Figure 54:
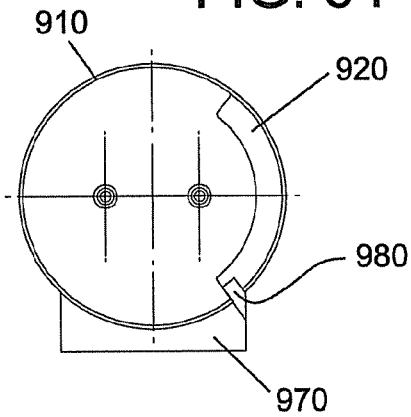
FIG. 54 is a front view of an end cap coupled with a socket key according to at least an embodiment.
Figure 55:
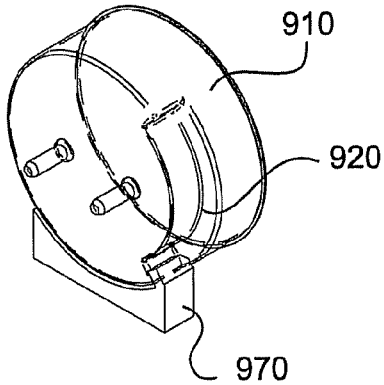
FIG. 55 is a perspective view of an end cap coupled with a socket key according to at least an embodiment.
Figure 56A:
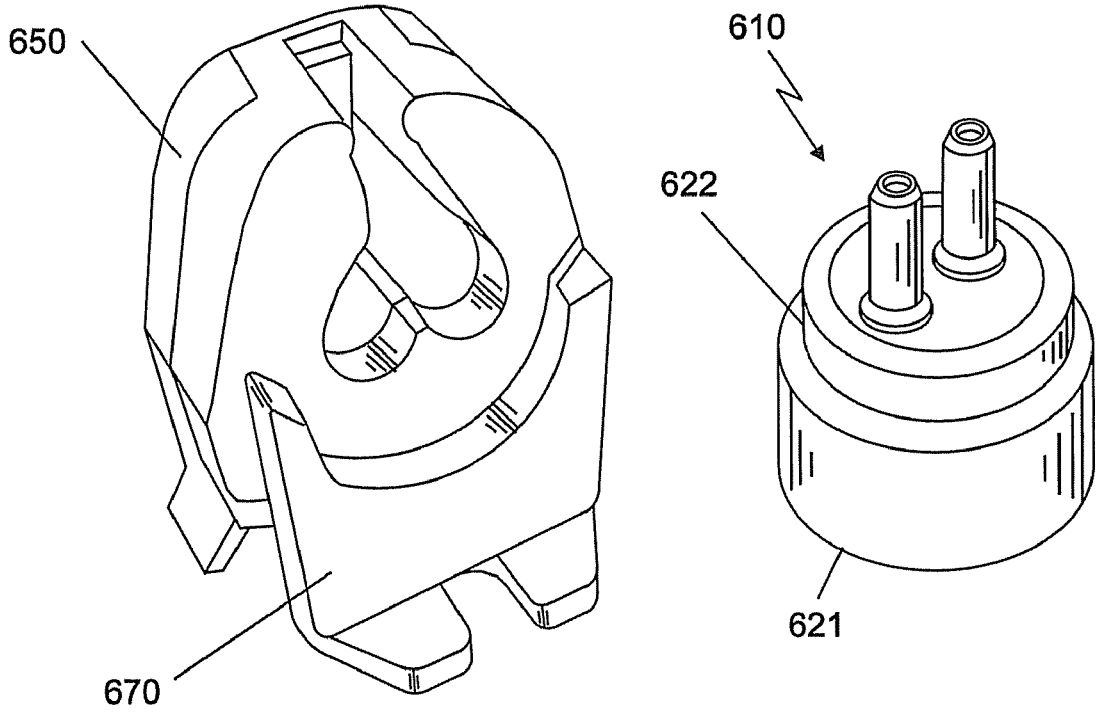
FIG. 56 is a composite view of end caps and sockets according to various embodiments.
Figure 56B:
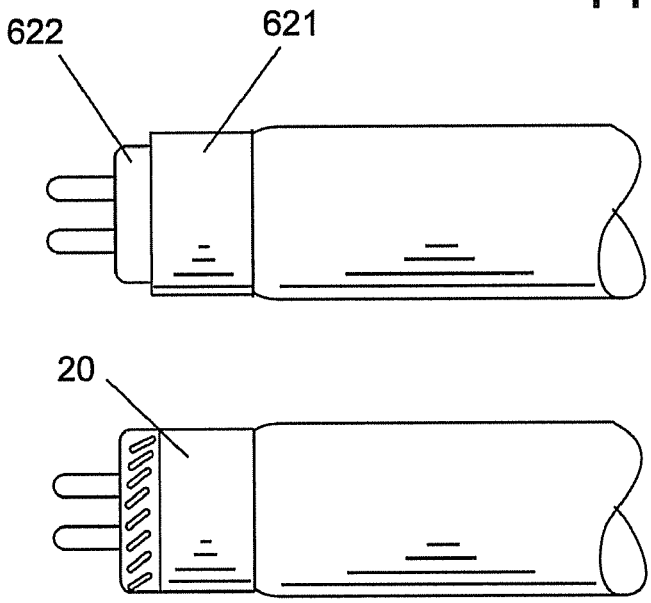
Figure 56C:
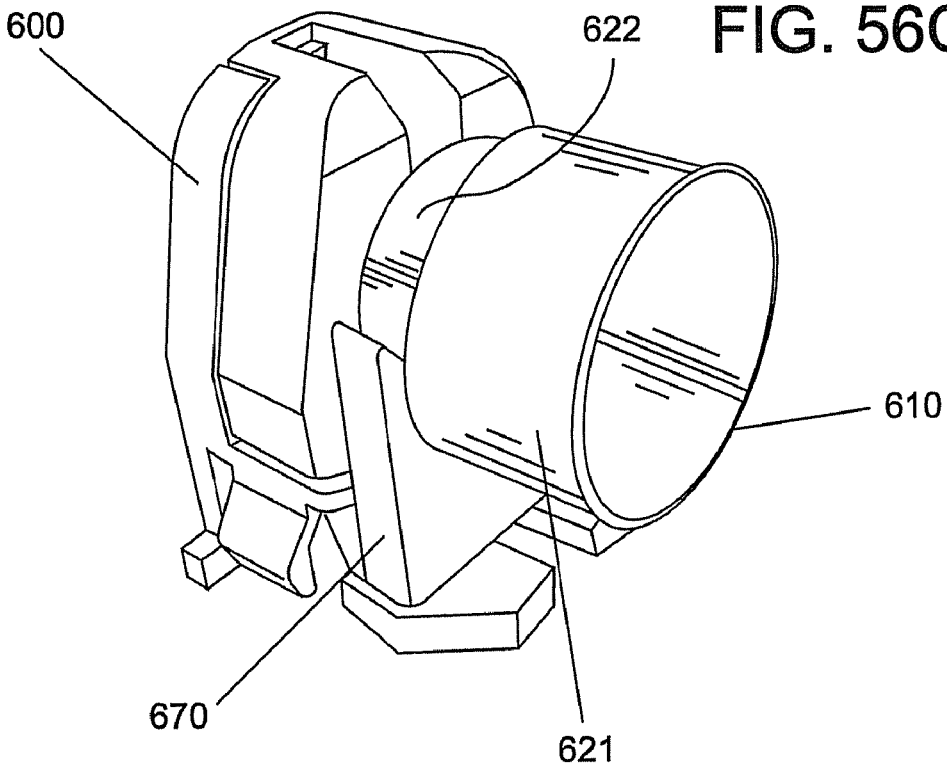
Figure 56D:
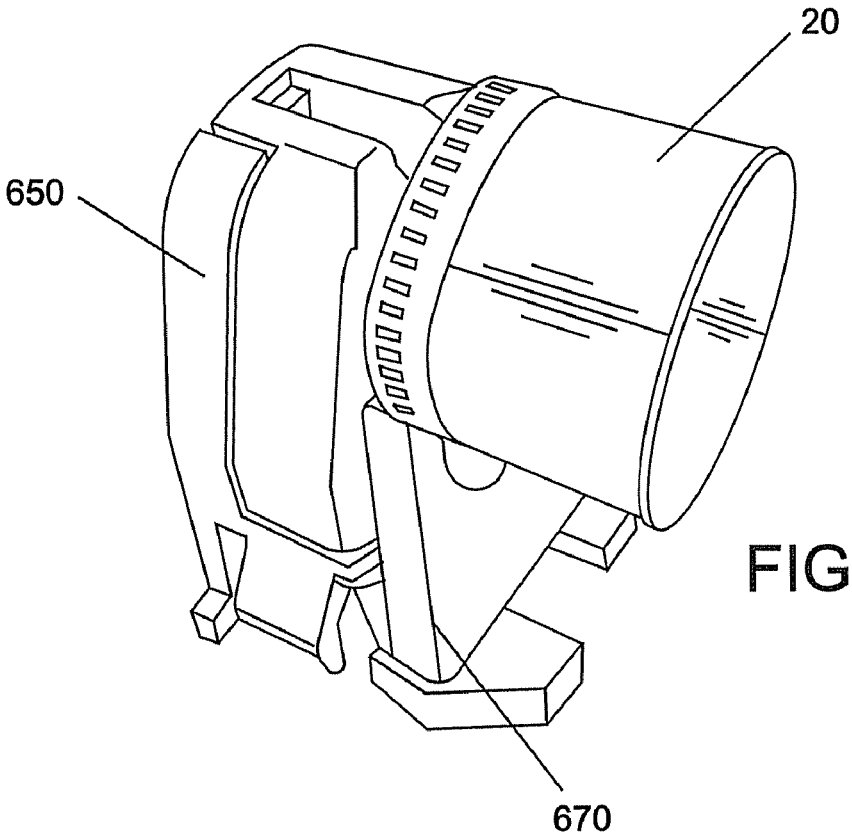
Figure 57:
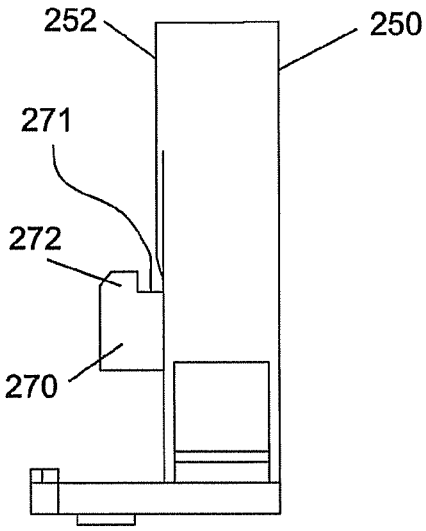
FIG. 57 is a side view of a socket according to at least an embodiment.
Figure 59:
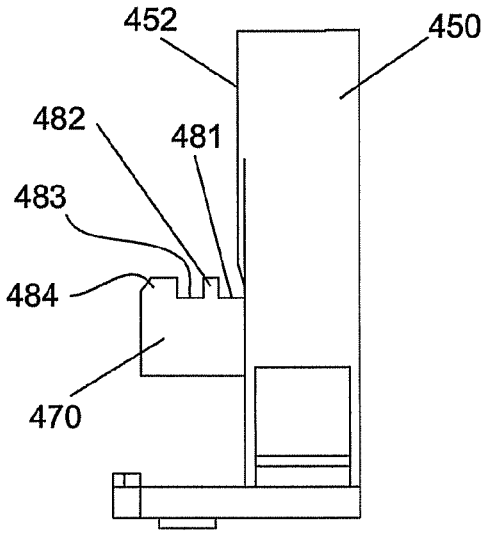
FIG. 59 is a side view of a socket according to at least an embodiment.

Similarly, FIGS. 54-55 show an embodiment in which key protrusion 980 is located at an end of key portion 970. Accordingly, key groove 920 of end cap 910 is located at an appropriate circumferential position to fit key portion 980. As shown in FIGS. 50-55, many different configurations are possible to allow for many different mated pairs of sockets and end caps.

The embodiments shown in FIGS. 43-55 show key protrusions formed against a front face of a socket and end caps having a key groove cut into the end face. However, it will be understood that other configurations are possible. For example, if the key portion is extended further away from the face of the socket, the key protrusion can be formed such that a space exists between the key portion and the front face of the socket. In this situation, the corresponding key groove on the end cap would not be cut into the end face, but instead could be formed at a position on the outer circumference of the cylindrical body of the end cap.

Additionally, it is possible to form a socket having a key protrusion adjacent to the front face of the socket as well as a second key protrusion displaced in a direction away from the front face of the socket. The corresponding end cap would thus have two key grooves, one cut into the end face and a second cut into the cylindrical body at a position axially displaced from the end face.

Figure 64:
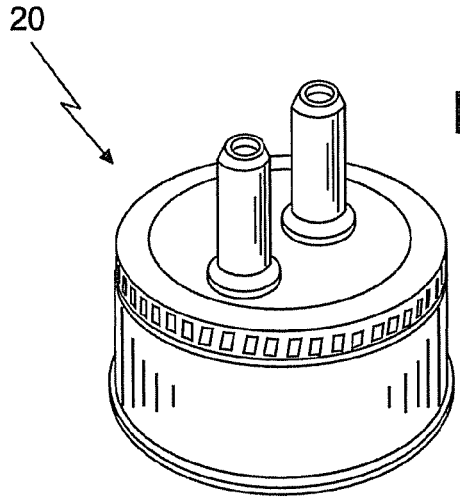
FIG. 64 is a perspective view of a conventional end cap.
Figure 65:
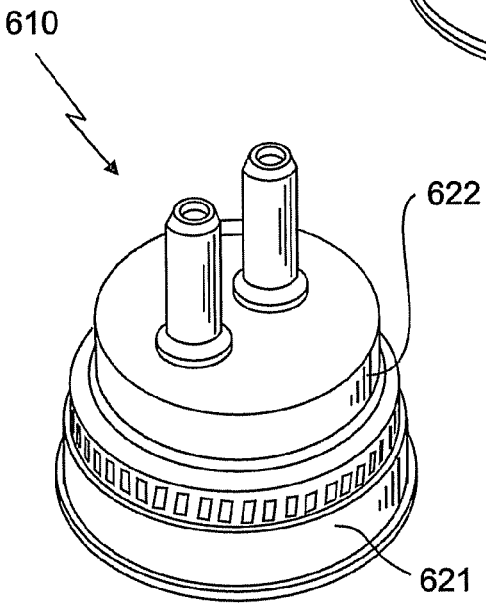
FIG. 65 is a perspective view of an end cap according to at least an embodiment.
Figure 66:
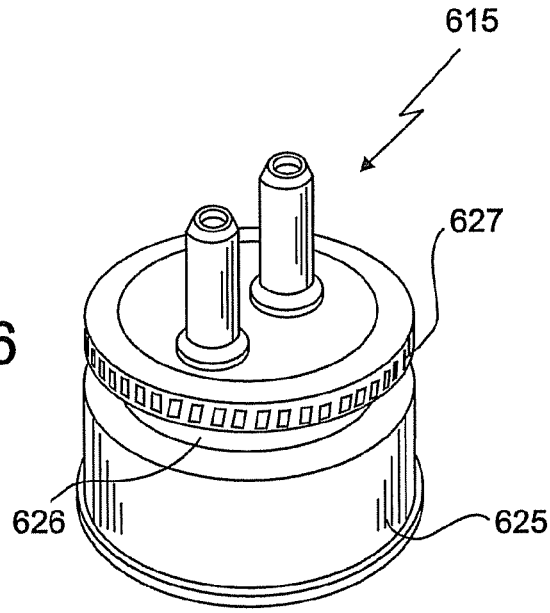
FIG. 66 is a perspective view of an end cap according to at least an embodiment.
Figure 67:
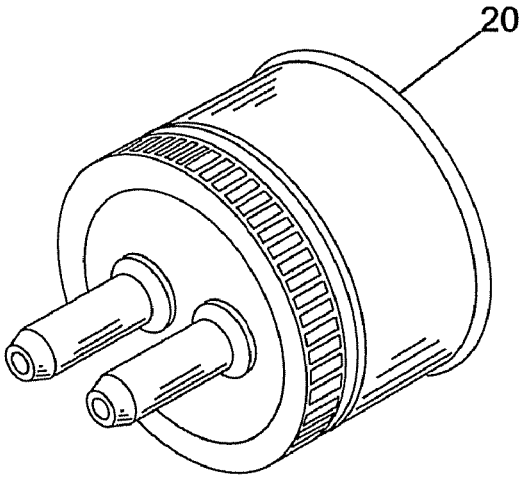
FIG. 67 is a perspective view of a conventional end cap.
Figure 68:
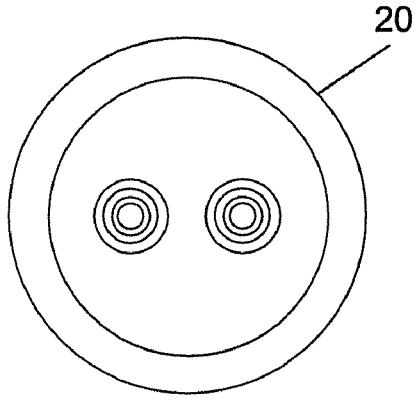
FIG. 68 is a top view of a conventional end cap.
Figure 69:
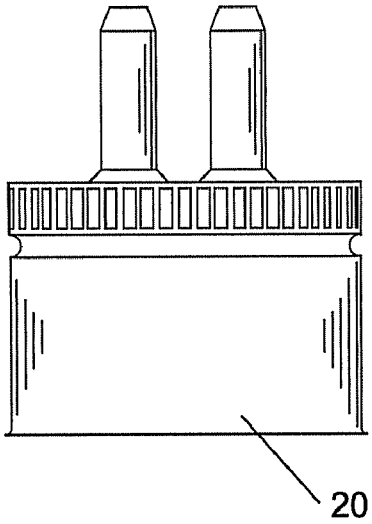
FIG. 69 is a side view of a conventional end cap.
Figure 70:
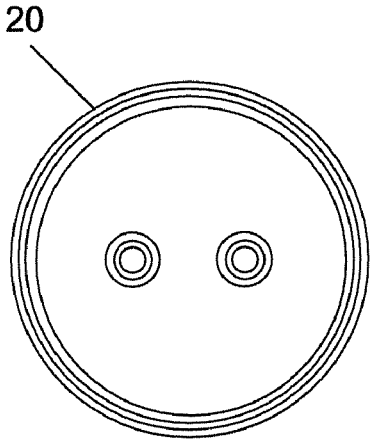
FIG. 70 is a bottom view of a conventional end cap.
Figure 71:
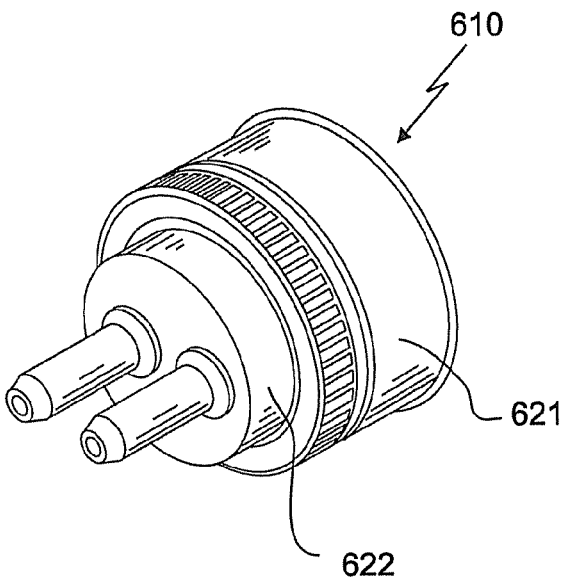
FIG. 71 is a perspective view of an end cap according to at least an embodiment.
Figure 72:
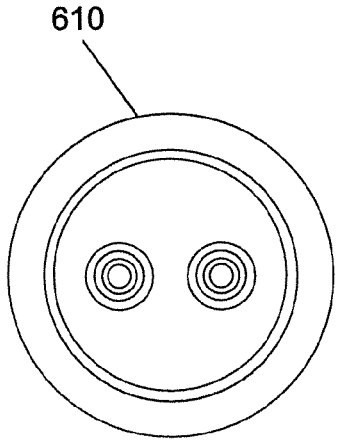
FIG. 72 is a top view of an end cap according to at least an embodiment.
Figure 73:
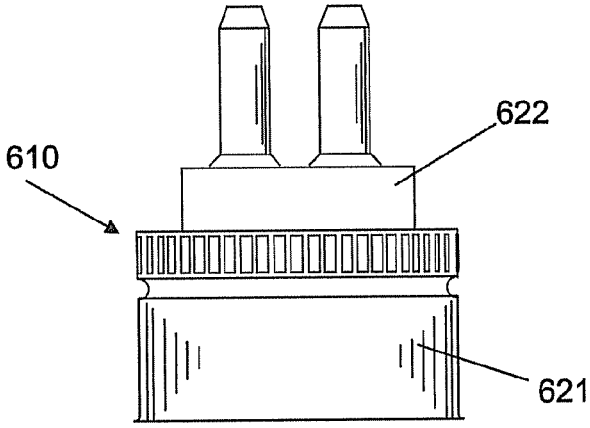
FIG. 73 is a side view of an end cap according to at least an embodiment.
Figure 74:
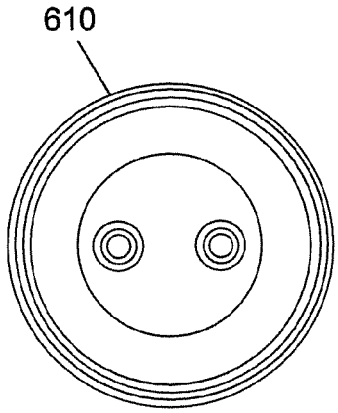
FIG. 74 is a bottom view of an end cap according to at least an embodiment.
Figure 75:
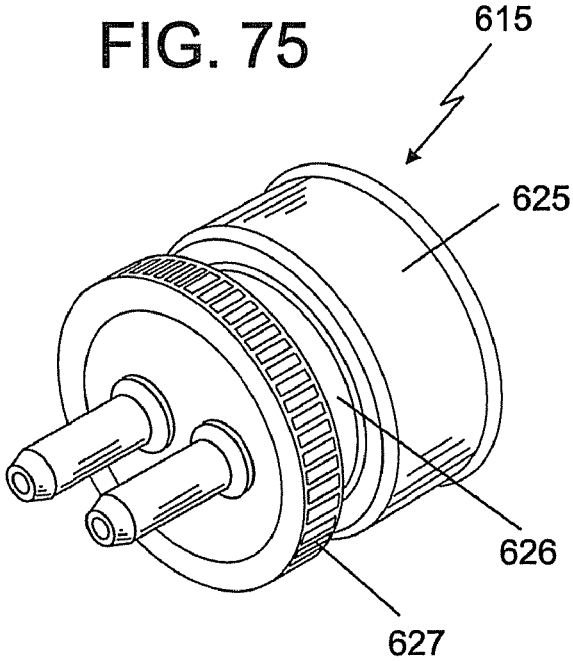
FIG. 75 is a perspective view of an end cap according to at least an embodiment.
Figure 76:
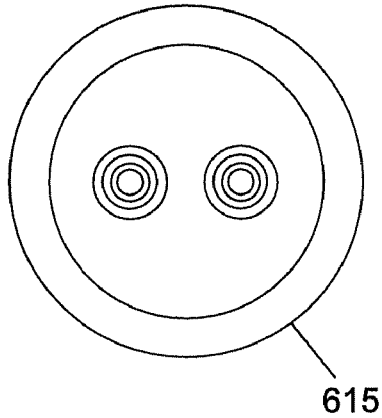
FIG. 76 is a top view of an end cap according to at least an embodiment.
Figure 77:
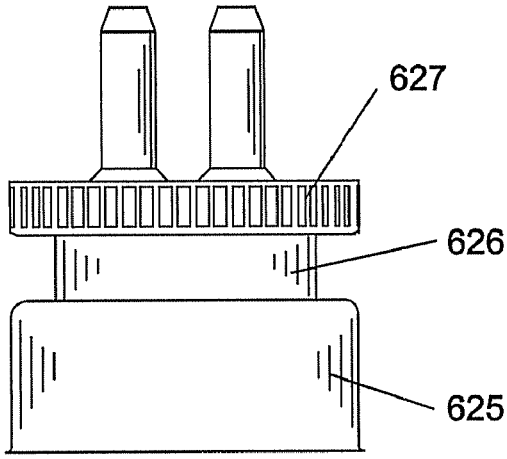
FIG. 77 is a side view of an end cap according to at least an embodiment.
Figure 78:
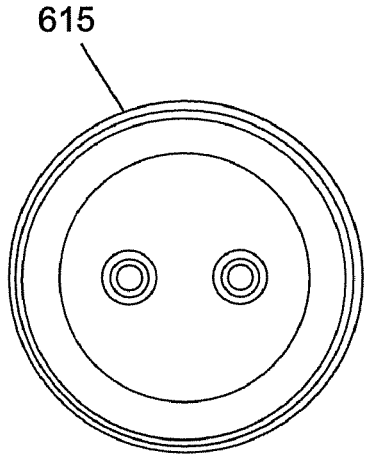
FIG. 78 is a bottom view of an end cap according to at least an embodiment.

FIGS. 65-66 show further embodiments of end caps of size T5. A conventional T5 end cap 20 is shown in FIG. 64 for comparison. End cap 610 shown FIG. 65 is a T5 version of the T12 end cap 110 shown in FIGS. 7-10. For example, end cap 610 is provided with a first cylindrical portion 621 and a second cylindrical portion 622. First cylindrical portion 621 has a given length and diameter and is open on one end to receive a lamp bulb (not shown) therein. Second cylindrical portion 622 is positioned adjacent to first cylindrical portion in an axial direction and has a diameter that is different than the diameter of first cylindrical portion 621.

Similarly, end cap 615 shown in FIG. 66 is a T5 version of the T12 end cap 210 shown in FIGS. 39-42. For example, end cap 615 is provided with a first cylindrical portion 625, a second cylindrical portion 626, and a third cylindrical portion 627. First cylindrical portion 625 has a given length and diameter and is open on one end to receive a lamp bulb (not shown) therein. Second cylindrical portion 626 is positioned adjacent to first cylindrical portion in an axial direction and has a diameter that is different than the diameter of first cylindrical portion 625. Third cylindrical portion 627 is positioned adjacent to second cylindrical portion 626 in an axial direction, and has a diameter different than the diameter of second cylindrical portion 626. Third cylindrical portion 627 may have the same diameter as first cylindrical portion 625, as seen in FIG. 66, the diameters of first cylindrical portion 625 and third cylindrical portion 627 may be different in other embodiments.

FIGS. 71-74 show additional views of end cap 610 and FIGS. 75-78 show additional views of end cap 615. Views of conventional end cap 20 are shown in FIGS. 67-70 for comparison.

Figure 79:
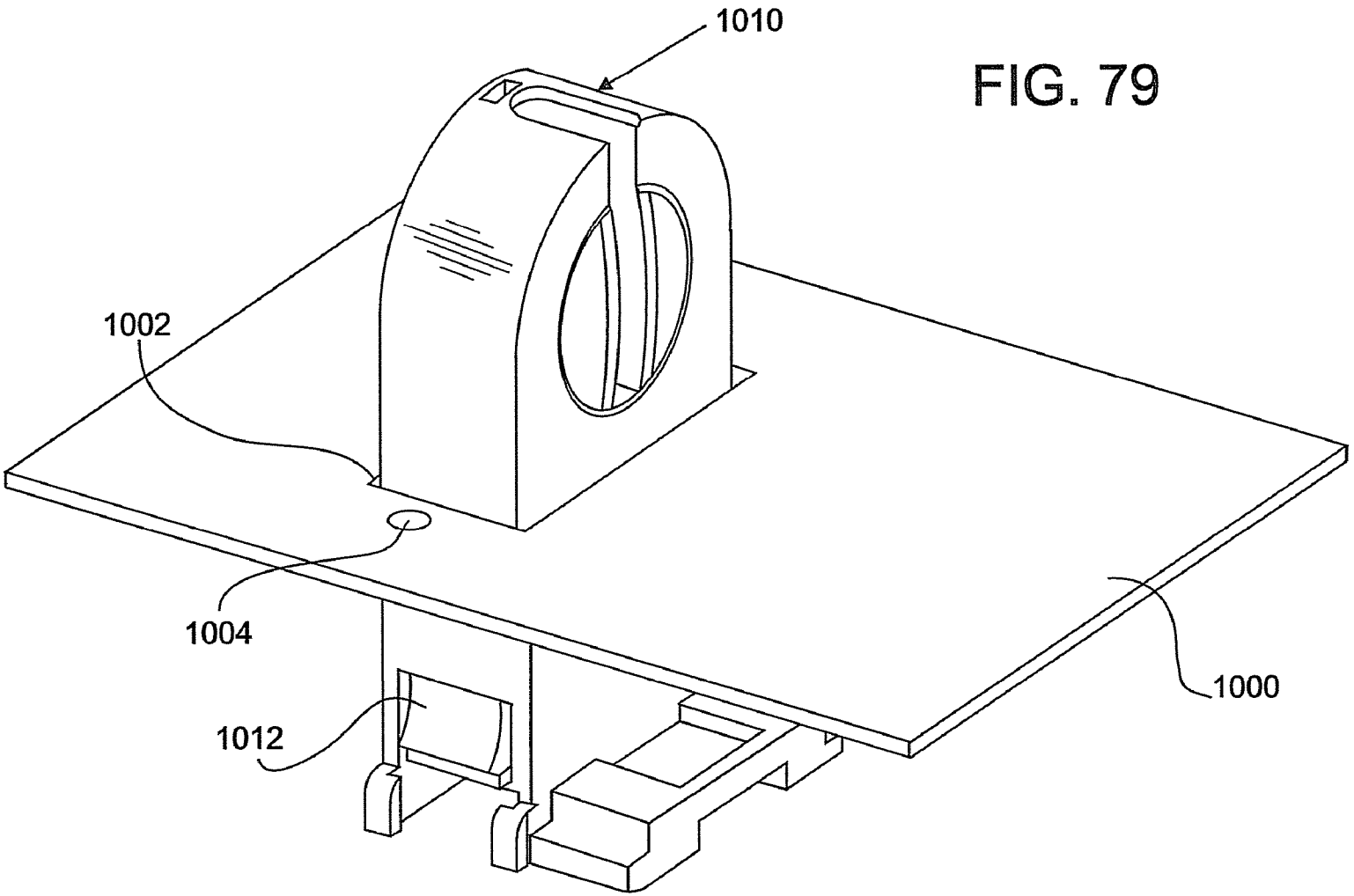
FIG. 79 is a perspective view of a socket according to at least an embodiment.

FIGS. 79-86 illustrate an assembly concept for a socket, a socket adaptor, and an end cap. In certain applications, as seen in FIG. 79, a socket 1010 is inserted through a cutout 1002 in a plate 1000. When fully inserted, clips 1012 snap into place to keep socket 1010 in position on plate 1000.

Figure 3:
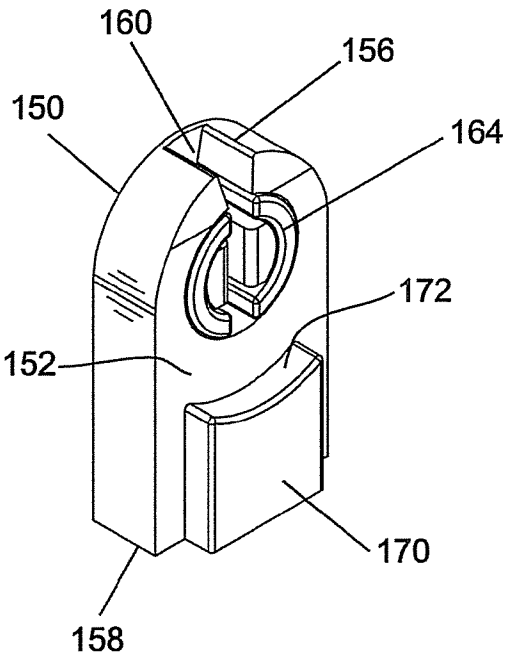
FIG. 3 is a perspective view of a socket according to at least an embodiment.
Figure 9:
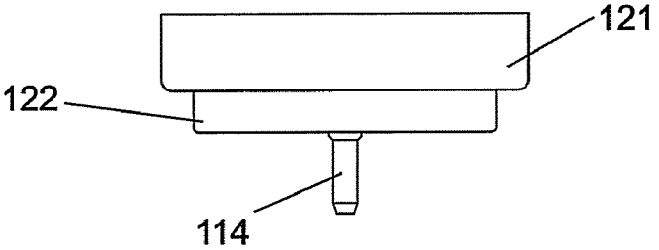
FIG. 9 is a top view of an end cap according to at least an embodiment.
Figure 10:
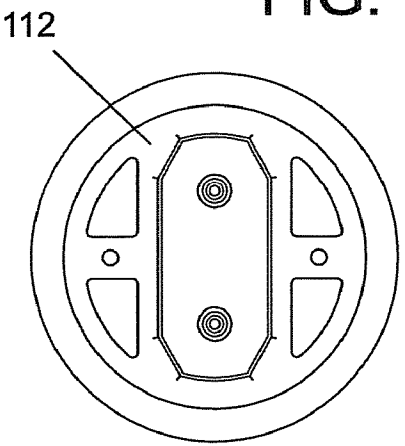
FIG. 10 is a front view of an end cap according to at least an embodiment.
Figure 8:
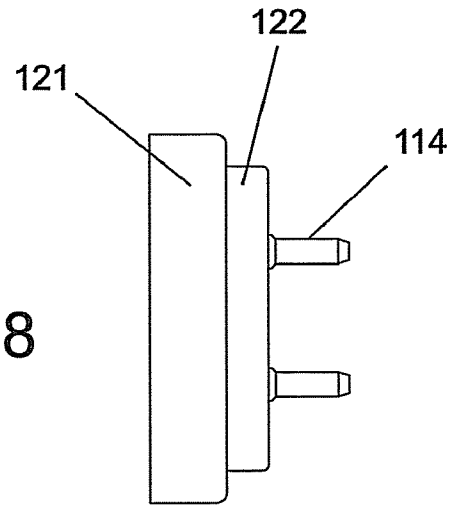
FIG. 8 is a side view of an end cap according to at least an embodiment.
Figure 7:
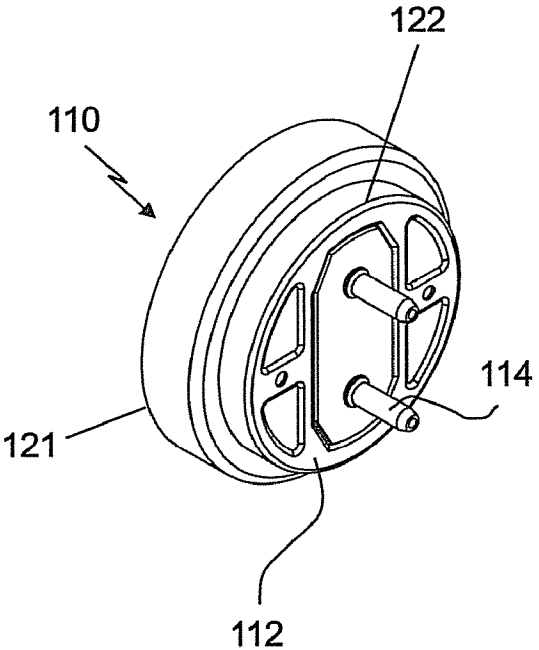
FIG. 7 is a perspective view of an end cap according to at least an embodiment.
Figure 12:
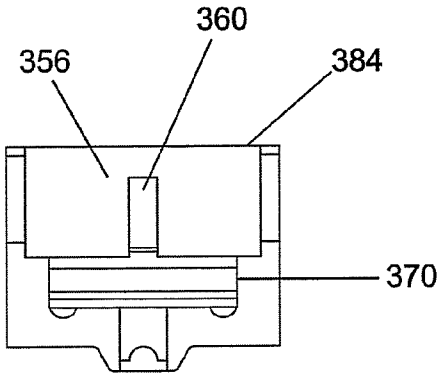
FIG. 12 is a top view of a socket according to at least an embodiment.
Figure 14:
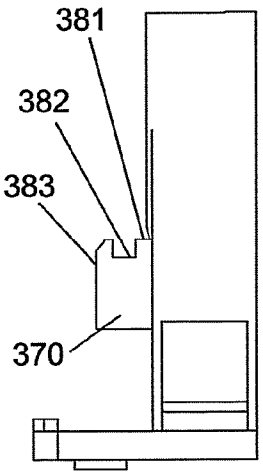
FIG. 14 is a side view of a socket according to at least an embodiment.
Figure 13:
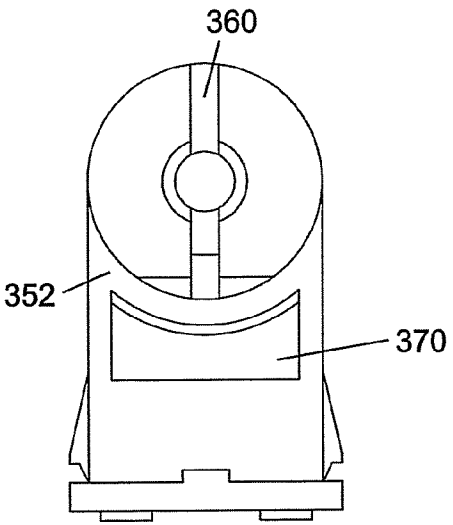
FIG. 13 is a front view of a socket according to at least an embodiment.
Figure 11:
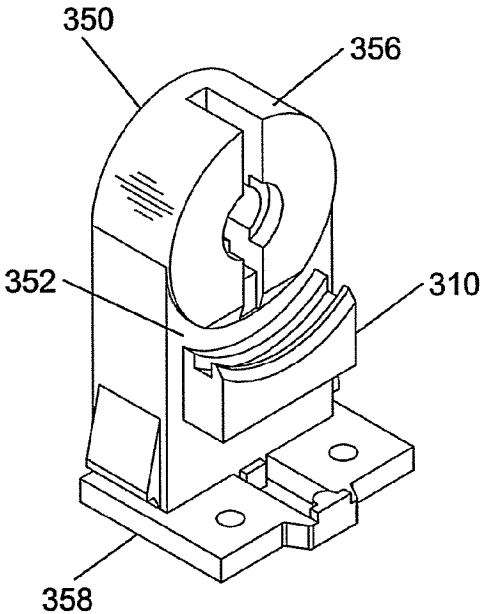
FIG. 11 is a perspective view of a socket according to at least an embodiment.
Figure 17:
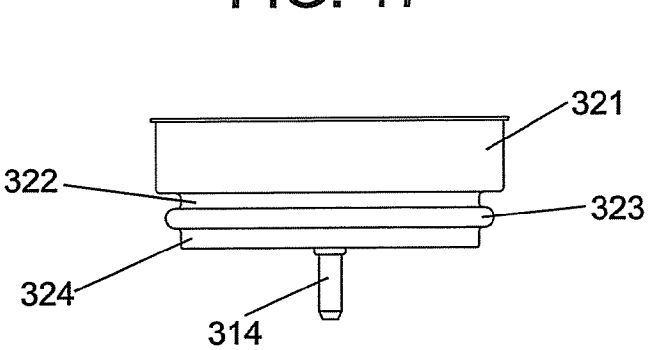
FIG. 17 is a top view of an end cap according to at least an embodiment.
Figure 18:
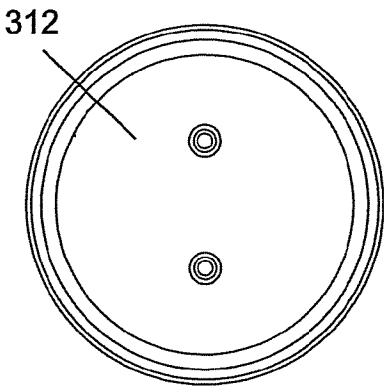
FIG. 18 is a front view of an end cap according to at least an embodiment.
Figure 16:
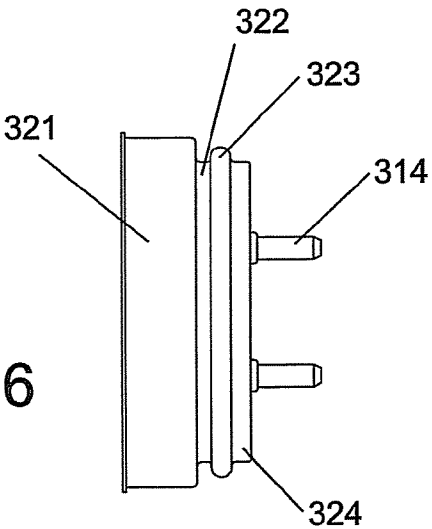
FIG. 16 is a side view of an end cap according to at least an embodiment.
Figure 15:
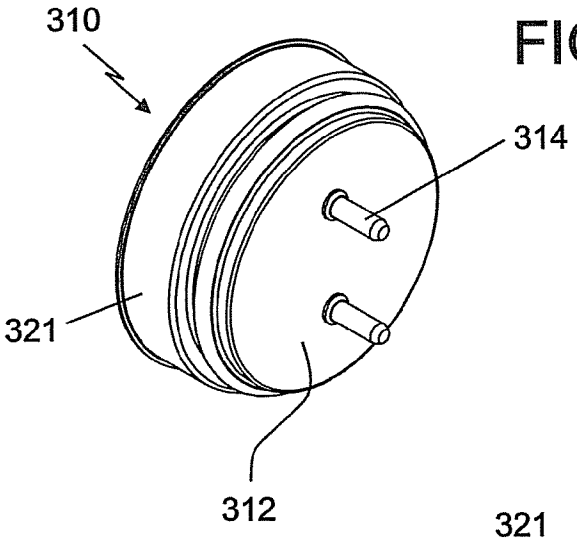
FIG. 15 is a perspective view of an end cap according to at least an embodiment.
Figure 20:
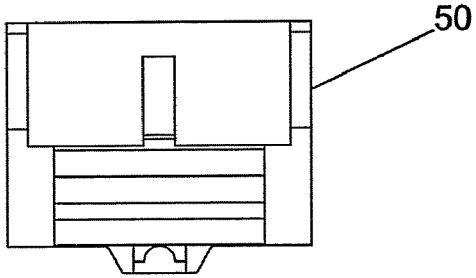
FIG. 20 is a top view of a socket according to at least an embodiment.
Figure 22:
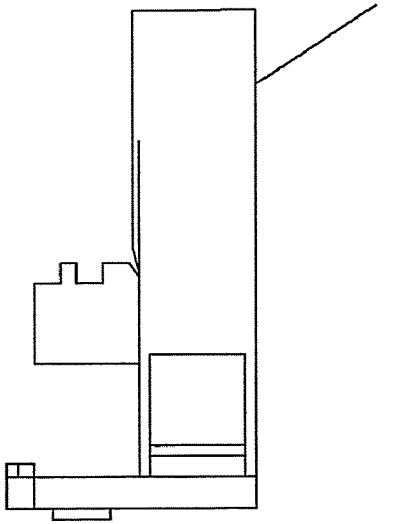
FIG. 22 is a side view of a socket according to at least an embodiment.
Figure 21:
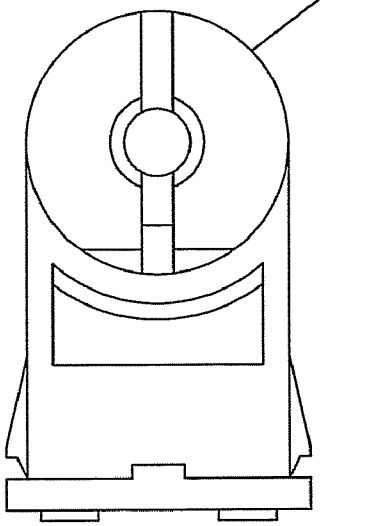
FIG. 21 is a front view of a socket according to at least an embodiment.
Figure 19:
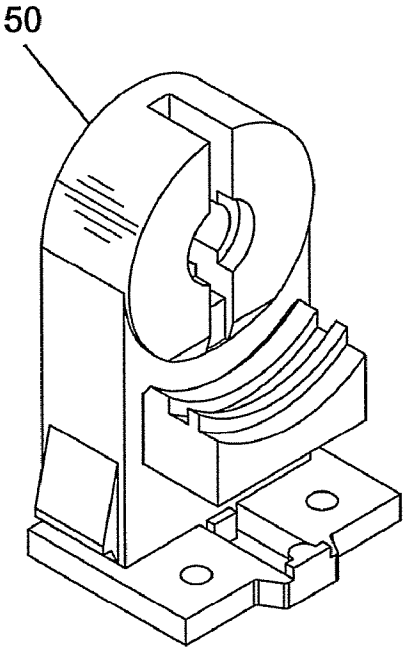
FIG. 19 is a perspective view of a socket according to at least an embodiment.
Figure 25:
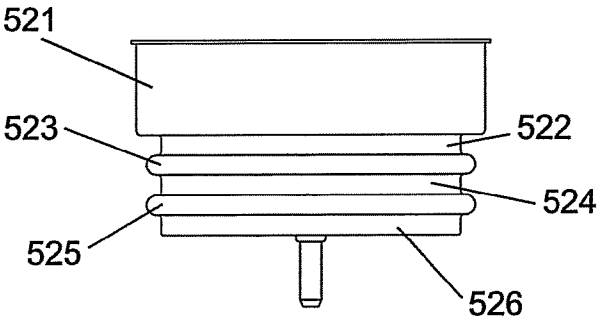
FIG. 25 is a top view of an end cap according to at least an embodiment.
Figure 26:
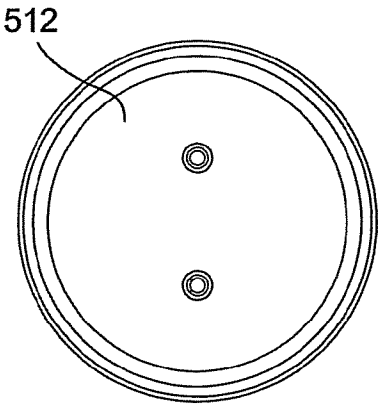
FIG. 26 is a front view of an end cap according to at least an embodiment.
Figure 24:
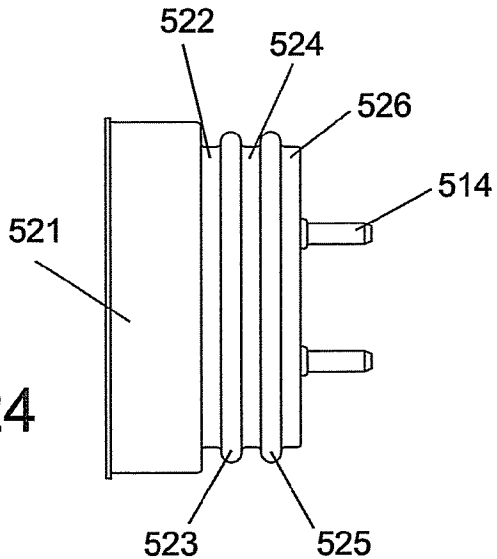
FIG. 24 is a side view of an end cap according to at least an embodiment.
Figure 23:
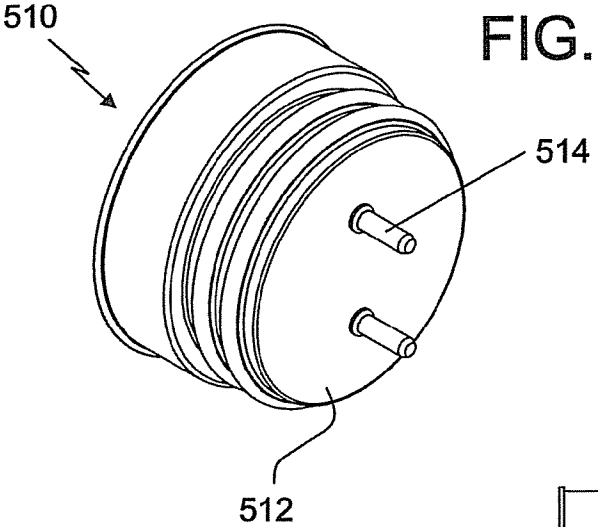
FIG. 23 is a perspective view of an end cap according to at least an embodiment.
Figure 28:
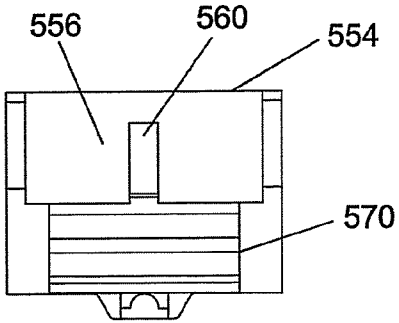
FIG. 28 is a top view of a socket according to at least an embodiment.
Figure 30:
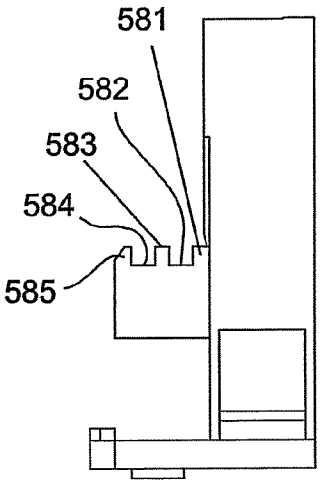
FIG. 30 is a side view of a socket according to at least an embodiment.
Figure 29:
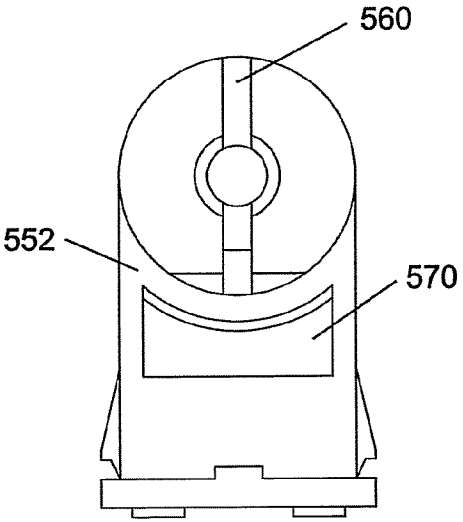
FIG. 29 is a front view of a socket according to at least an embodiment.
Figure 27:
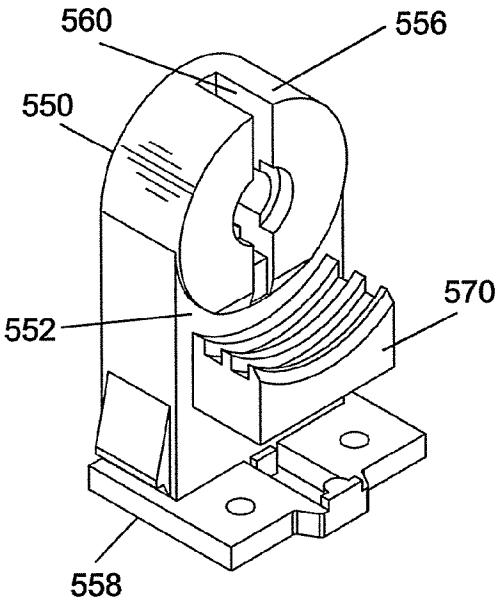
FIG. 27 is a perspective view of a socket according to at least an embodiment.
Figure 33:
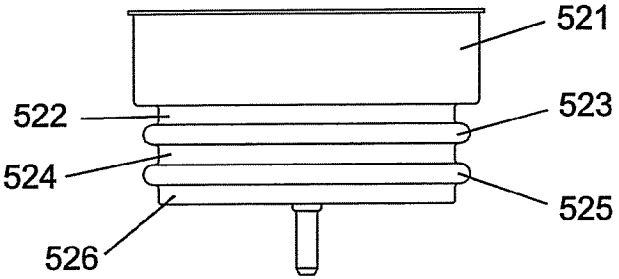
FIG. 33 is a top view of an end cap according to at least an embodiment.
Figure 34:
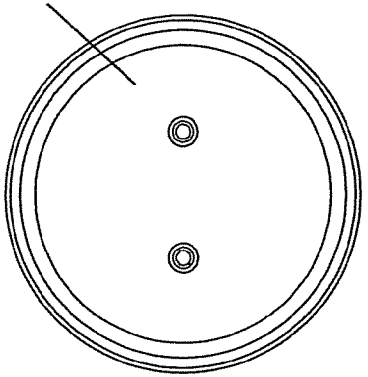
FIG. 34 is a front view of an end cap according to at least an embodiment.
Figure 32:
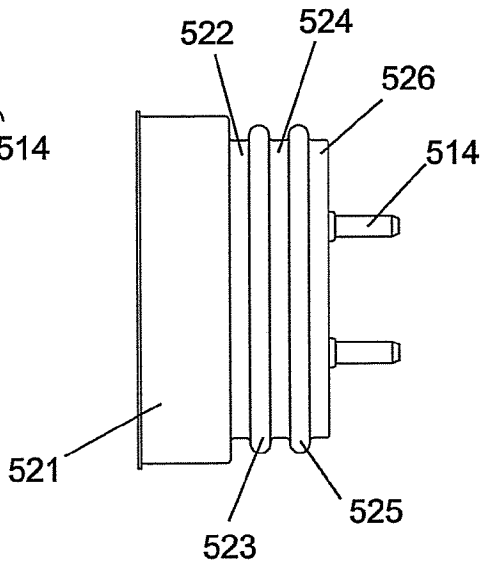
FIG. 32 is a side view of an end cap according to at least an embodiment.
Figure 31:
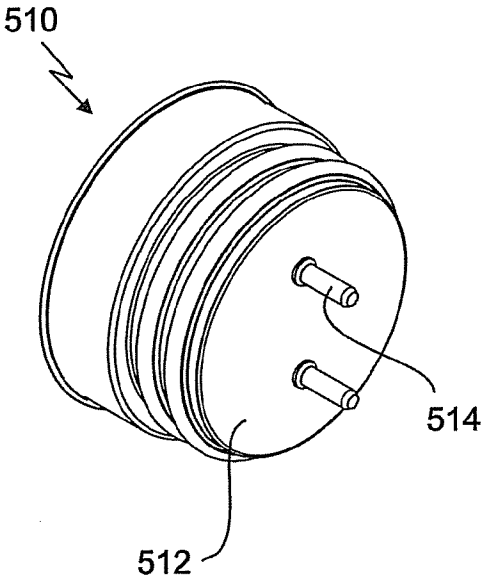
FIG. 31 is a perspective view of an end cap according to at least an embodiment.
Figure 36:
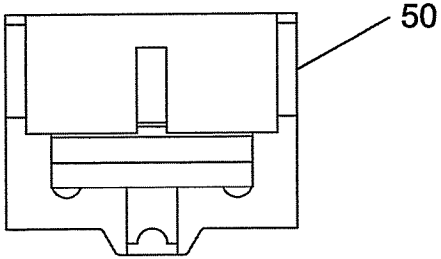
FIG. 36 is a top view of a socket according to at least an embodiment.
Figure 38:
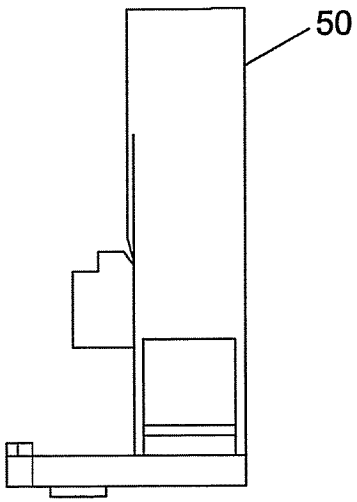
FIG. 38 is a side view of a socket according to at least an embodiment.
Figure 37:
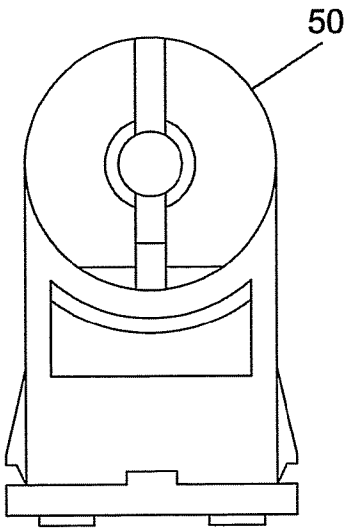
FIG. 37 is a front view of a socket according to at least an embodiment.
Figure 35:
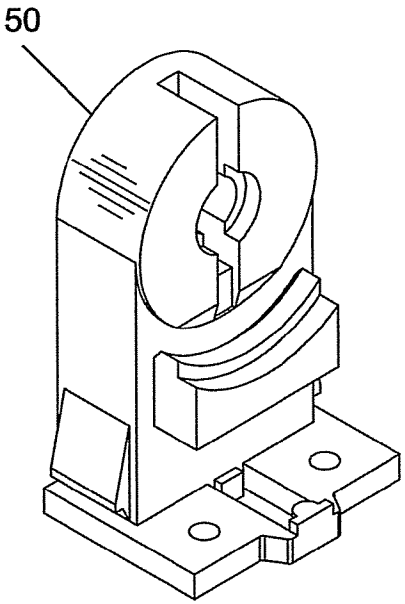
FIG. 35 is a perspective view of a socket according to at least an embodiment.
Figure 41:
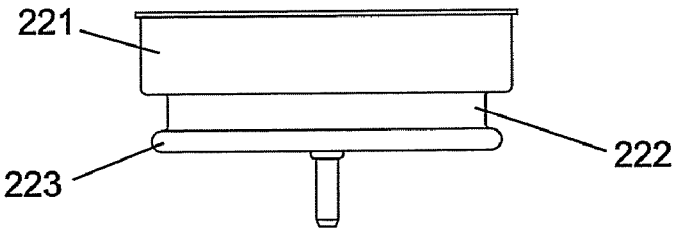
FIG. 41 is a top view of an end cap according to at least an embodiment.
Figure 42:
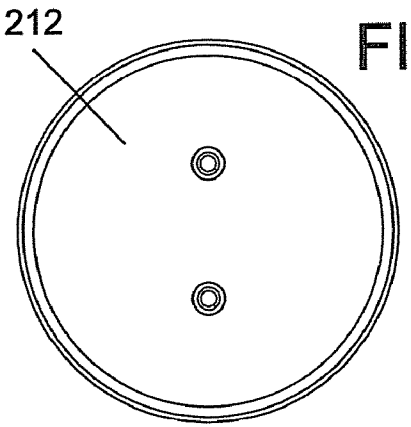
FIG. 42 is a front view of an end cap according to at least an embodiment.
Figure 40:
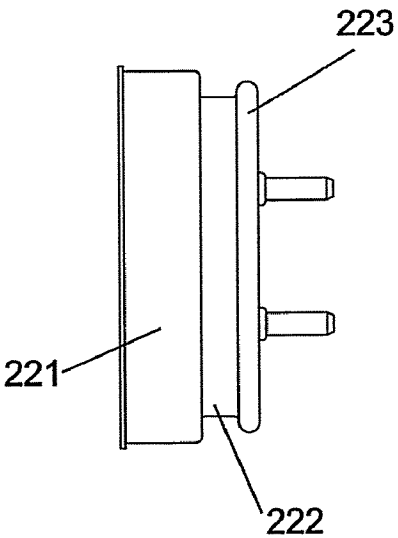
FIG. 40 is a side view of an end cap according to at least an embodiment.
Figure 39:
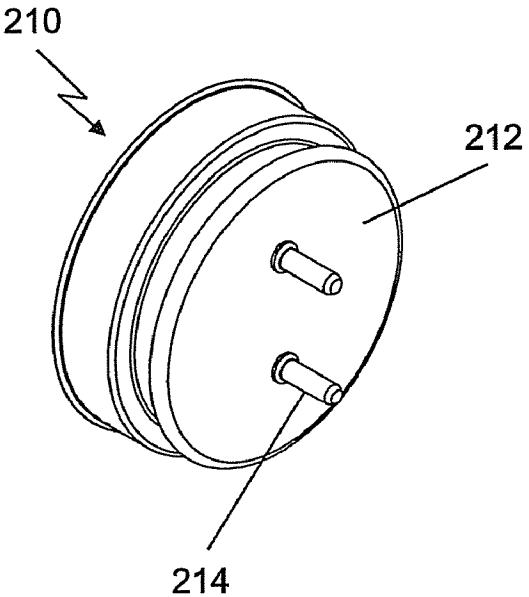
FIG. 39 is a perspective view of an end cap according to at least an embodiment.
Figure 43:
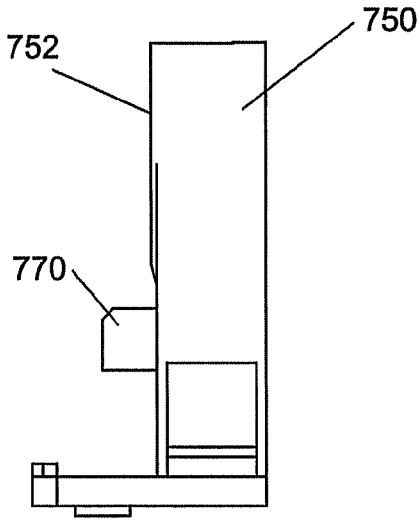
FIG. 43 is a side view of a socket according to at least an embodiment.
Figure 80:
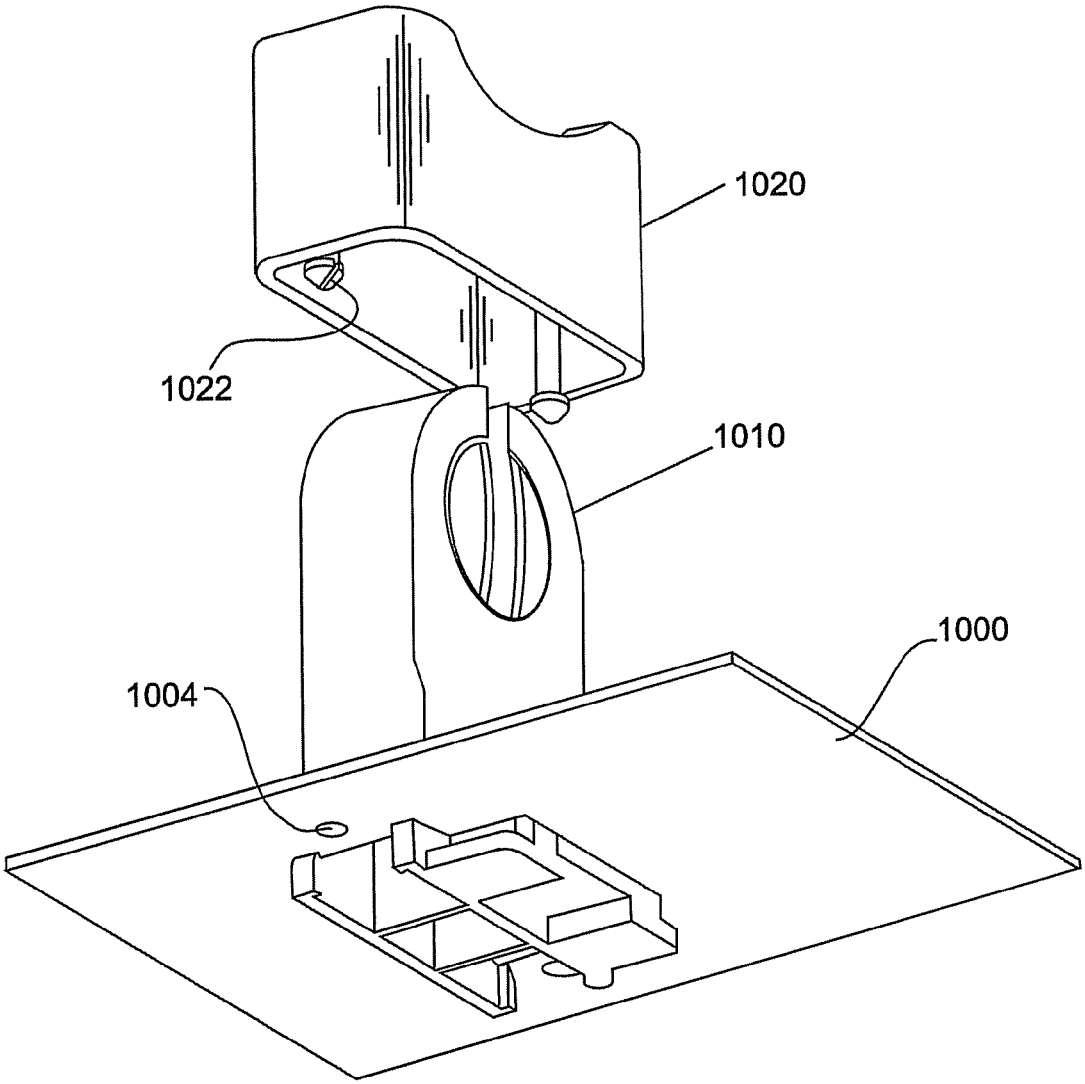
FIG. 80 is a perspective view of a disassembled socket and socket adaptor according to at least an embodiment.
Figure 81:
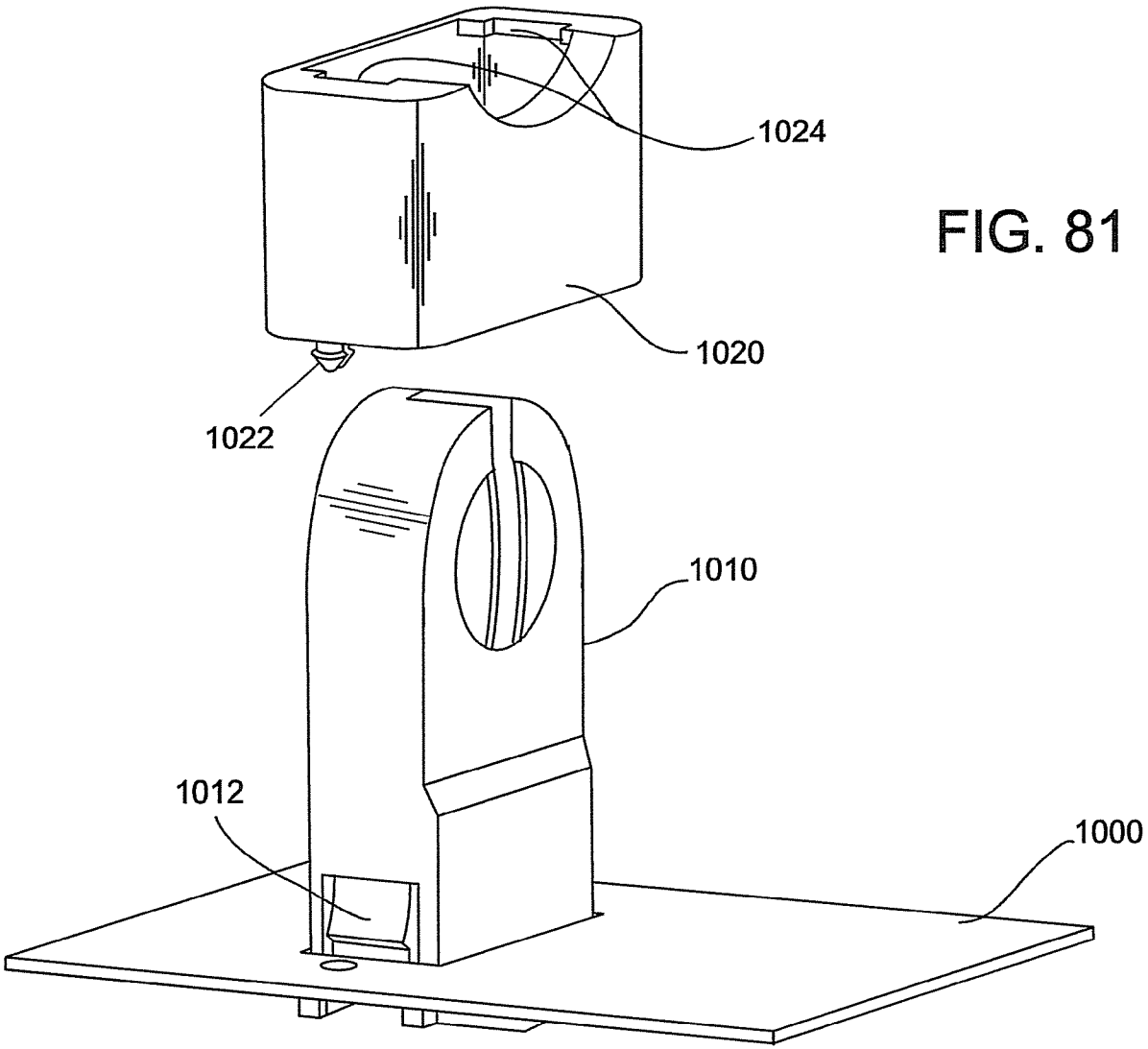
FIG. 81 is a perspective view of a disassembled socket and socket adaptor according to at least an embodiment.
Figure 82:
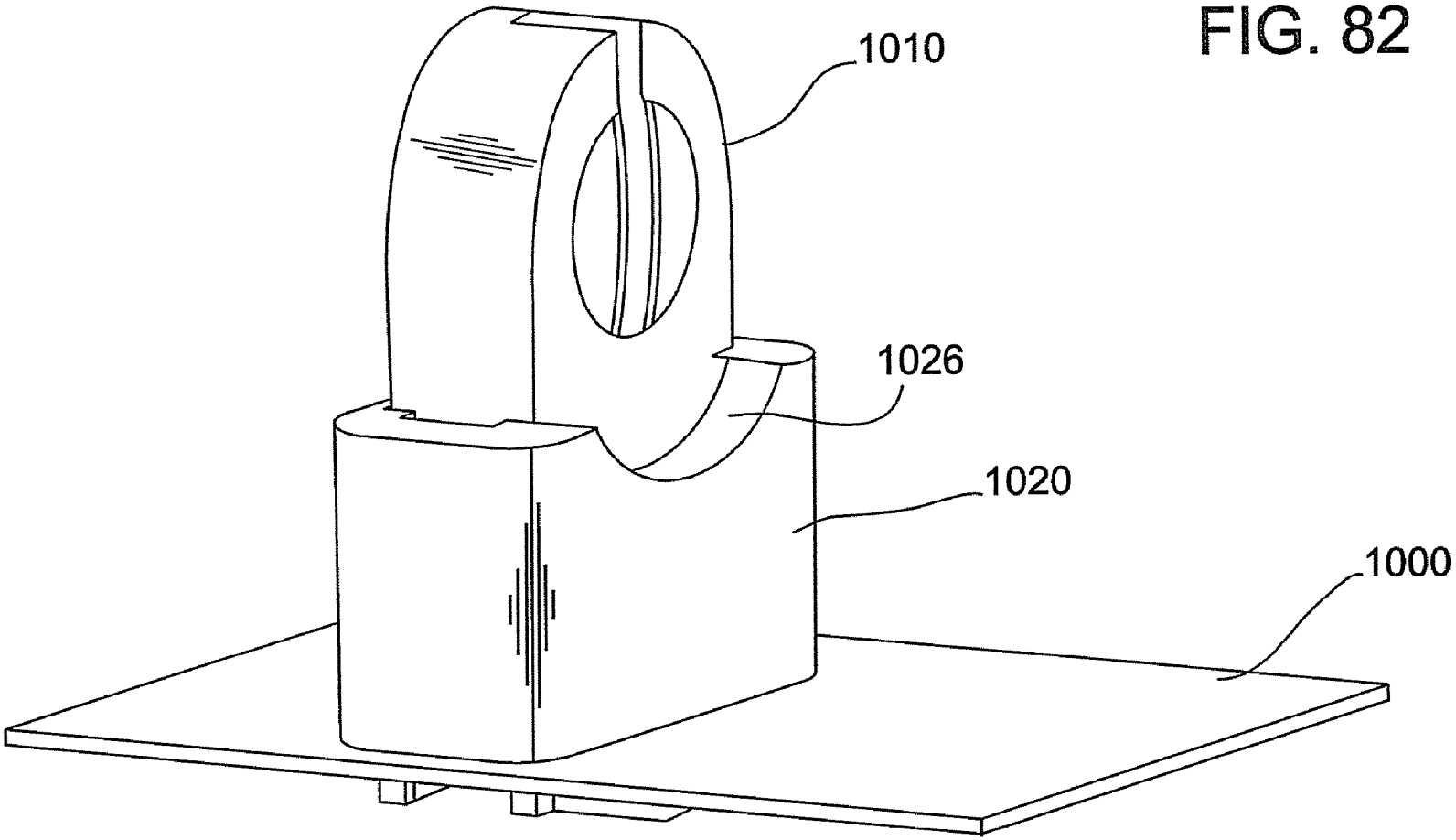
FIG. 82 is a perspective view of an assembled socket and socket adaptor according to at least an embodiment.
Figure 84:
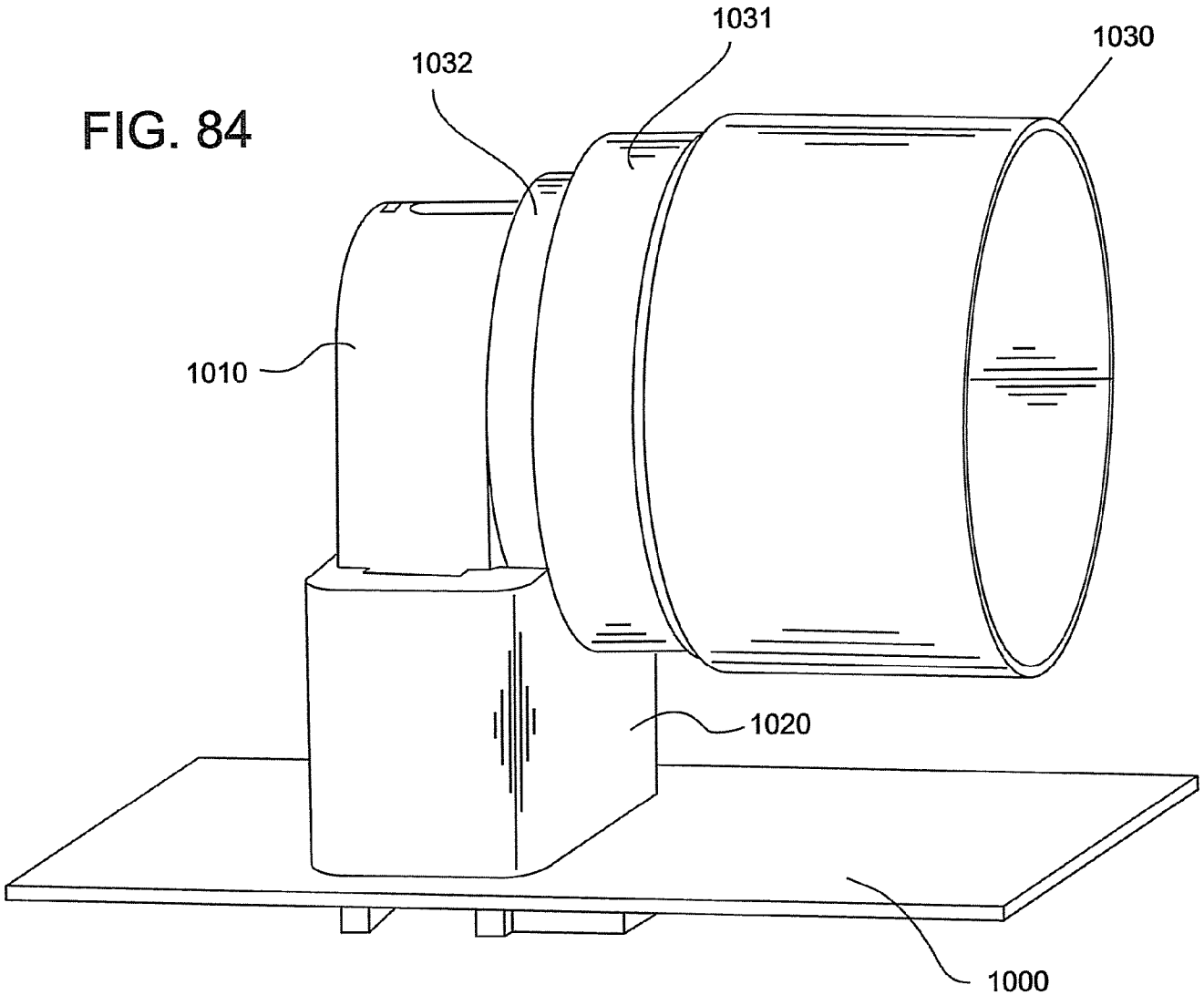
FIG. 84 is a perspective view of an assembled socket assembly and end cap according to at least an embodiment.
Figure 85:
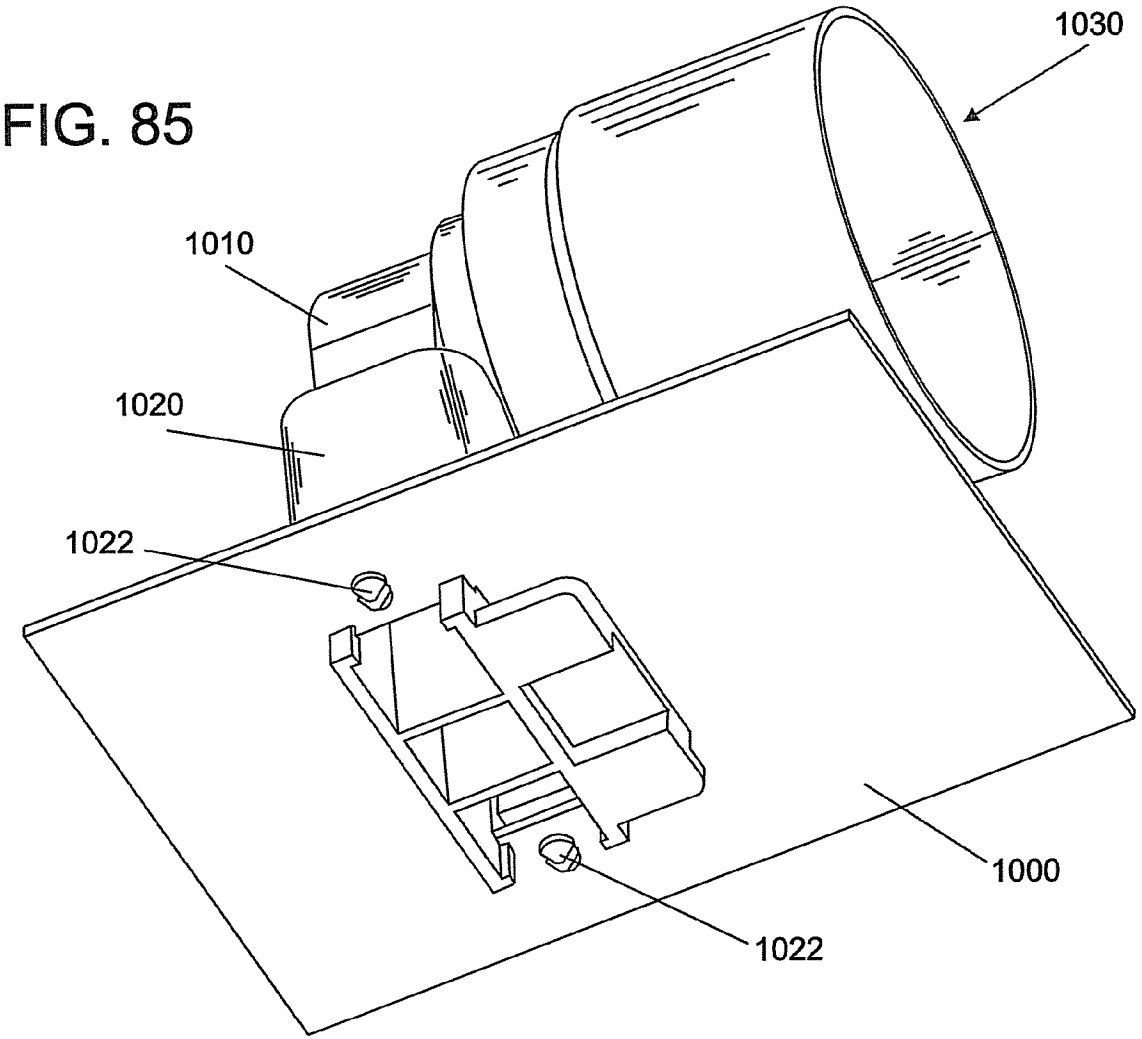
FIG. 85 is a perspective view of an assembled socket assembly and end cap according to at least an embodiment.
Figure 86:
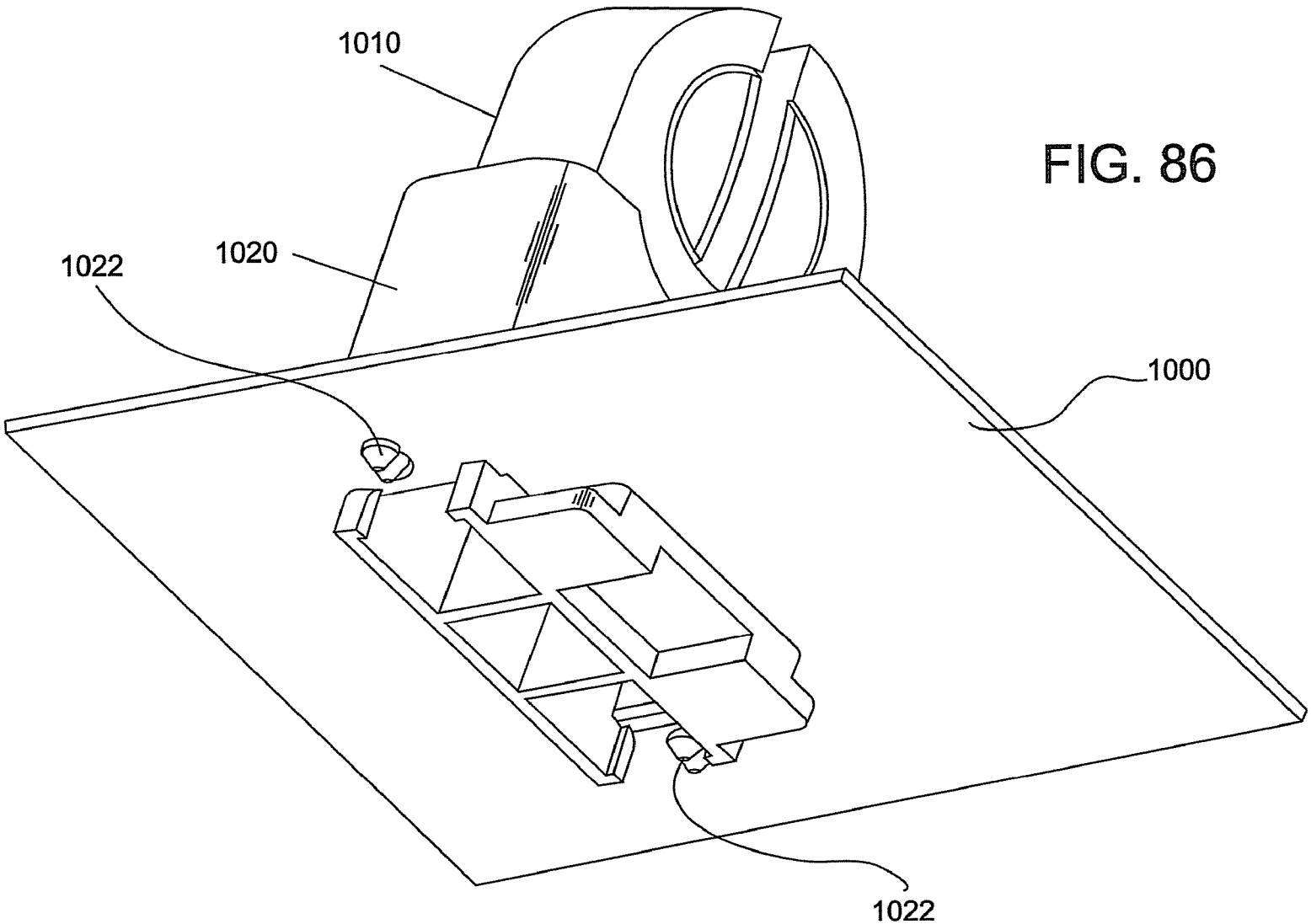
FIG. 86 is a perspective view of an assembled socket and socket adaptor according to at least an embodiment.

In applications such as seen in FIGS. 70-86, it would not be possible to use a socket such as socket 150 in FIG. 3 because cutout 1002 is not large enough to accommodate an integrated key portion 170 of socket 150. Thus, in order to achieve the benefits of the keying system described above, an adaptor 1020 can be fitted to socket 1010 once socket 1010 is positioned, as seen in FIGS. 80-82. To attach adaptor 1020, holes 1004 can be drilled into plate 1000 near cutout 1002, and clips 1022 provided on adaptor 1020 can snap into holes 1004, as seen in FIGS. 80 and 85-86.

Figure 83:
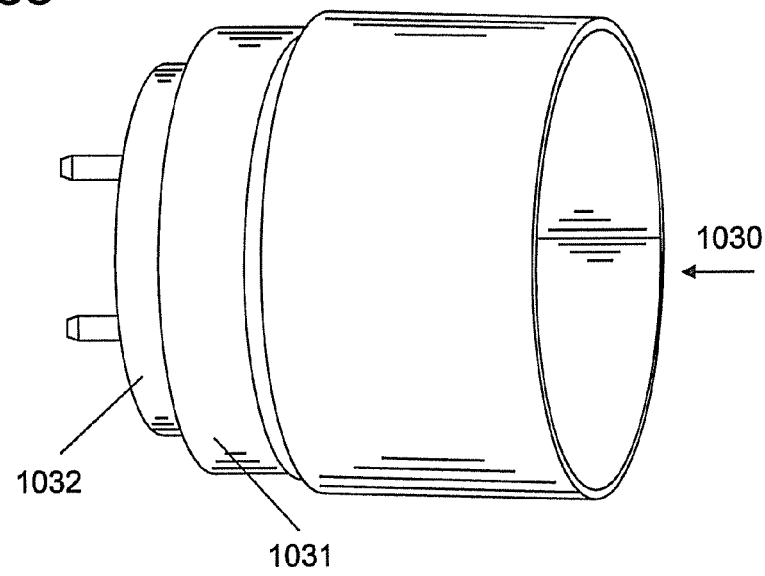
FIG. 83 is a perspective view of a disassembled socket assembly and end cap according to at least an embodiment.
Figure 83:
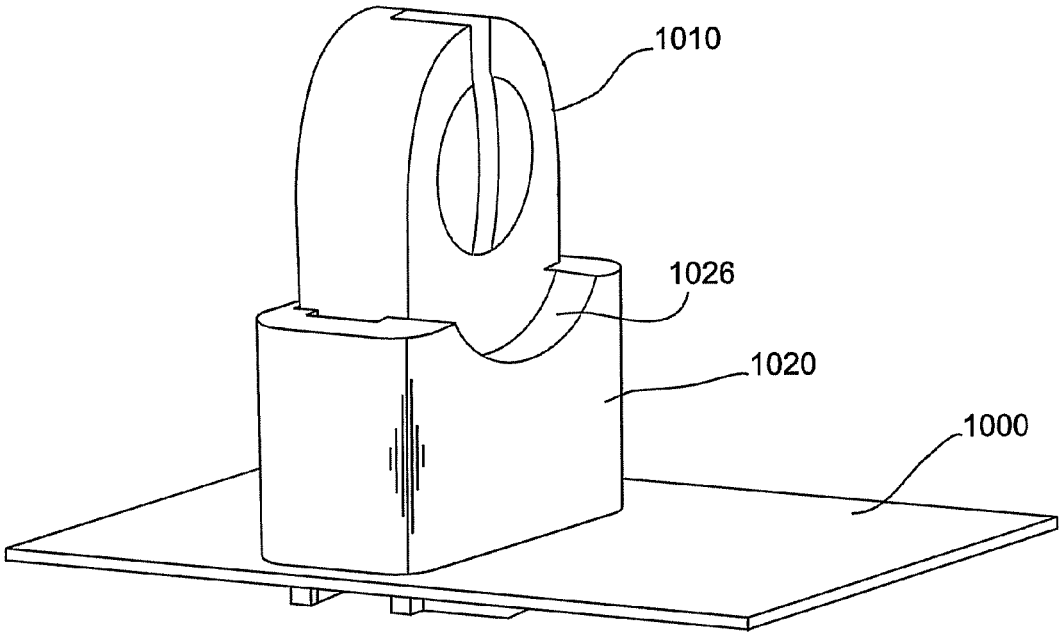

As seen in FIGS. 80-82, adaptor 1020 comprises a tubular body, and one side of the adaptor, a key portion 1026 is provided. In the embodiment shown in FIGS. 80-82, key portion 1026 is shaped as an arc of a circle. FIG. 83 shows a corresponding end cap 1030 that includes a first cylindrical portion 1031 and a second cylindrical portion 1032. As seen in FIGS. 83-84, key portion 1026 is structured to receive second cylindrical portion 1032.

Additionally, as seen in FIG. 81, adaptor 1024 can be provided with socket removal grooves 1024. These grooves provide access to clips 1012 of socket 1010 so that a tool can be used to remove socket 1010 from plate 1000, for example to perform maintenance or replace a socket.

Figure 87:
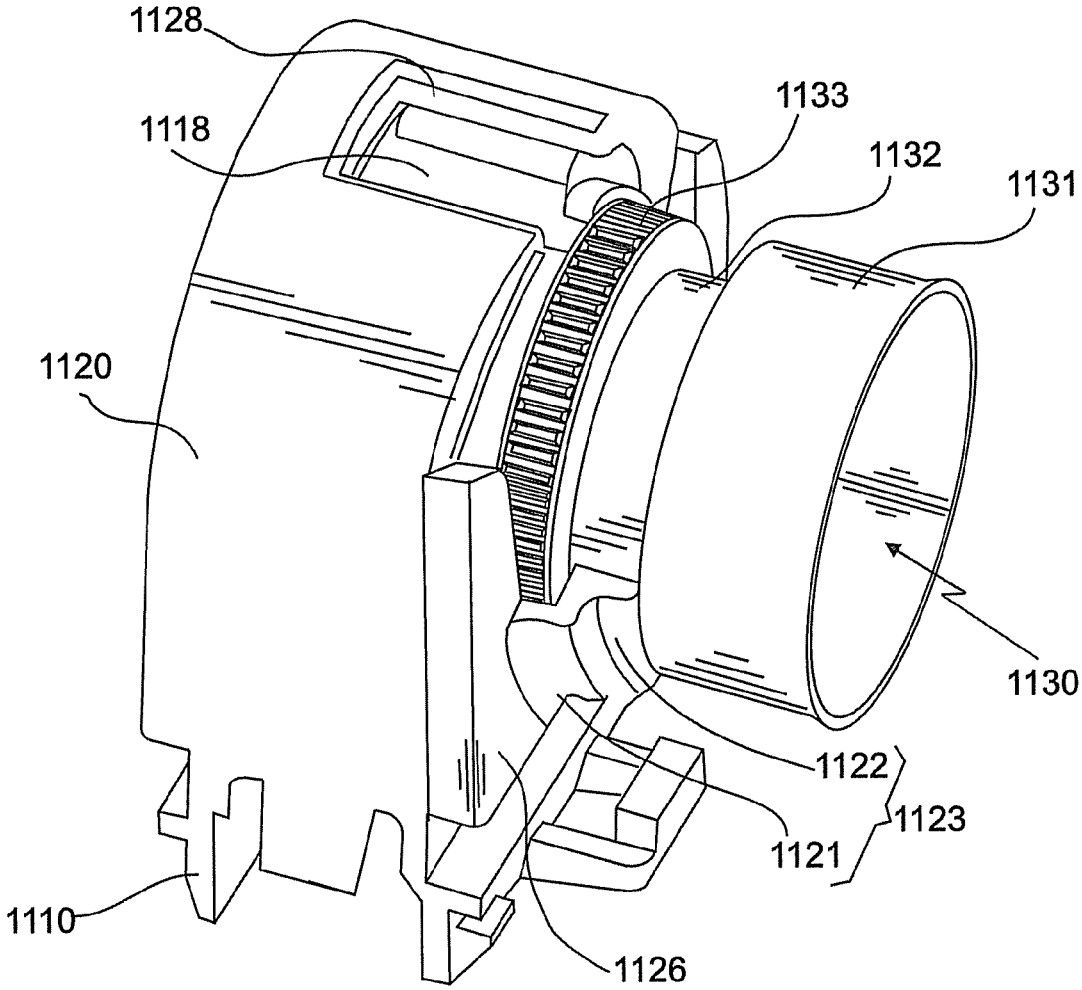
FIG. 87 is a perspective view of a socket, socket adaptor, and end cap according to at least an embodiment.
Figure 88:
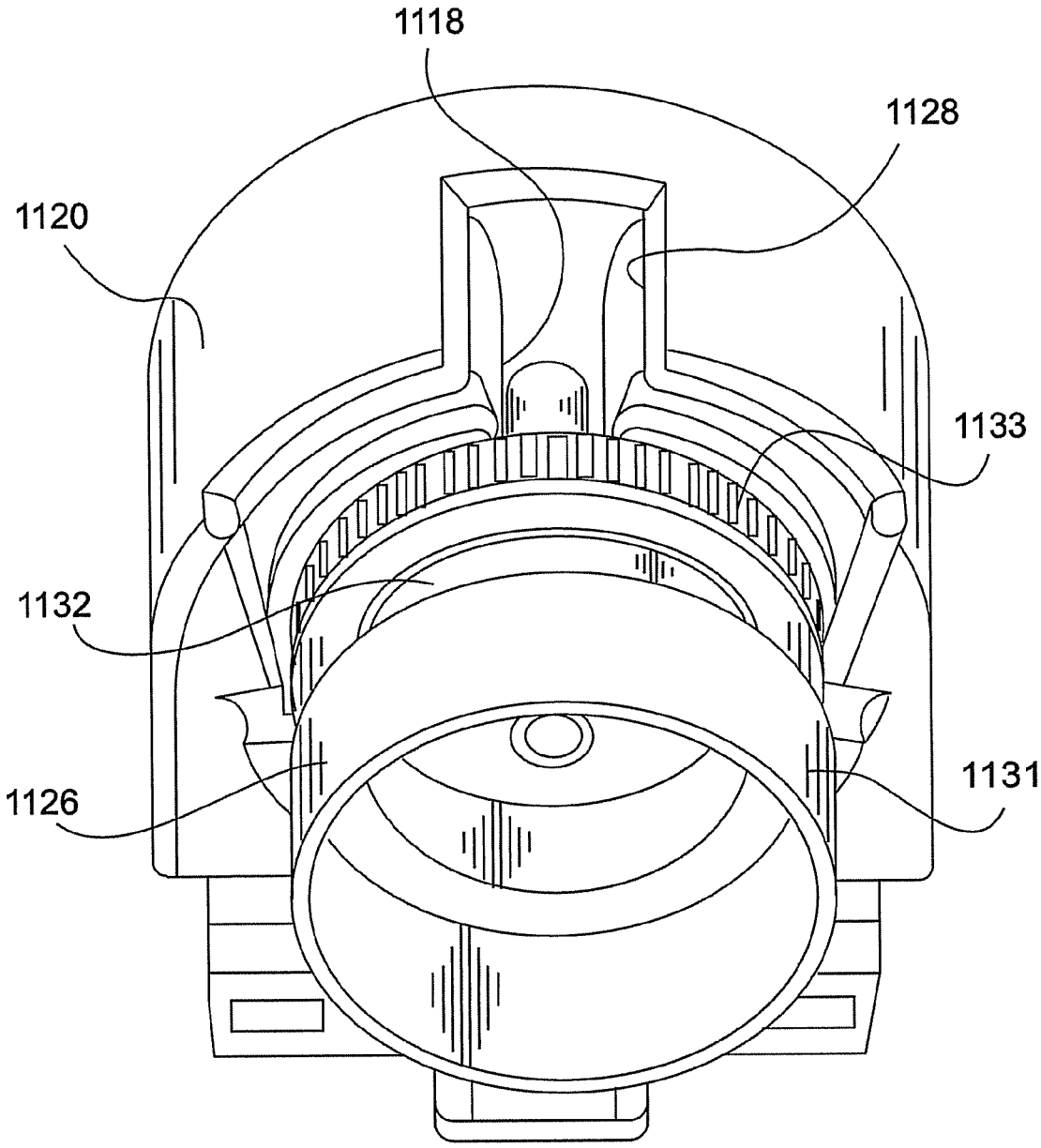
FIG. 88 is a perspective view of a socket, socket adaptor, and end cap according to at least an embodiment.
Figure 89:
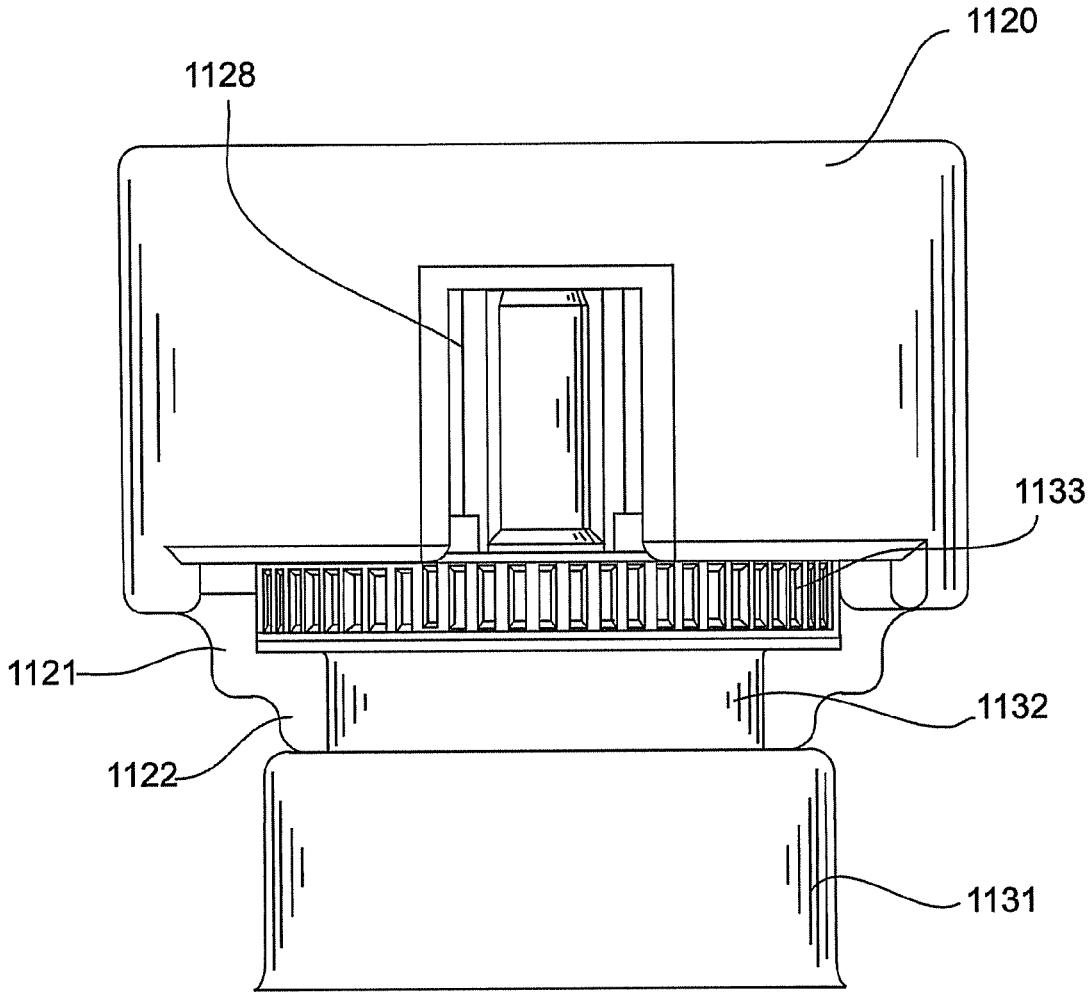
FIG. 89 is a planar view of a socket, socket adaptor, and end cap according to at least an embodiment.
Figure 90:
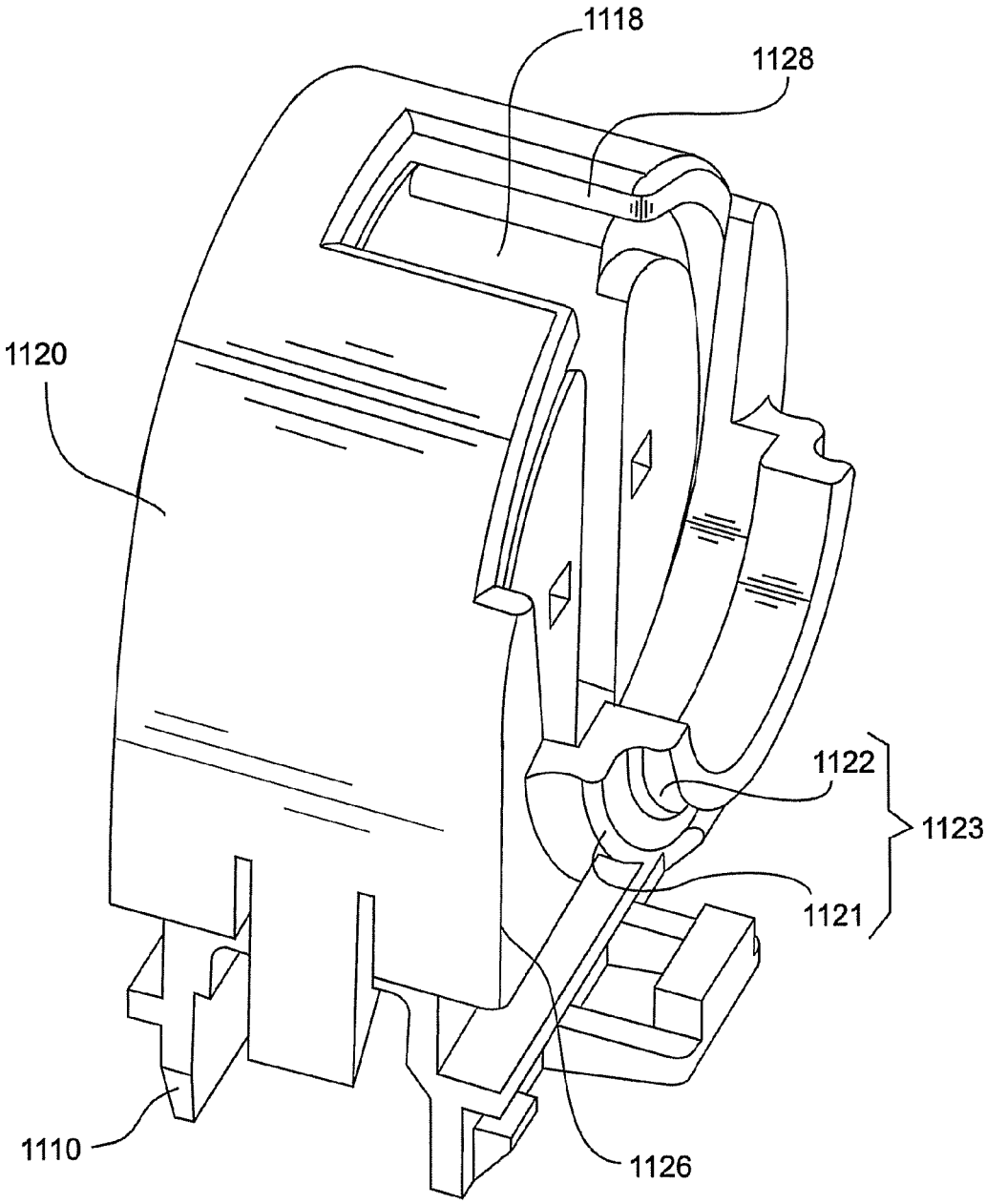
FIG. 90 is a perspective view of a socket and socket adaptor according to at least an embodiment.
Figure 91:
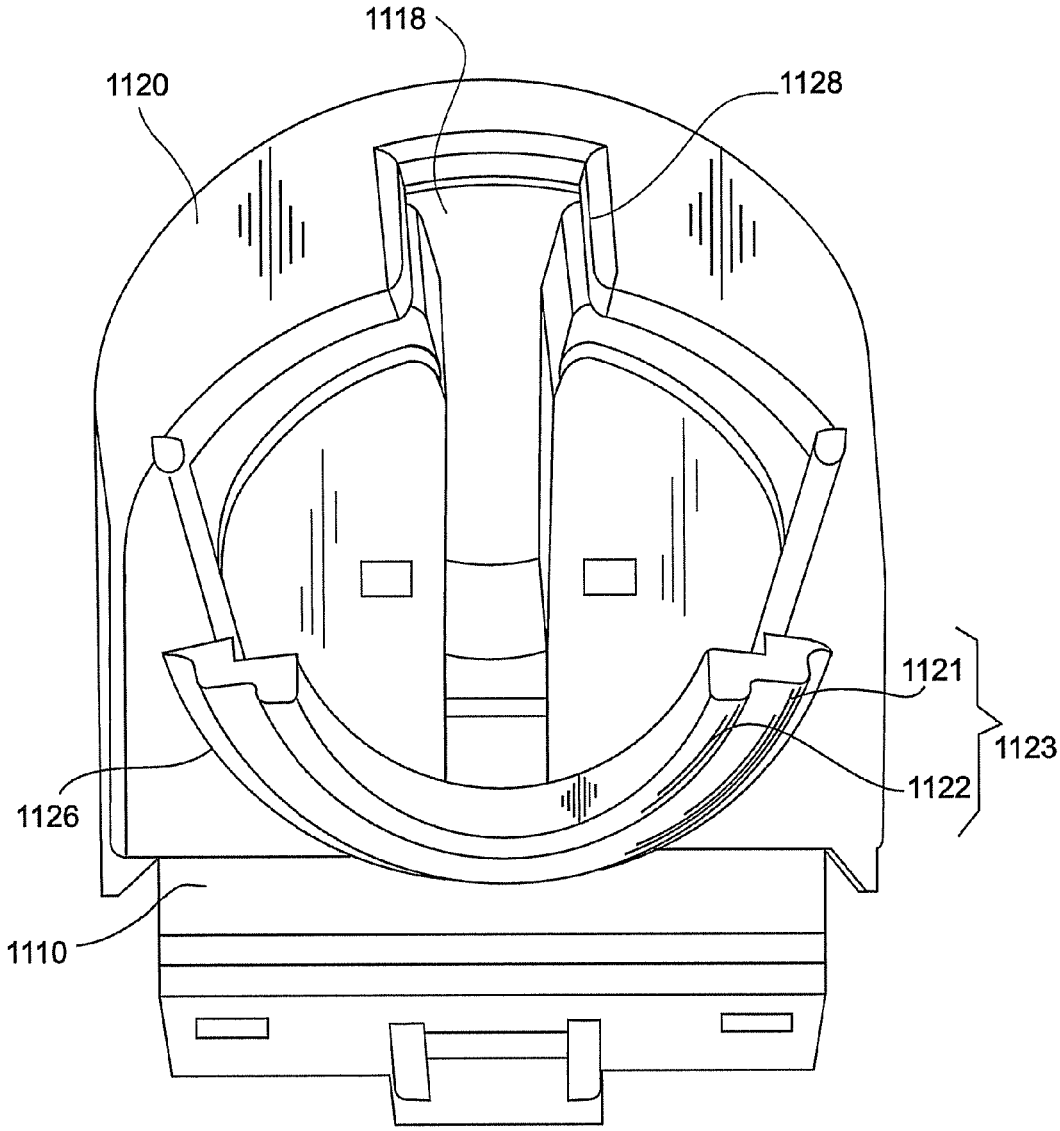
FIG. 91 is a perspective view of a socket and socket adaptor according to at least an embodiment.
Figure 92:
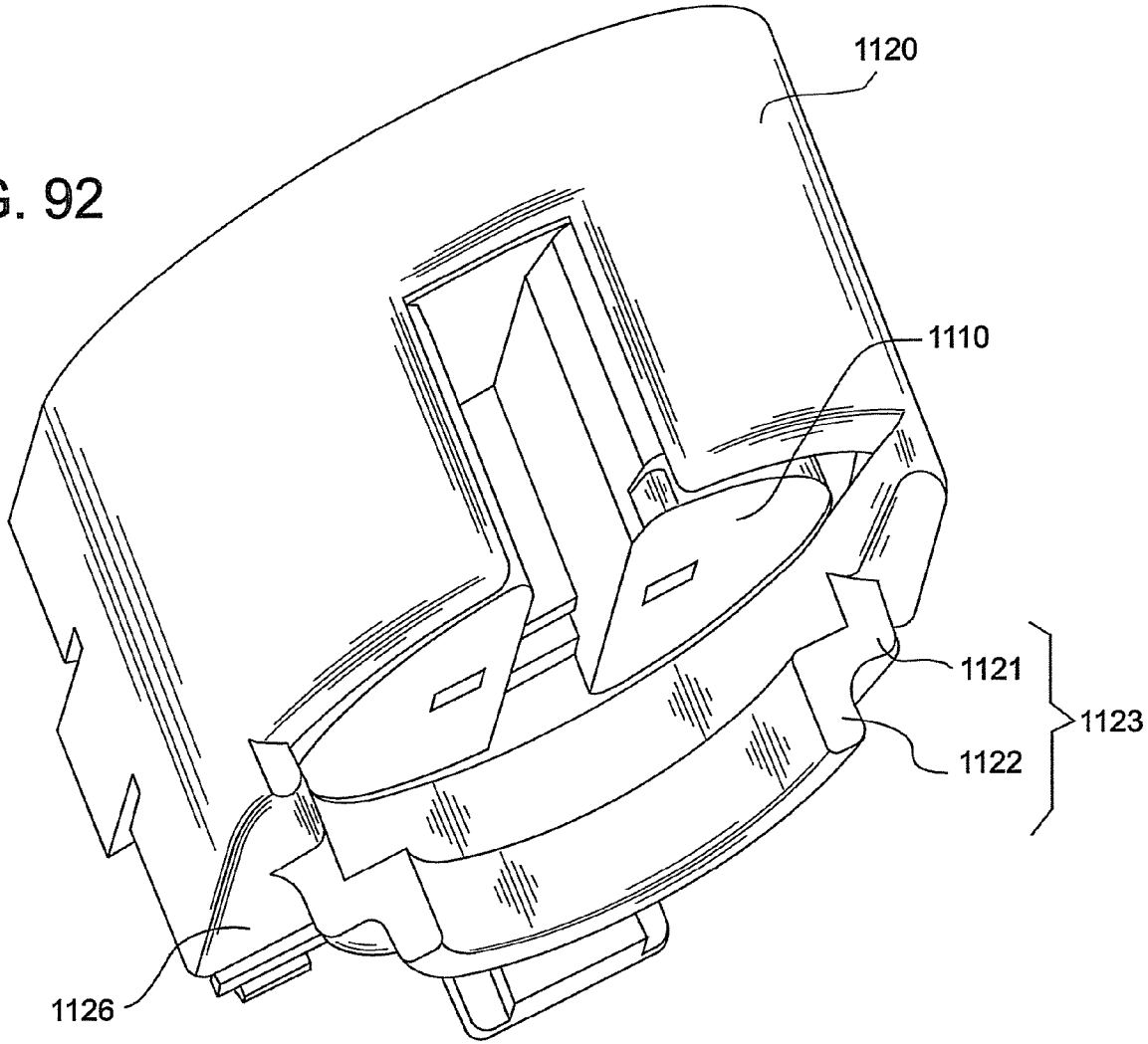
FIG. 92 is a perspective view of a socket and socket adaptor according to at least an embodiment.
Figure 93:
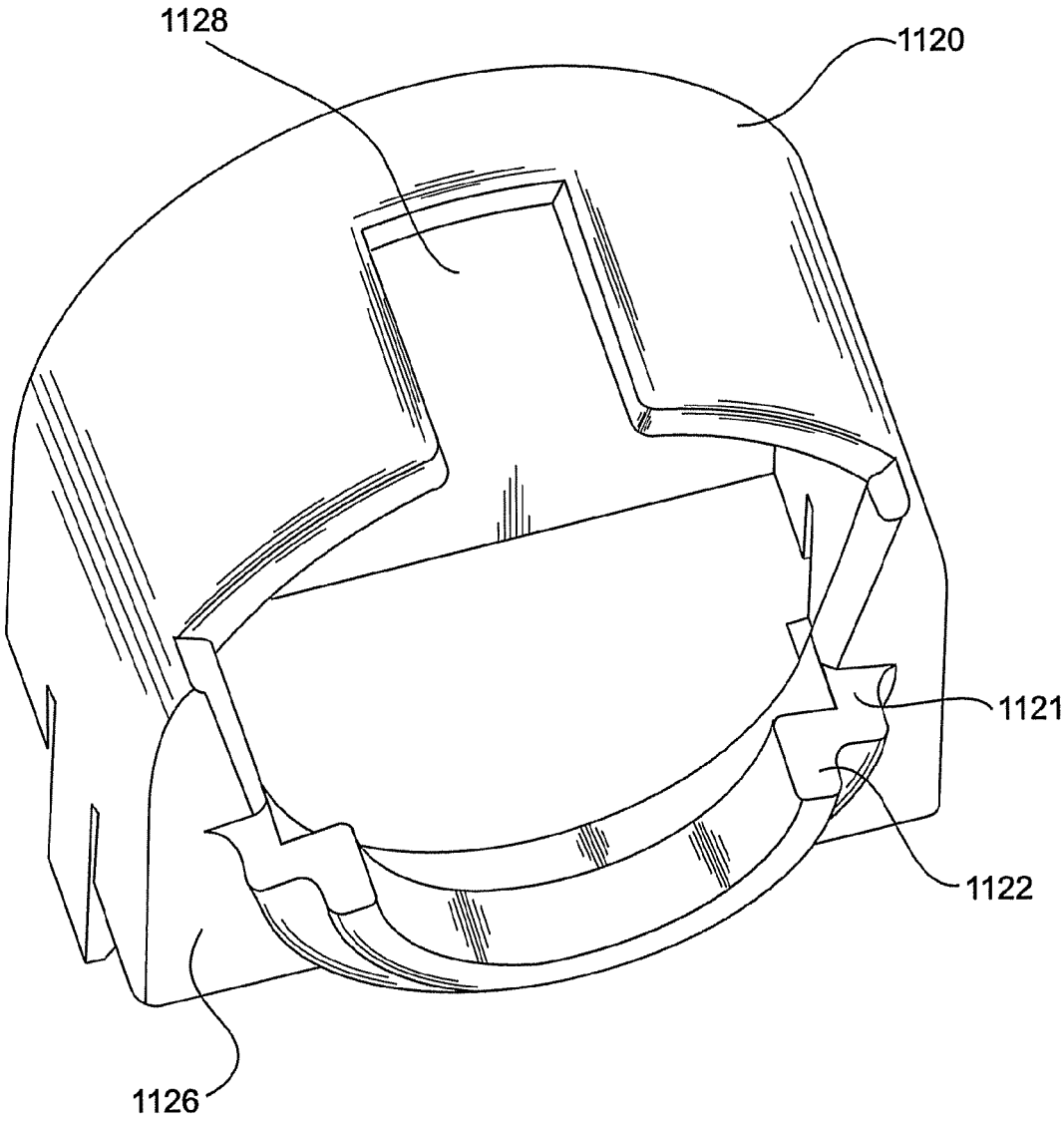
FIG. 93 is a perspective view of a socket adaptor according to at least an embodiment.
Figure 94:
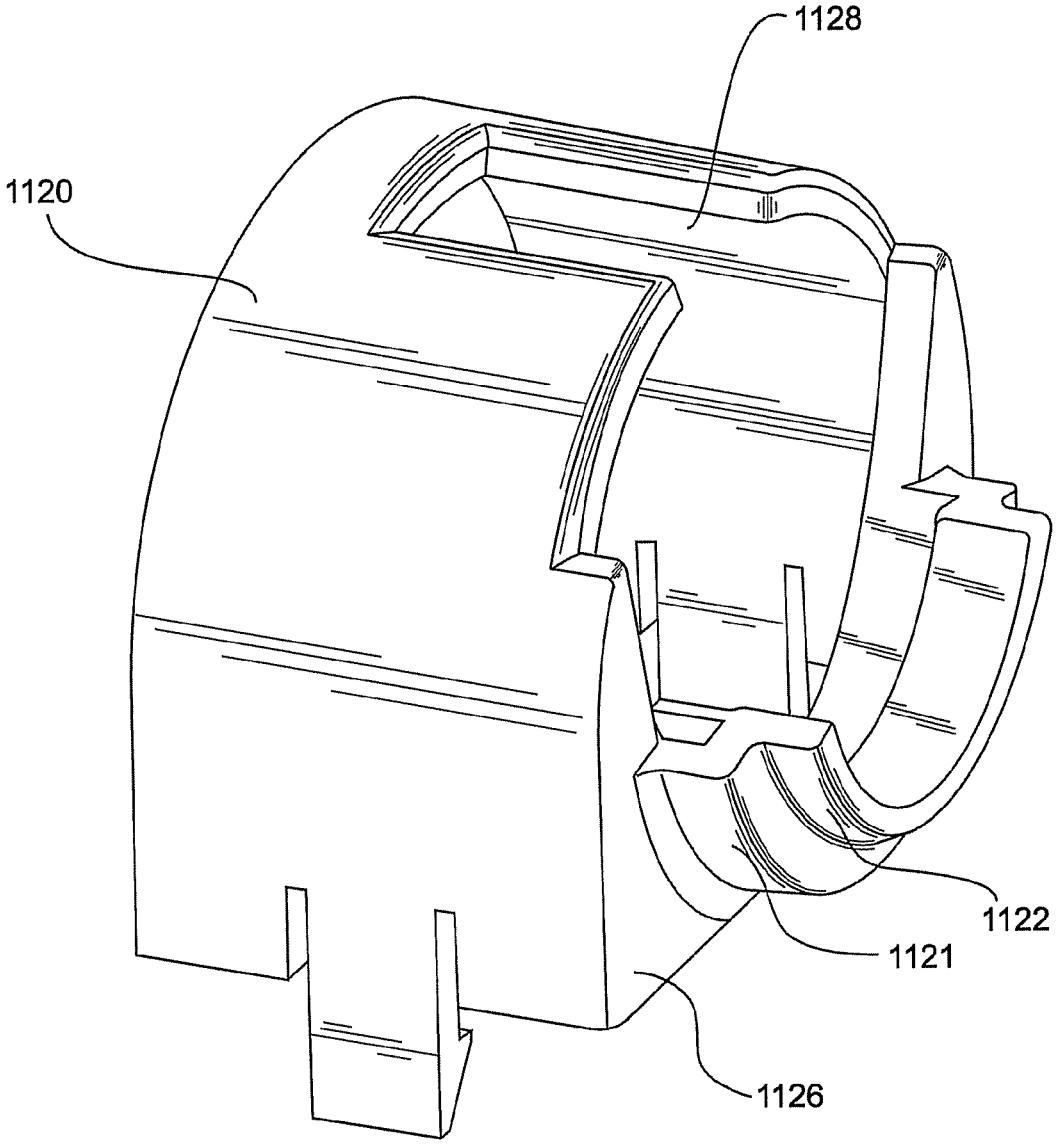
FIG. 94 is a perspective view of a socket adaptor according to at least an embodiment.
Figure 95:
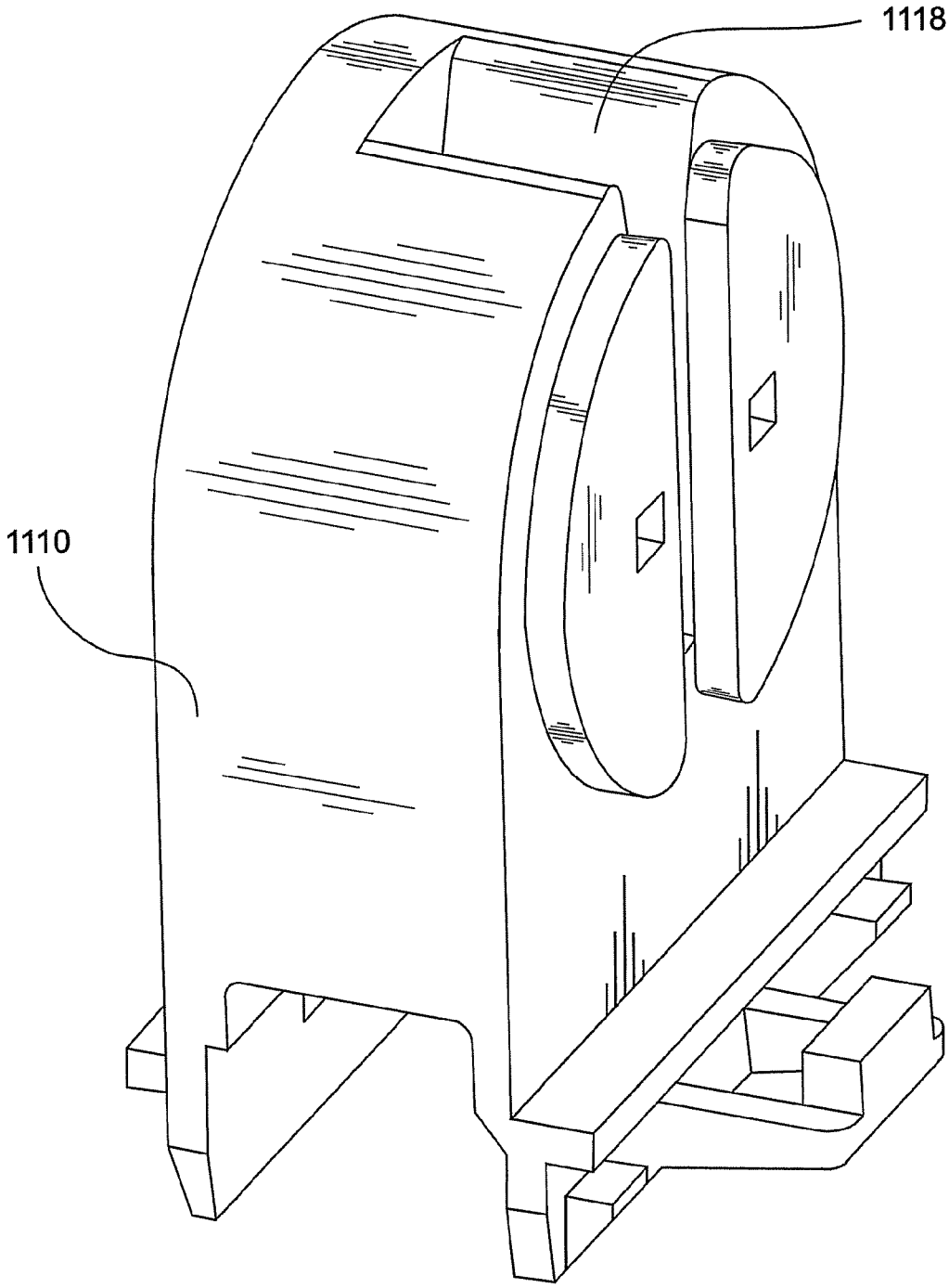
FIG. 95 is a perspective view of a socket according to at least an embodiment.

FIGS. 87-95 illustrate another possible embodiment of a socket adaptor. For example, FIG. 87 shows an adaptor 1120 that is fitted over a conventional socket 1110. Adaptor 1120 comprises a body that is open at one end to fit over socket 1110. Opposite the open end, adaptor 1120 is provided with an adaptor pin groove 1128 that fits over and corresponds to socket pin groove 1118. Thus, pins of a lamp base can be inserted through adaptor pin groove 1128 into socket pin groove 1118. Additionally, a cutout is provided in a front face 1126 of adaptor 1120, the cutout being sufficiently large to accommodate an end cap of a lamp.

Additionally a key portion 1123 may be provided on the front face 1126 of adaptor 1120. In the embodiments shown in FIGS. 87-94, key portion 1123 includes a first key segment 1121 and a second key segment 1122. First key segment 1121 is adjacent to front face 1126 and second key segment 1122 is positioned adjacent to first key segment 1121 in a direction away from front face 1126.

In the particular embodiment seen in FIGS. 87-94, first key segment 1121 is in the form of a groove, and second key segment 1126 is in the form of a ridge. As seen in FIG. 87, when end cap 1130 couples with socket 1110 and adaptor 1120, third cylindrical portion 1133 can couple with first key segment 1121 and second cylindrical portion 1132 can couple with second key segment 1122. In the particular embodiment shown in FIG. 87, first cylindrical portion 1131 of end cap 1130 rests outside of key portion 1123.

Thus, as illustrated in FIGS. 79-94, conventional sockets can be retrofitted with adaptors to benefit from the safety advantages provided by the keying system. While FIGS. 79-94 show particular embodiments of adaptors and end caps, it will be understood that adaptors shown in FIGS. 79-94 can be modified to incorporate any variety of key portions or key segment arrangements, such as those previously discussed or any other possible arrangements. For example, a socket adaptor may be provided with any of key portions 170, 270, 370, 470, or 570 discussed above.

Figure 96:
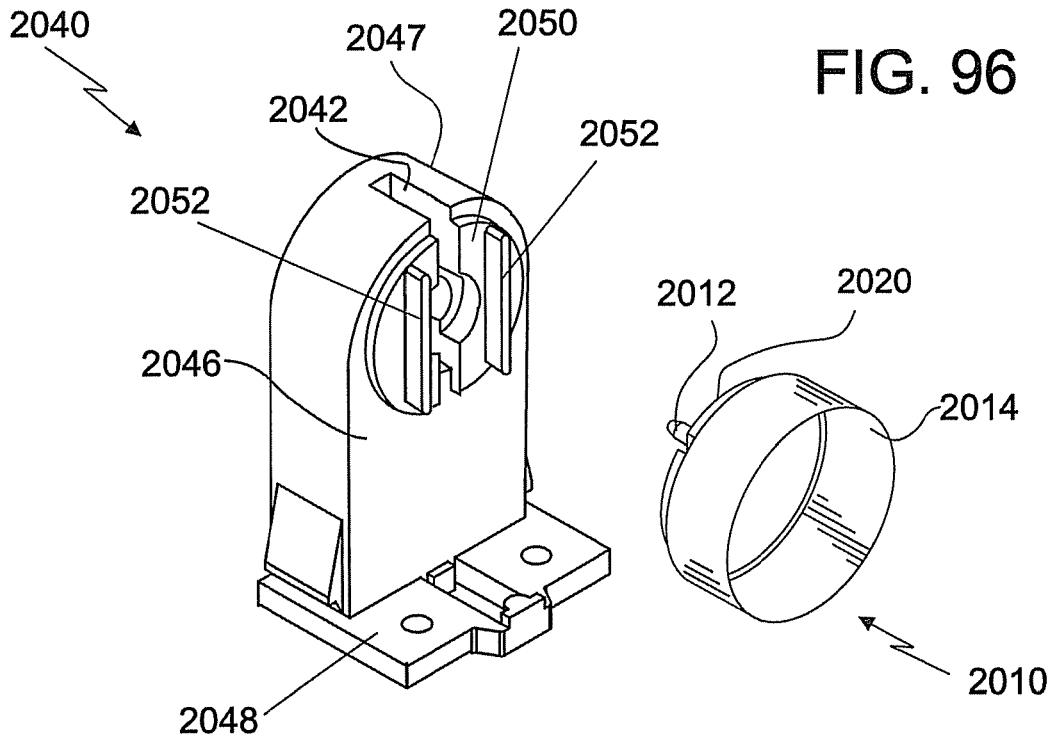
FIG. 96 shows a perspective view of an end cap and socket according to at least an embodiment.
Figure 97:
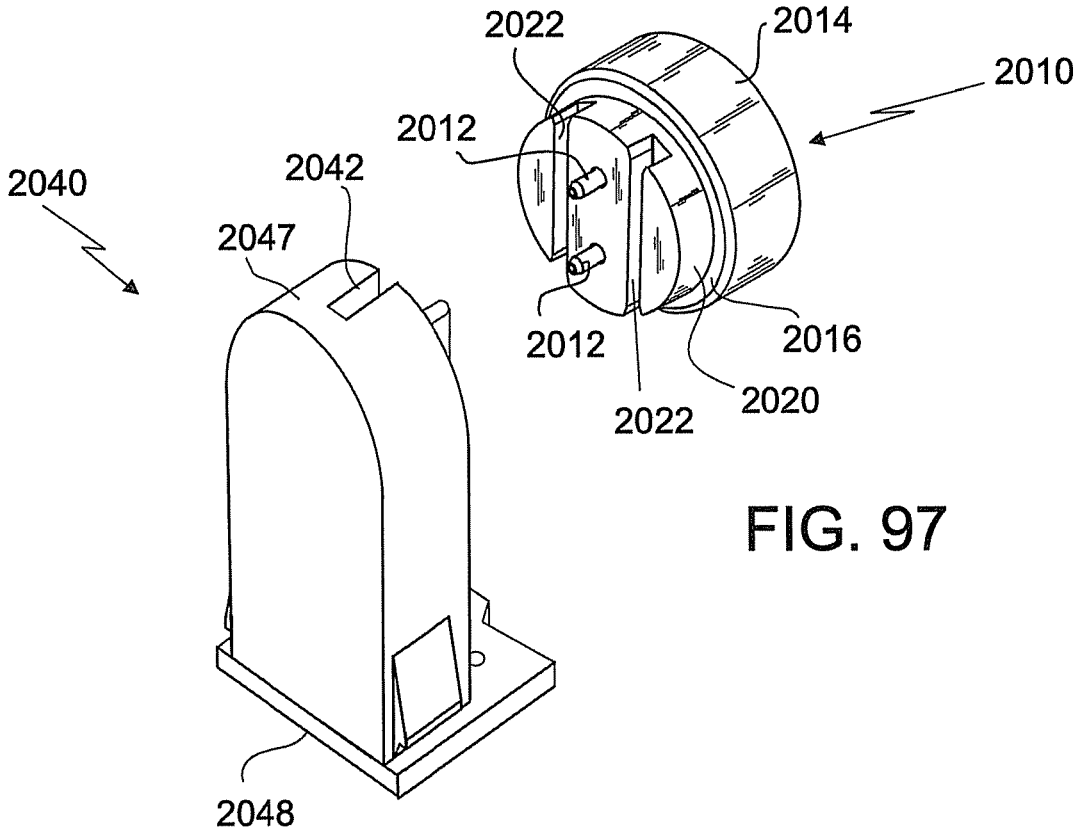
FIG. 97 shows a perspective view of an end cap and socket according to at least an embodiment.

FIGS. 96 and 97 illustrate alternative embodiments of an end cap and socket system. In particular, FIGS. 96 and 97 illustrate end cap 2010 and socket 2040 according to at least one embodiment.

End cap 2010 may be generally cylindrical in shape and open on one end to receive a lamp bulb therein. For example, end cap 2010 may include cylindrical portion 2014. At a first end of cylindrical portion 2014, an end face 2016 may be formed. At a second end of cylindrical portion 2014 opposition end face 2016, cylindrical portion 2014 is open and structured to receive a lamp bulb therein.

End cap 2010 may also include contact pins 2012. Contact pins 2012 extend from key disk 2020 in a direction approximately perpendicular to the surface of key disk 2020 and end face 2014. Contact pins 2012 are structured such that electrical connection can be provided from contact pins 2012 through the key disk and end face to a lamp bulb inserted into the open end of end cap 2010.

As further seen in FIGS. 96-97, end cap 2010 may also include key disk 2020. Key disk 2020 is provided on end face 2016, and is generally cylindrical in shape. Key disk 2020 has a predetermined depth, and includes at least one key groove 2022 cut into the key disk 2020 for at least a part of the depth. In the embodiments shown in FIGS. 96 and 97, the key groove 2022 extends completely through the circle defined by the key disk 2020; i.e., the key groove 2022 follows the path of a chord of the circle defined by key disk 2020. However, it will be understood that this is not a requirement, as there may be embodiments in which the key groove does not extend completely through key disk 2020.

Additionally, in the embodiment shown in FIGS. 96 and 97, there are two key grooves 2022 cut into key disk 2020, and key grooves 2022 are symmetrically disposed on key disk 2020. However, it is not necessary that key grooves 2022 be symmetrically placed, as some embodiments may include asymmetric key grooves. FIGS. 96 and 97 also show that key grooves 2022 may be parallel.

An embodiment of socket 2040 is also seen in FIGS. 96 and 97. Socket 2040 may include a front face 2046, a pin-receiving end 2047, and a base end 2048. Socket 2040 may also include an insertion groove 2042 beginning at the pin-receiving end 2047 and extending in a direction toward the base end 2048. Insertion groove 2042 may be structured such that contact pins 2012 can be inserted therein by sliding the pins into insertion groove 2012 in a direction towards base end 2048.

Figure 100:
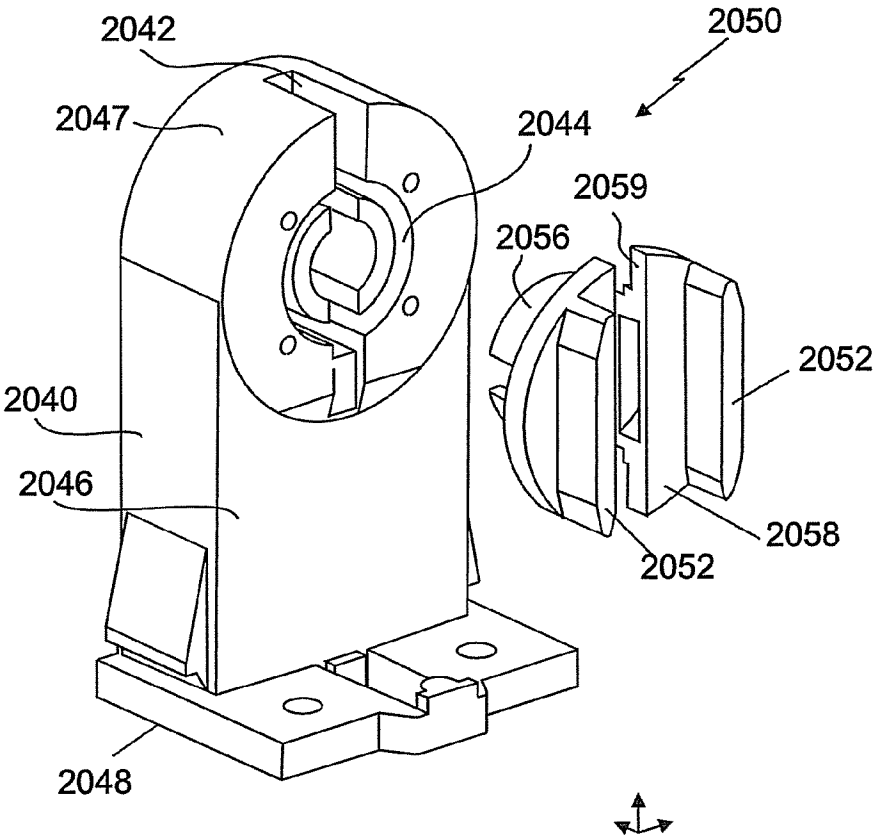
FIG. 100 shows an exploded perspective view of a socket according to at least an embodiment.
Figure 102:
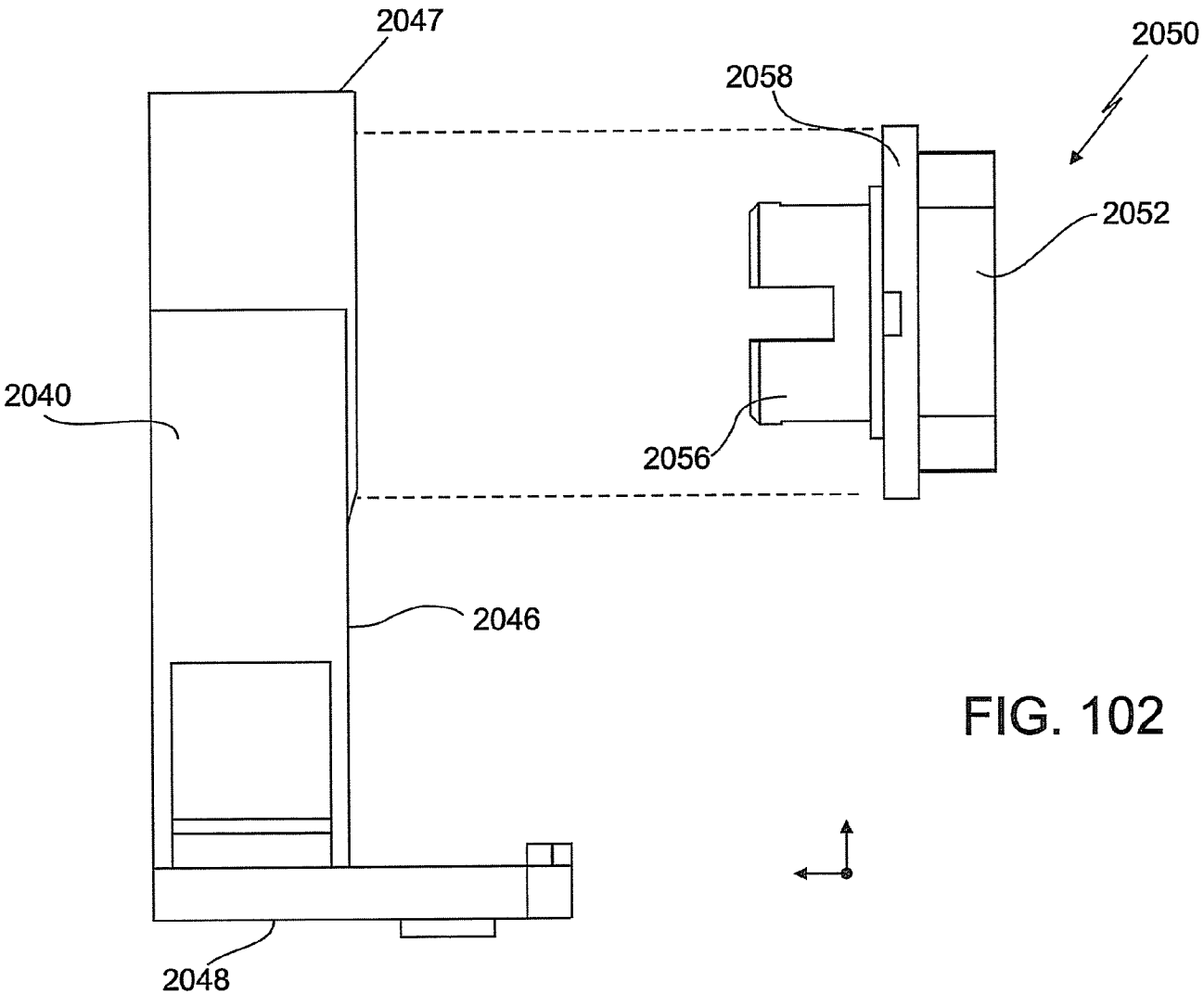
FIG. 102 shows an exploded side view of a socket according to at least an embodiment.
Figure 105:
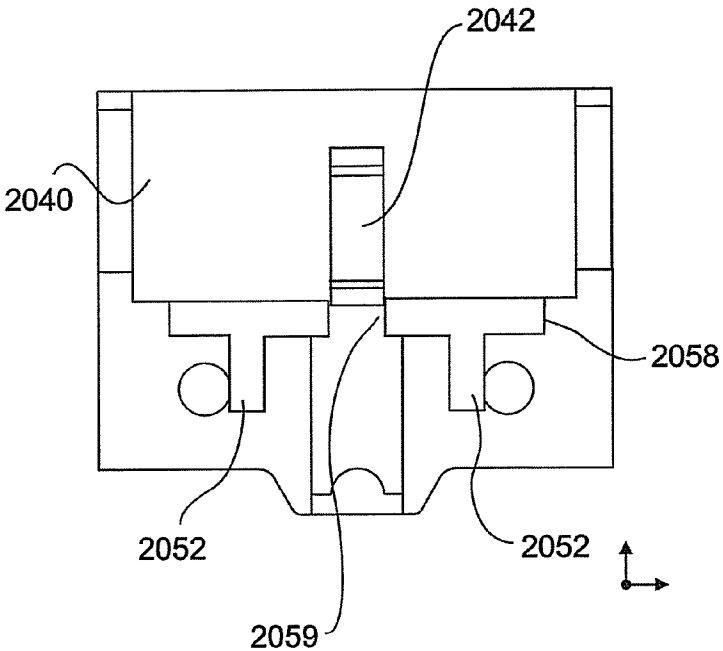
FIG. 105 shows a top view of a socket according to at least an embodiment.
Figure 103:
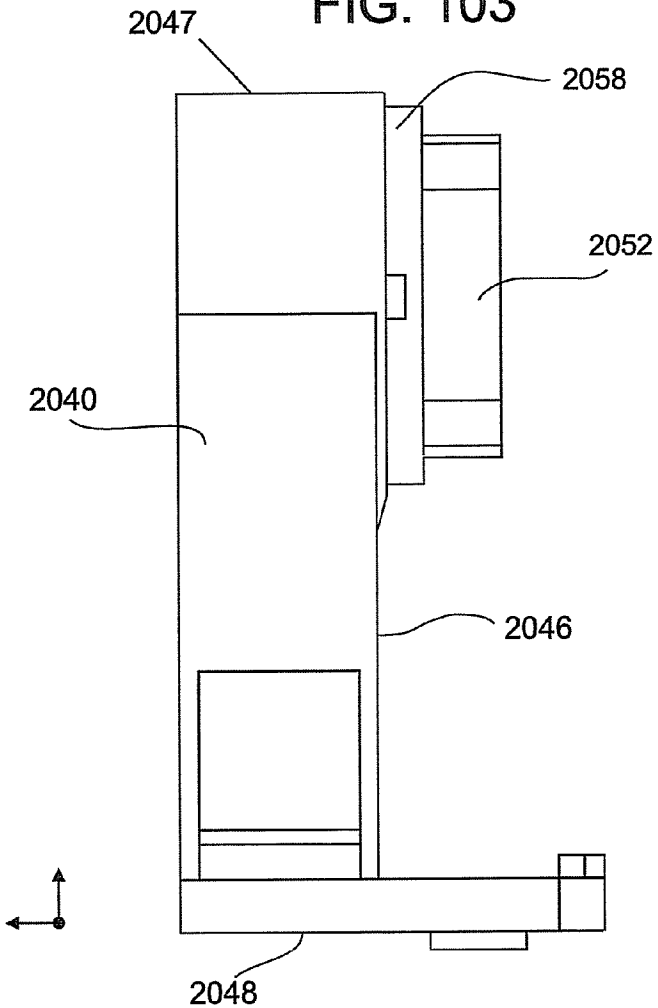
FIG. 103 shows a side view of a socket according to at least an embodiment.
Figure 104:
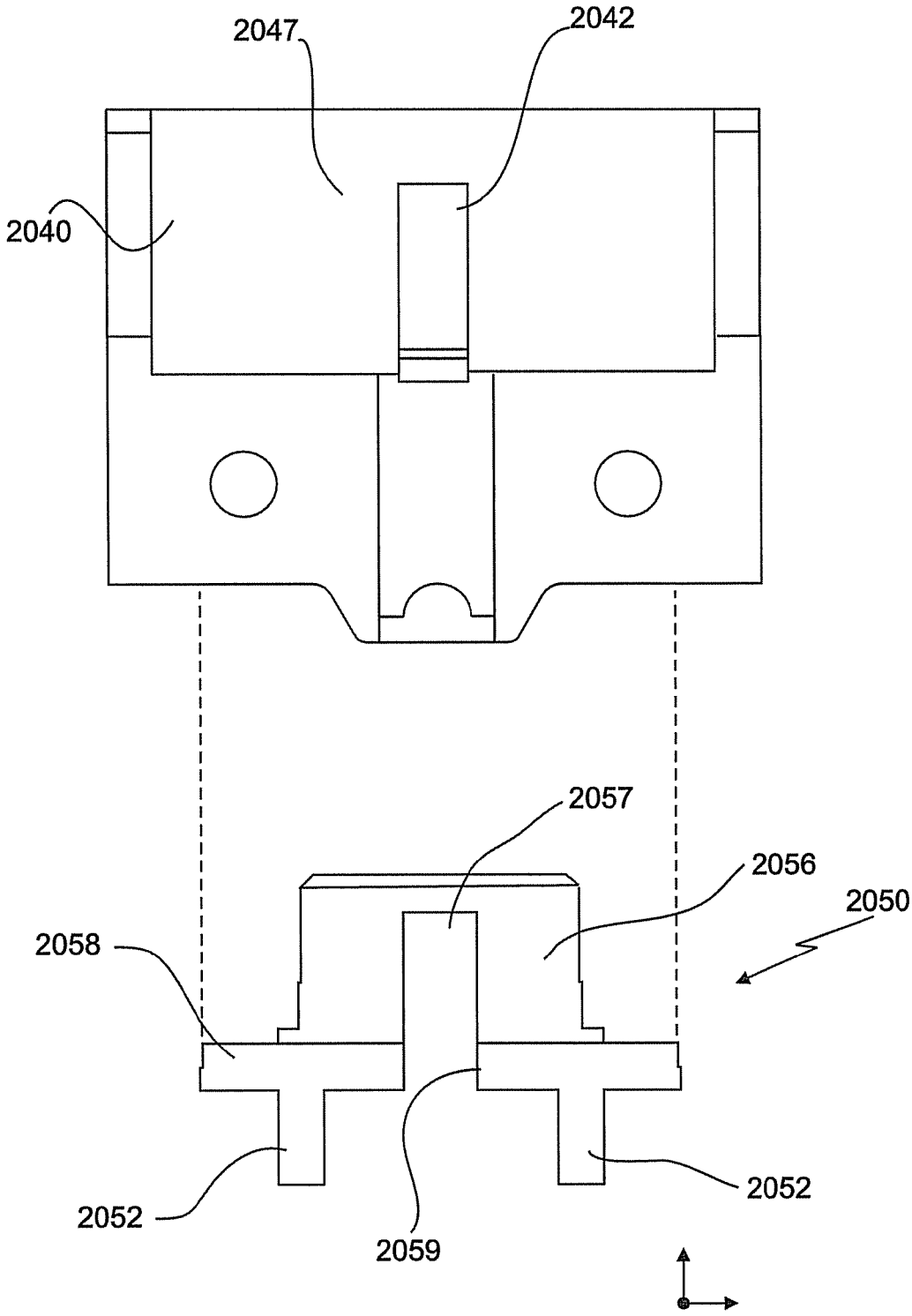
FIG. 104 shows an exploded top view of a socket according to at least an embodiment.

As seen in FIG. 100, socket 2040 may also include a rotation groove 2044 that is generally circular in shape. Rotation groove 2044 is cut into the front face 2046 of socket 2040 and intersects with insertion groove 2042. Socket 2040 may also include electrical contacts that are positioned within rotation groove 2044. When contact pins 2012 of end cap 2010 are rotated in rotation groove 2044, contact pins 2012 can come in contact with the electrical contacts, thus creating an electrical connection between the lamp bulb and the socket 2040.

FIGS. 100-105 show an embodiment of a key piece 2050 that can be inserted into socket 2040. In general, key piece 2050 is inserted into rotation groove 2044 of socket 2040 and is rotatable within rotation groove 2044. Key piece 2050 may be held in place within socket 2040 through the use of clips provided on socket 2040 and/or key piece 2050, or by any other suitable means for maintaining key piece 2050 in a rotatable state within socket 2040.

As seen in FIGS. 100-105, key piece 2050 may include a key piece body 2056, a key piece face 2058, and at least one key rib 2052. One embodiment of key piece body 2056 may be a hollow cylinder having a first and second end, the cylinder being structured to fit within the rotation groove. Key piece body 2056 may also include a key piece body insertion groove 2057 that extends from the first end of the key piece body 2056 and extending in a direction toward the second end of the key piece body 2056. When key piece 2050 is assembled with socket 2040, key piece body insertion groove 2057 is perpendicular to front face 2046 of socket 2040, key piece body insertion groove 2057 can align with insertion groove 2042 when key piece 2050 is oriented accordingly.

FIGS. 100-105 further illustrate that key piece 2058 may be attached to the first end of key piece body 2056. Key piece face 2058 may be approximately parallel to front face 2046 of socket 2040, and key piece face 2058 may include a key piece face insertion groove 2059 aligned with key piece body insertion groove 2057. Key piece face insertion groove 2059 extends in a straight line through the center of key piece face 2058.

Additionally, at least one key rib 2052 may be provided on key piece face 2058. Key rib 2052 extends from the key piece face in a direction away from front face 2046 of socket 2040. As further seen in FIGS. 100 and 104, key rib 2052 may be parallel to key piece face insertion groove 2059.

In general, the key ribs 2052 provided on key piece 2050 will be configured so as to correspond to the key grooves 2022 on a mated end cap. For example, as seen in the embodiments shown in FIGS. 96-97, the key ribs 2052 extend completely through the circle defined by the key piece face 2058; i.e., key ribs 2052 follow the path of a chord of the circle defined by key piece face 2058, similar to key grooves 2022 on end cap 2010 in FIGS. 96-97. However, it will be understood that this is not a requirement, as there may be embodiments in which the key rib does not extend completely across key piece face 2058.

Additionally, in the embodiment shown in FIGS. 96-97, there are two key ribs 2052 provided on key piece face 2058, and key ribs are symmetrically disposed on key piece face 2058, similar to key grooves 2022 seen in FIGS. 96-97. However, it is not necessary that key ribs be symmetrically placed, as some embodiments may include asymmetric key ribs. FIGS. 96-97 also show that key ribs 2052 may be parallel.

To operate the end cap and socket system shown in FIGS. 96-97, end cap 2010 is positioned such that the contact pins can be slid into insertion groove 2042. If the key disk 2020 of end cap 2010 is properly mated with key piece 2050 of socket 2040, then key ribs 2052 will insert into key grooves 2022 as the end cap 2010 is slid into position. If an end cap and socket are not properly mated, then key ribs 2052 will not align with key grooves 2022, and it will not be possible to couple the end cap with socket.

Once end cap 2010 is fully inserted into the socket 2040, end cap 2010 can be rotated relative to socket 2040. Although hidden from view by key piece face 2058, contact pins 2012 will rotate through rotation groove 2044 as end cap 2010 is rotated. Contact pins will come into contact with the electrical contacts within the rotation groove, and be locked into place through elastic force of the electrical contacts or any other suitable means for maintaining contact between electrical pins 2012 and the electrical contacts in the rotation groove.

The ability to prevent improper mating between sockets and end caps is an important safety feature. For example, a socket may be connected to a power supply of a certain magnitude. If a user inserts a bulb and end cap into the socket that is not compatible with the power supply, then the bulb and/or socket could be damaged, and there is a risk of electrical shock to the user or a risk of sparking and fire. Thus, a socket 2040 with key piece 2050 can be configured to only accept bulbs with end caps 2010 having a properly configure key disk 2020, thereby helping to ensure that only a properly selected bulb is inserted, and thereby preventing damage to property and ensuring the safety of workers.

Figure 98:
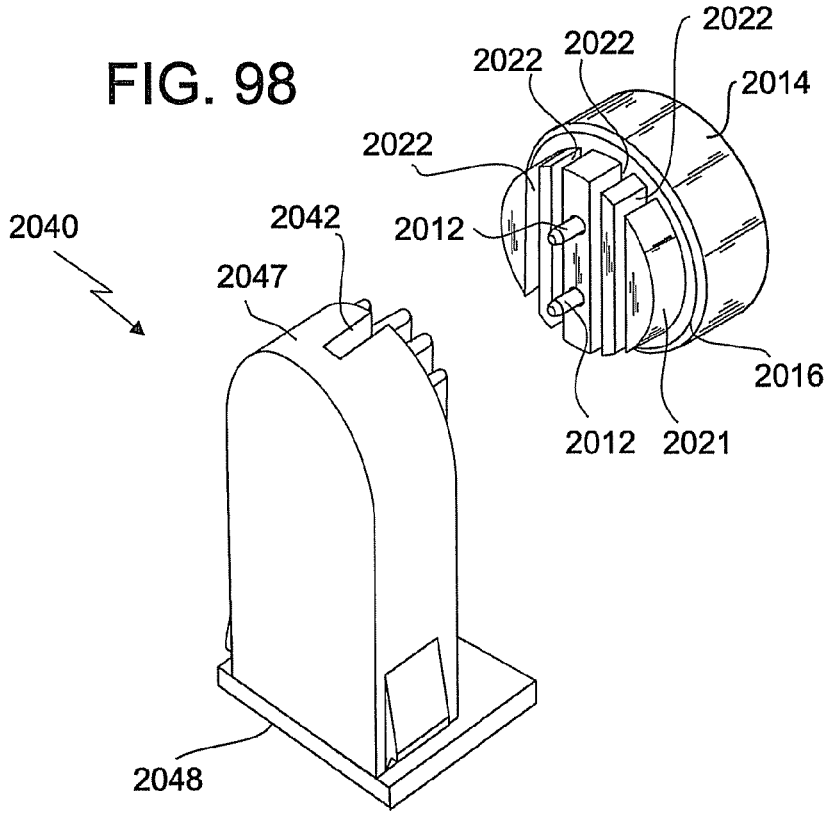
FIG. 98 shows a perspective view of an end cap and socket according to at least an embodiment.
Figure 99:
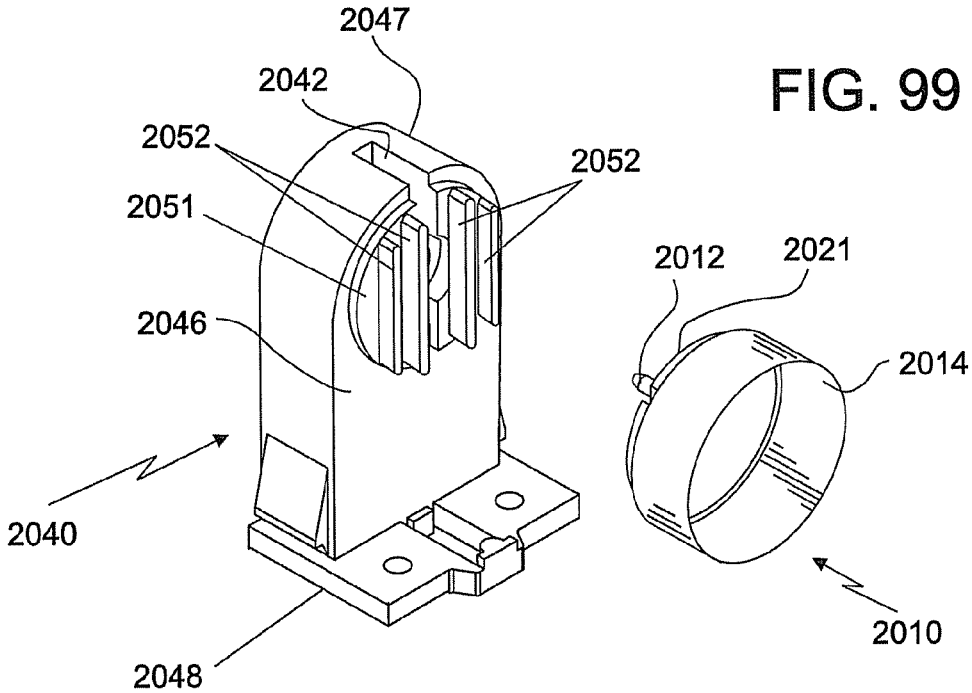
FIG. 99 shows a perspective view of an end cap and socket according to at least an embodiment.
Figure 101:
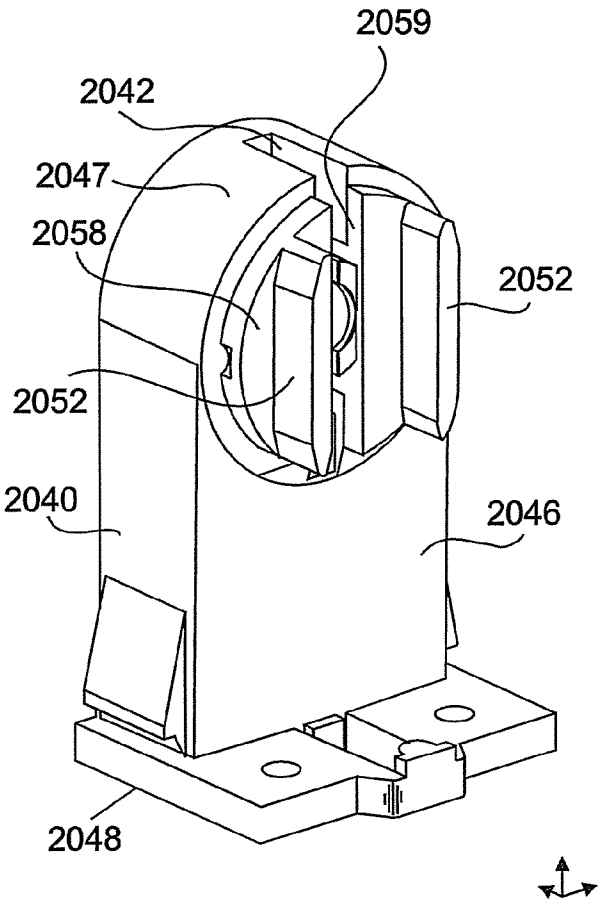
FIG. 101 shows a perspective view of a socket according to at least an embodiment.

FIGS. 98-99 show at least another embodiment of an end cap and socket system. For example, the end cap 2010 in FIGS. 98-99 is provided with a key disk 2021 that includes four key grooves 2022. Accordingly, socket 2040 in FIGS. 98-99 is provided with a key piece 2051 that includes four key ribs 2022. The four key ribs 2052 of key piece 2051 are configured to correspond to the four key grooves 2022 of key disk 2021.

Figure 106:
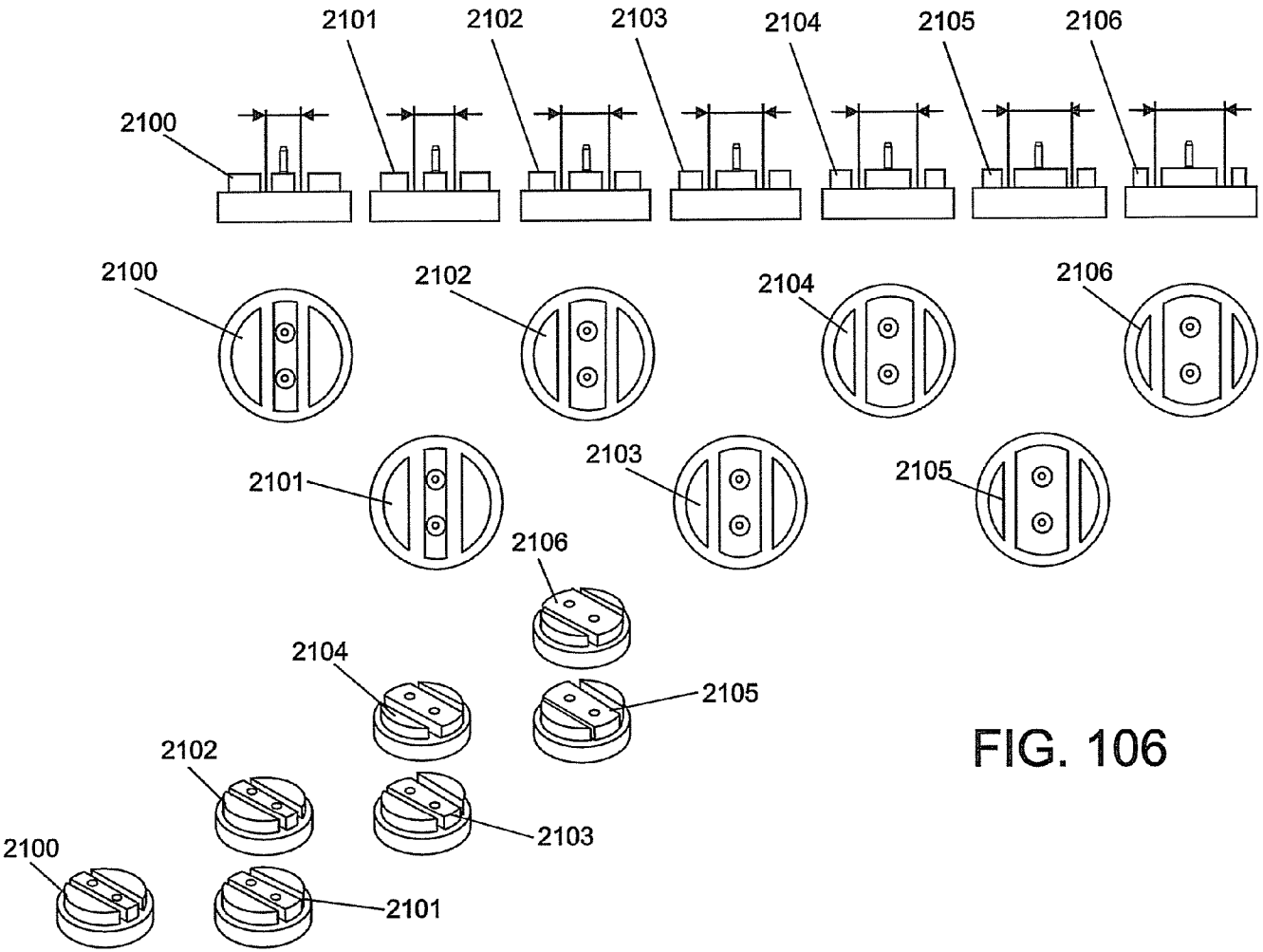
FIG. 106 shows various views of end caps according to various embodiments.
Figure 107:
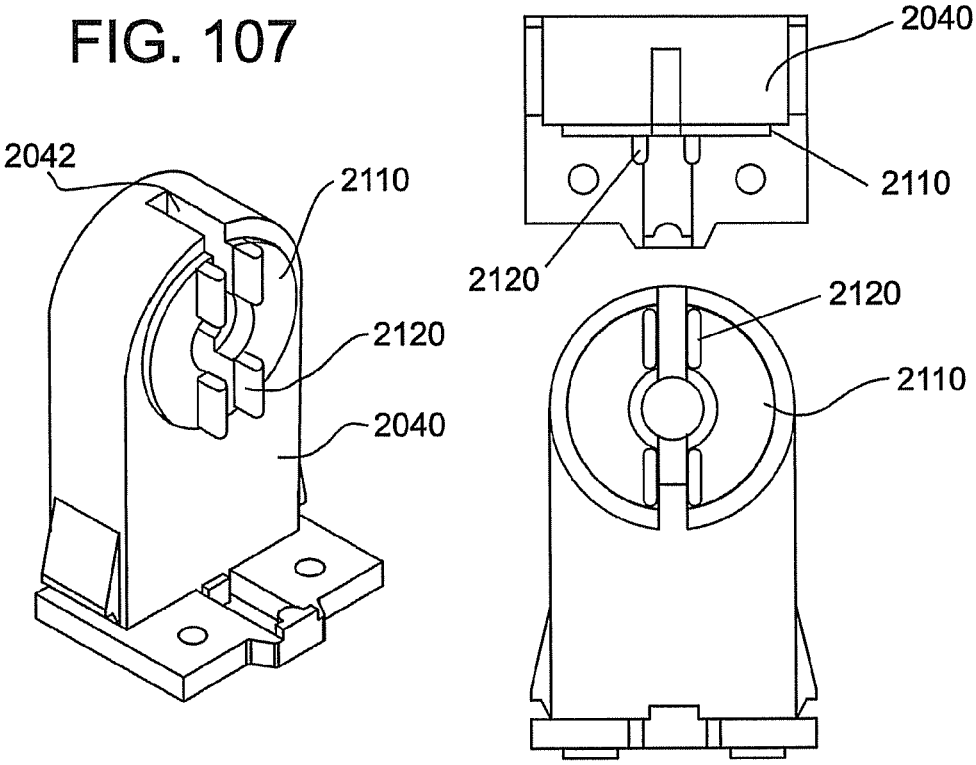
FIG. 107 shows various views of a socket according to at least an embodiment.
Figure 108:
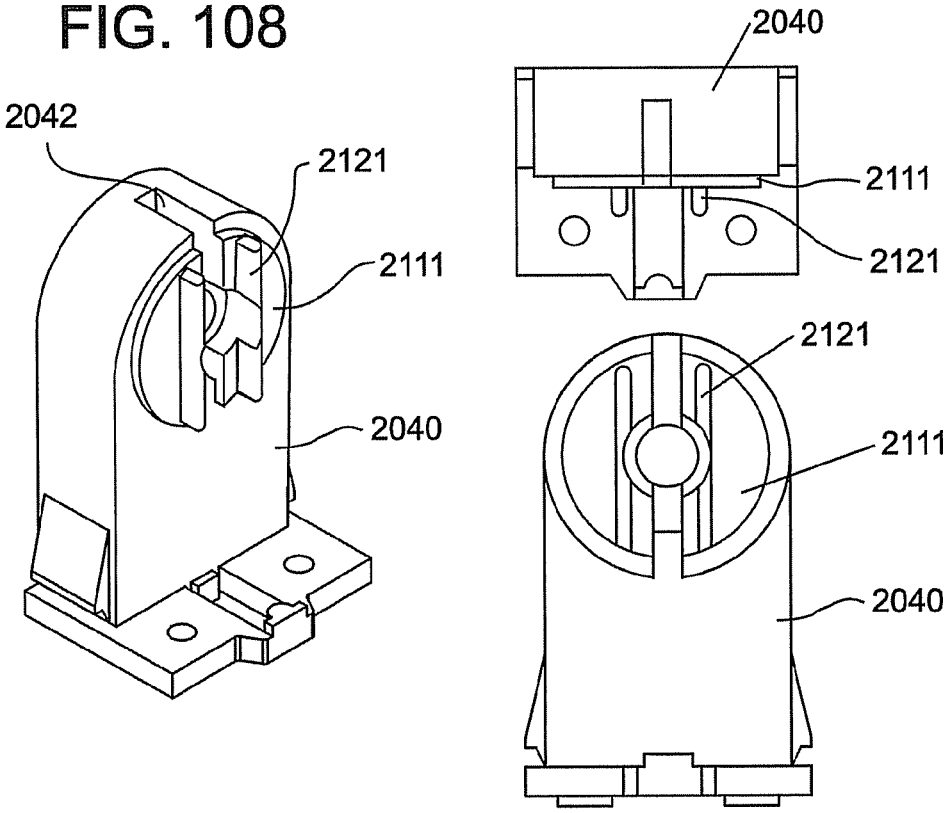
FIG. 108 shows various views of a socket according to at least an embodiment.
Figure 109:
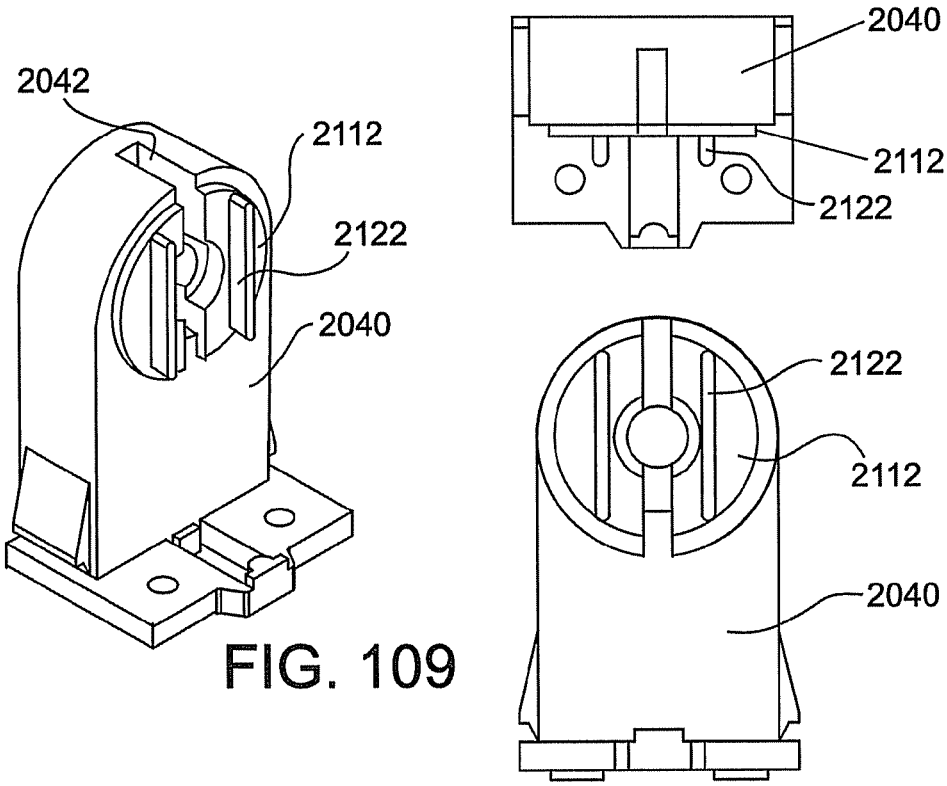
FIG. 109 shows various views of a socket according to at least an embodiment.
Figure 110:
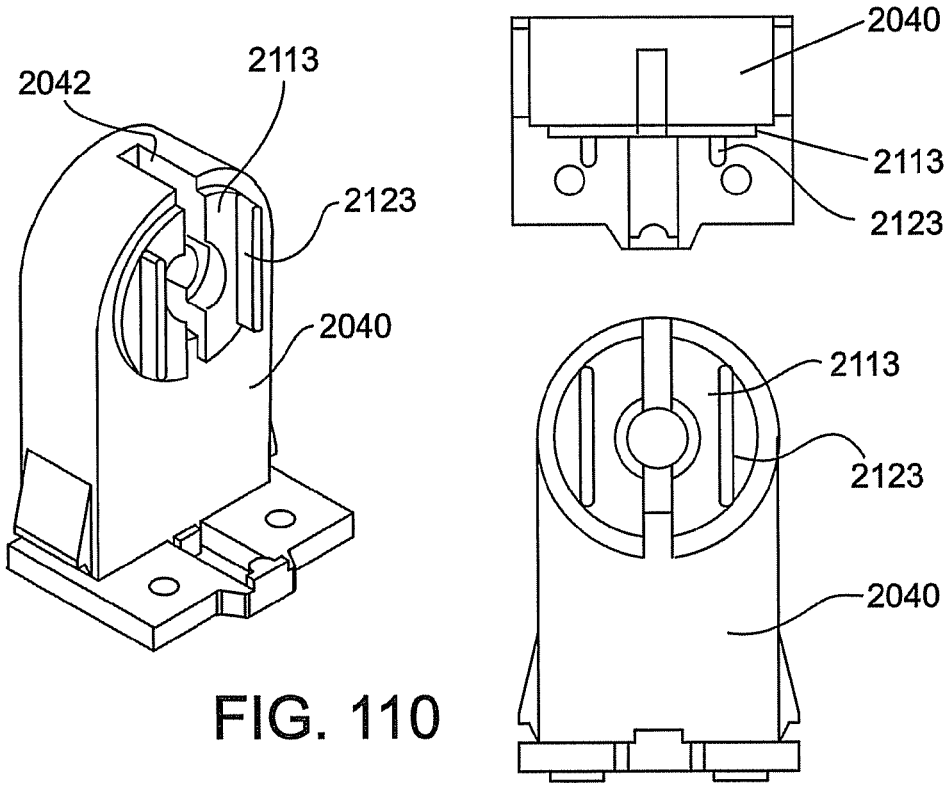
FIG. 110 shows various views of a socket according to at least an embodiment.
Figure 111:
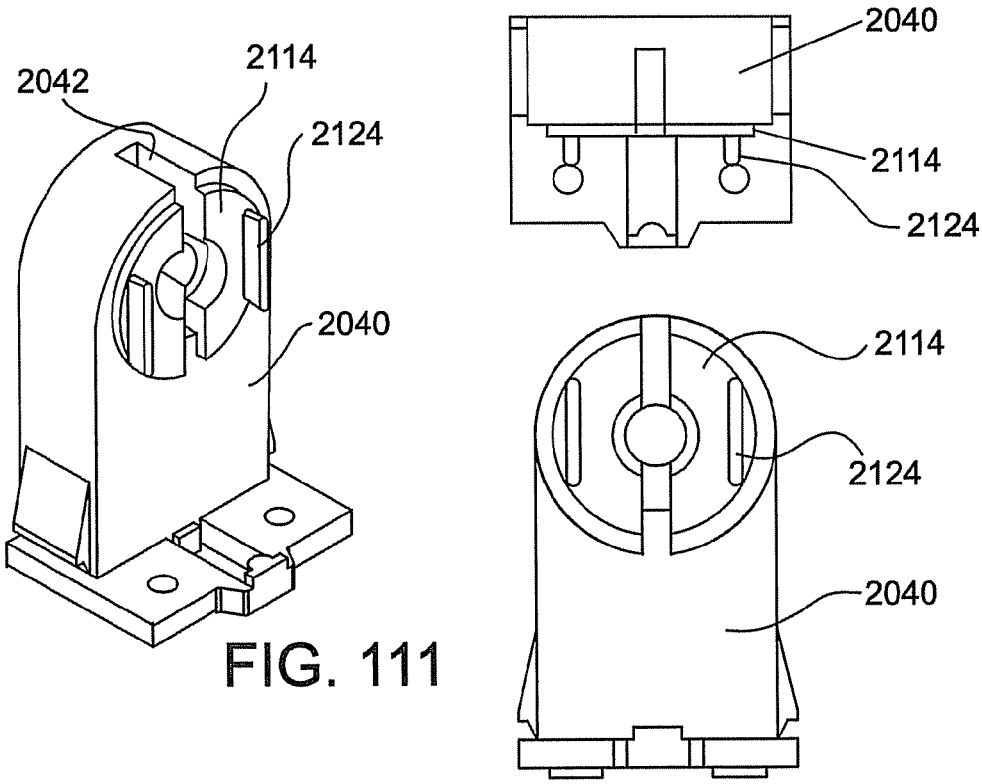
FIG. 111 shows various views of a socket according to at least an embodiment.
Figure 112:
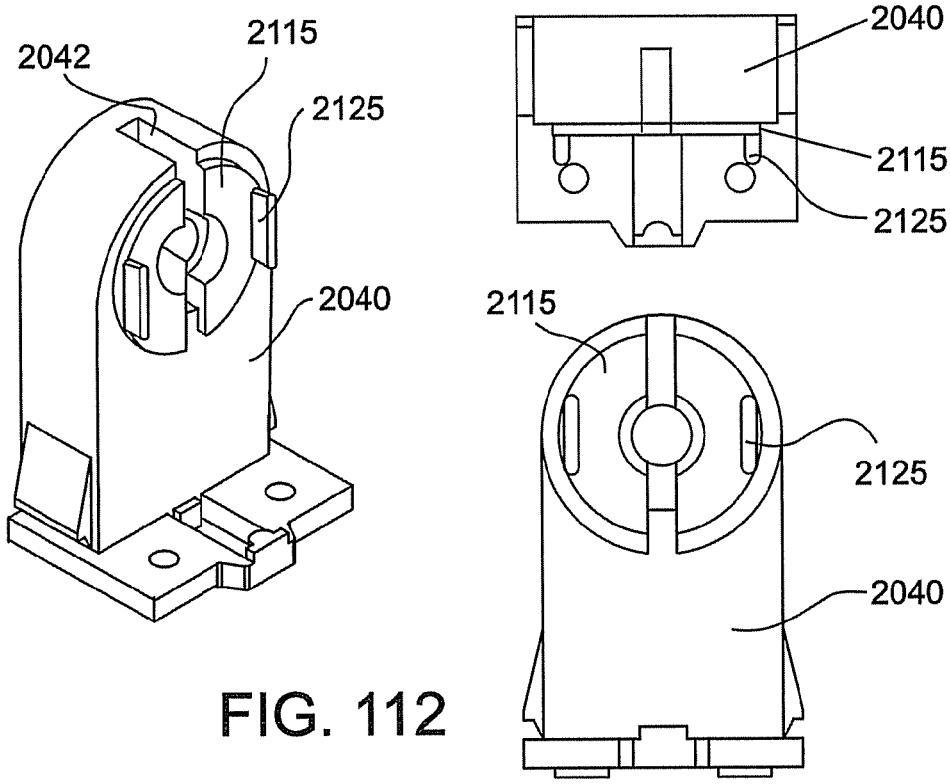
FIG. 112 shows various views of a socket according to at least an embodiment.

FIG. 106 shows views of various embodiments of key disks. For example, in comparing key disks 2100, 2101, 2102, 2103, 2104, 2105, 2106, it is seen that the distance between the key grooves can be varied. For example, key disk 2100 has a short distance between the key grooves, while key 2106 has a larger distance between the key grooves.

FIGS. 107-112 show views of sockets 2040 with various embodiments of key disks. For example, the sockets in FIGS. 107-112 are provided with key disks 2110, 2111, 2112, 2113, 2114, and 2115, each of which respectively have key ribs 2120, 2121, 2122, 2123, 2124, and 2125. It can be seen in FIGS. 107-112 that the distance between the key ribs can be varied to accommodate various different end cap key disk designs.

Figure 113:
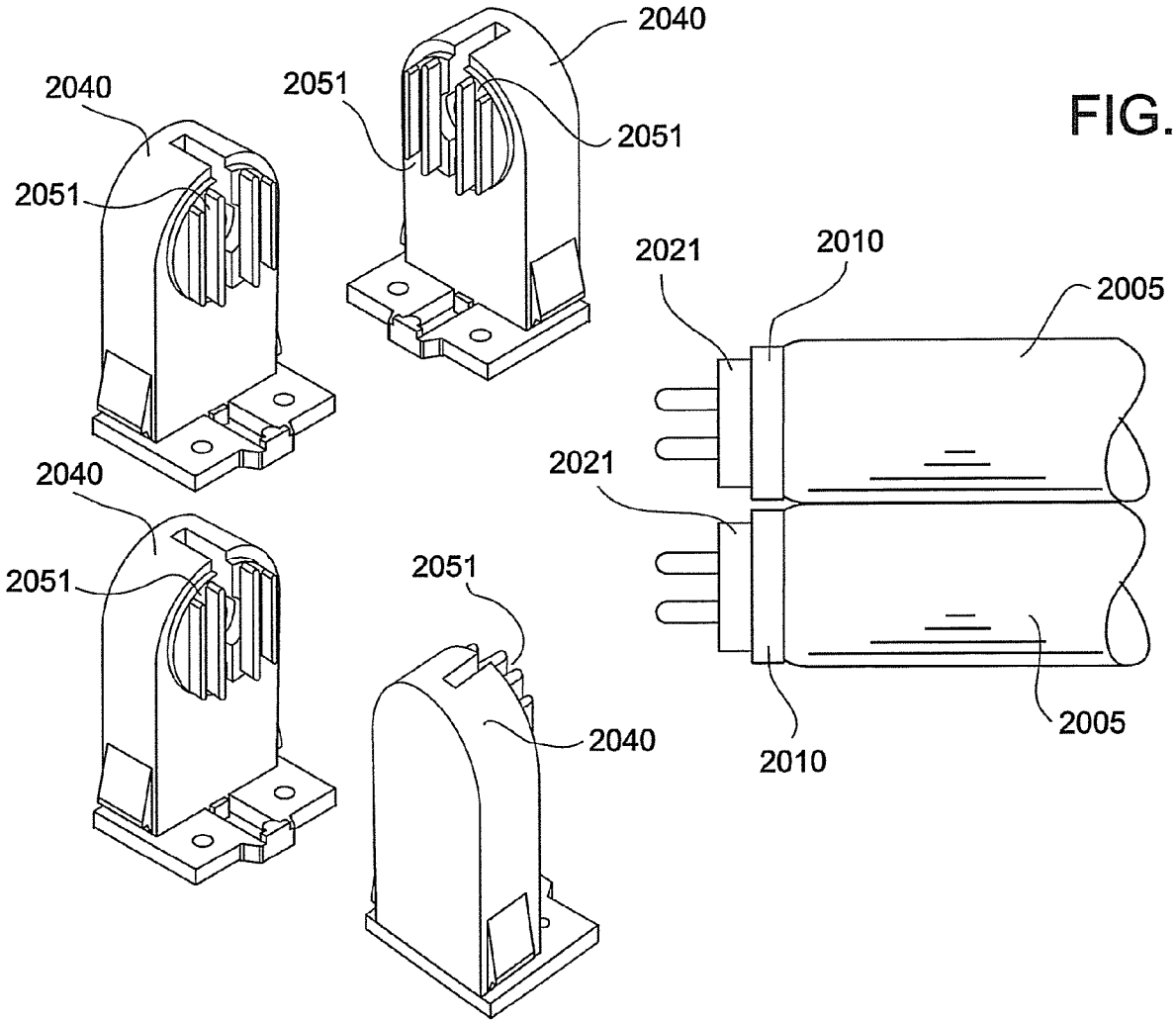
FIG. 113 shows lamps with end caps and sockets according to at least an embodiment.
Figure 114:
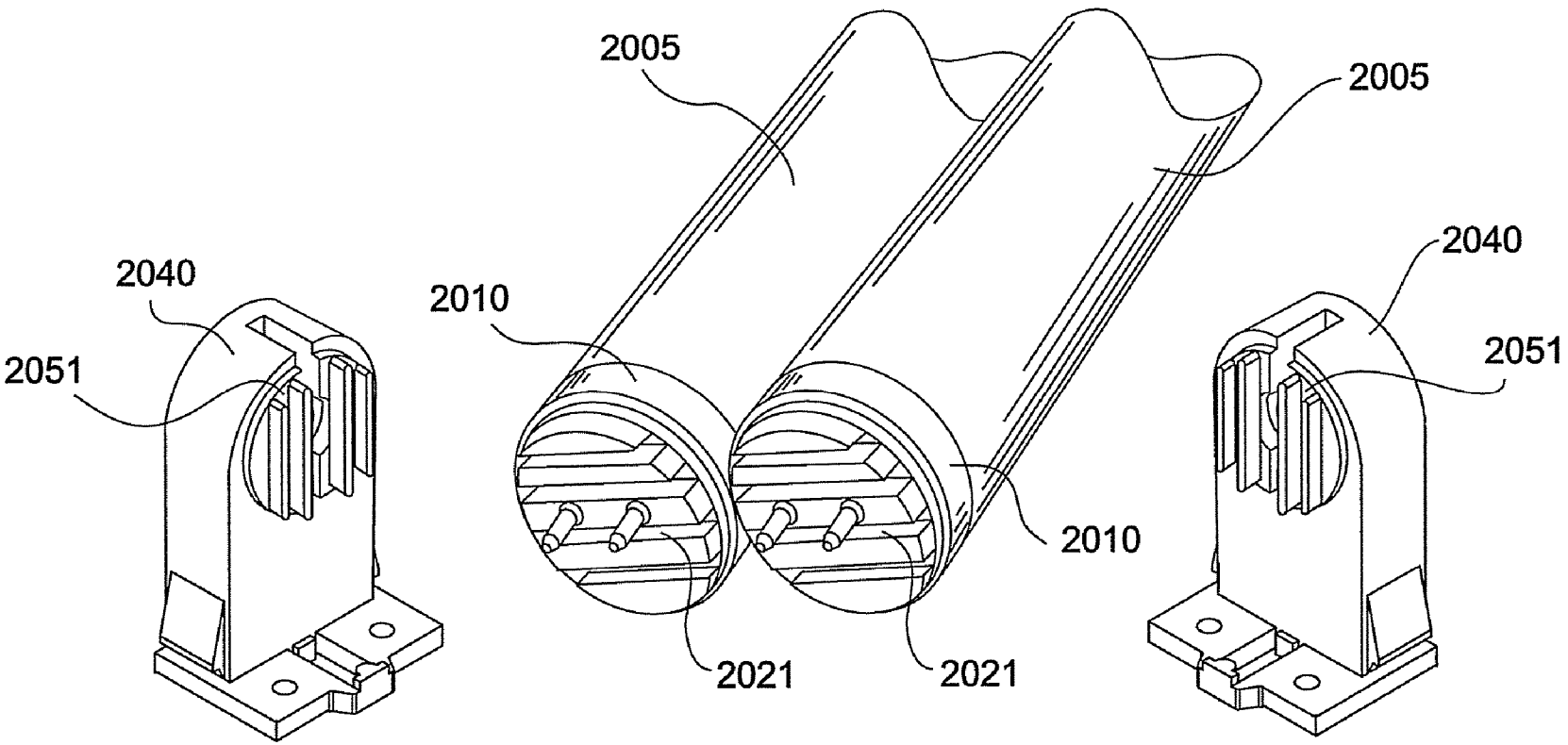
FIG. 114 shows lamps with end caps and sockets according to at least an embodiment.
Figure 115:
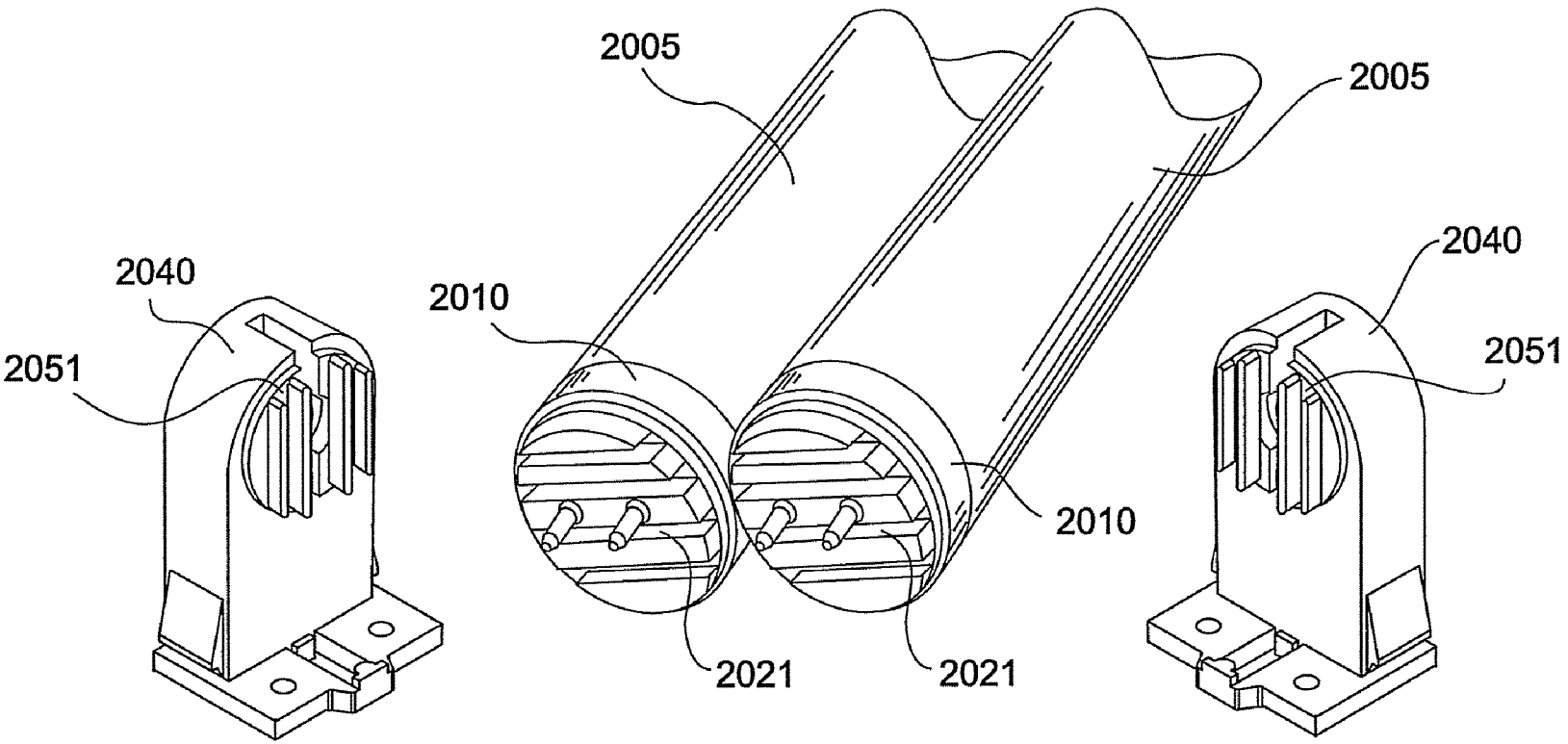
FIG. 115 shows lamps with end caps and sockets according to at least an embodiment.
Figure 116:
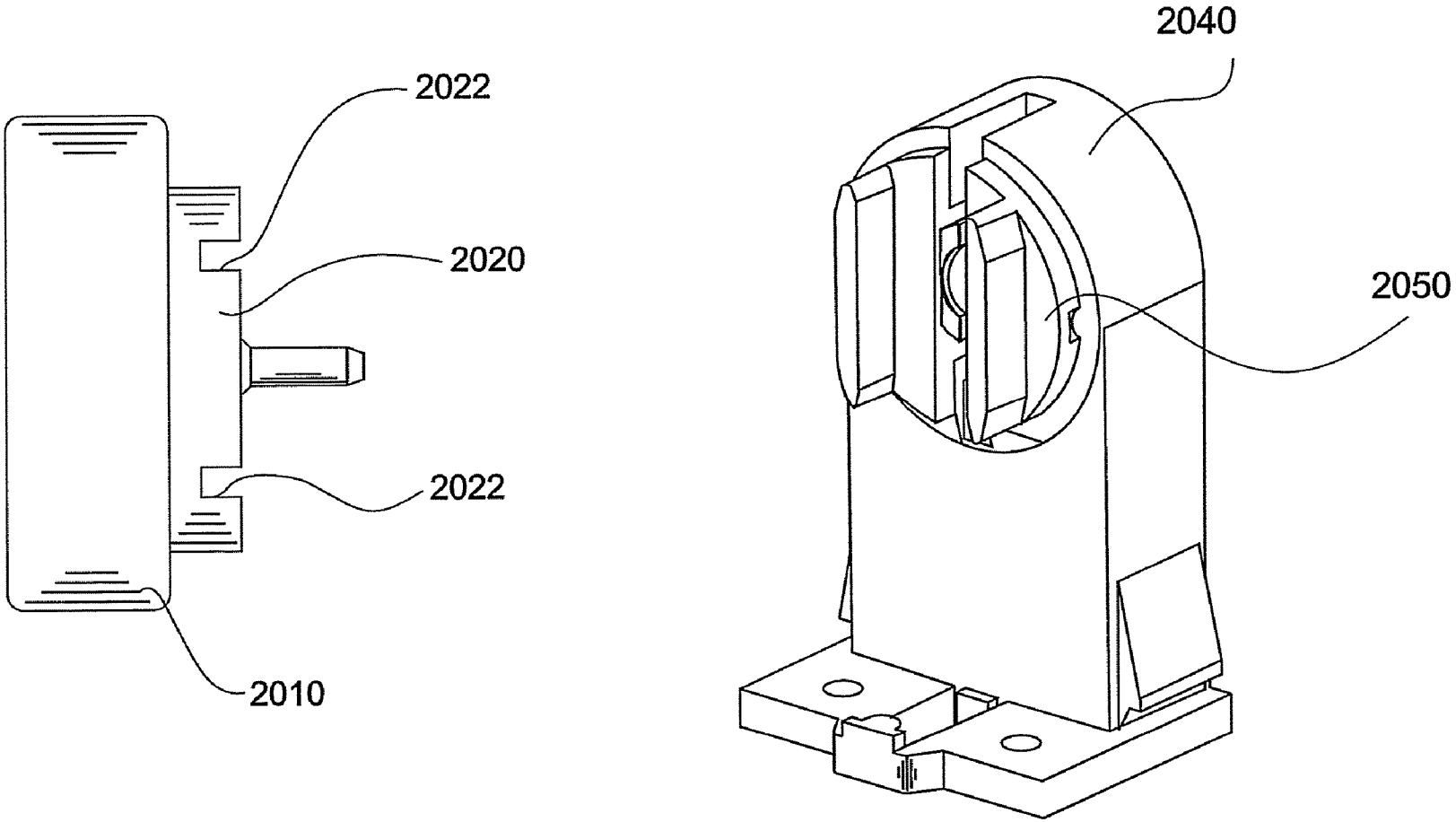
FIG. 116 shows an end cap and socket according to at least an embodiment.

FIGS. 113-116 show various views of other embodiments of end caps and sockets. For example, FIGS. 113-115 show sockets 2040 with key pieces 2051 having four key ribs and end caps 2010 with key disks 2021 having four key grooves. End caps 2010 are shown positioned on an end of lamp bulb 2005. FIG. 2021 shows an embodiment of a key piece 2050 with two sockets and an end cap 2010 with a key disk 2020 having two key grooves 2022.

Figure 117:
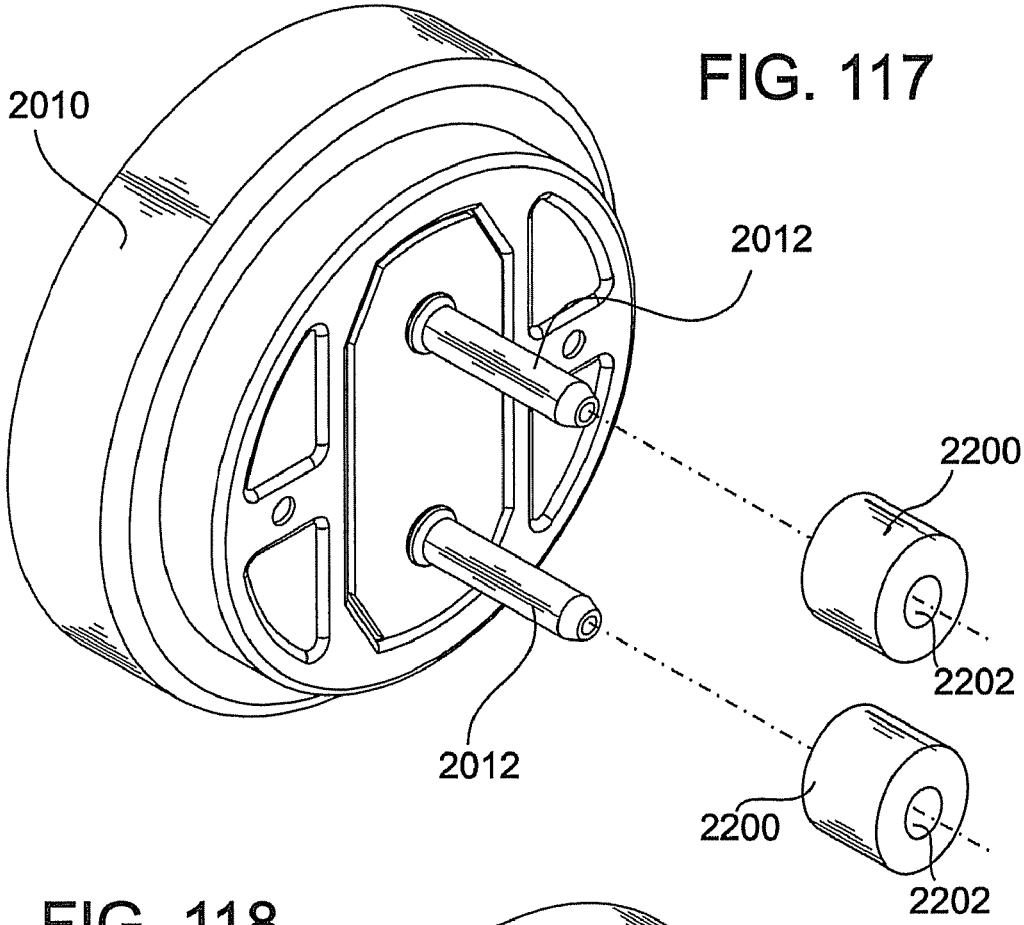
FIG. 117 shows an exploded perspective view of an end cap with adaptor inserts according to at least an embodiment.
Figure 118:
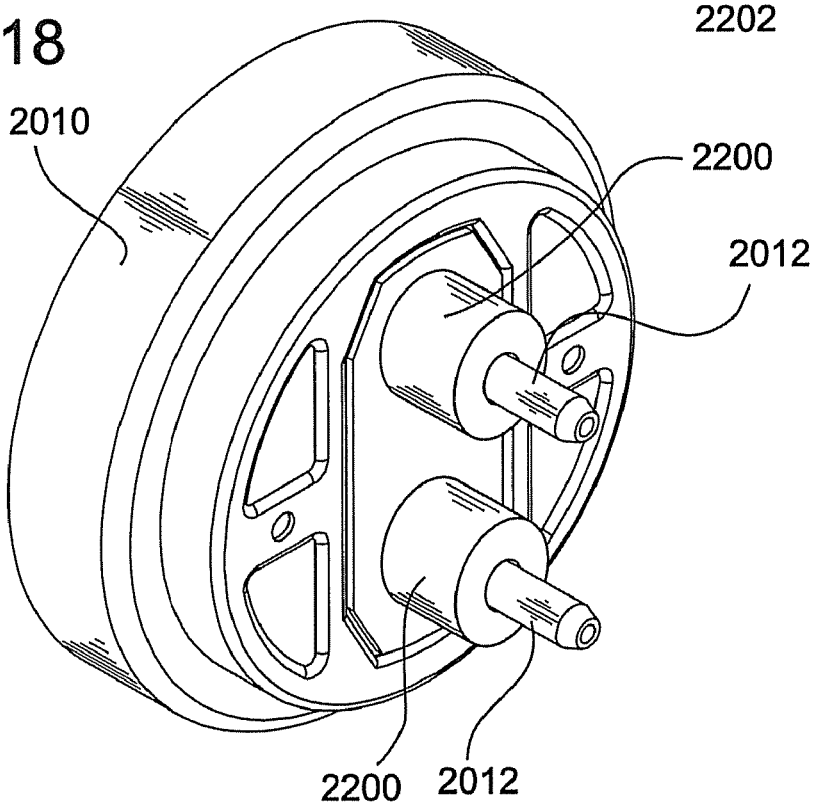
FIG. 118 shows a perspective view of an end cap with adaptors according to at least an embodiment.

FIGS. 117-120 also show that conventional end caps having longer pins can be fitted with adaptors to be used with a socket having a key piece. For example, as seen in FIGS. 117-118, an adaptor can have a body portion 2200 with a hole 2202 extending through body portion 2200. Body portion 2200 can be fitted over contact pins 2012 such that contact pins 2012 are inserted into hole 2202. In the embodiment shown in FIGS. 117-118, body portions 2200 may be small cylinders that fit over each individual contact pin.

Figure 119:
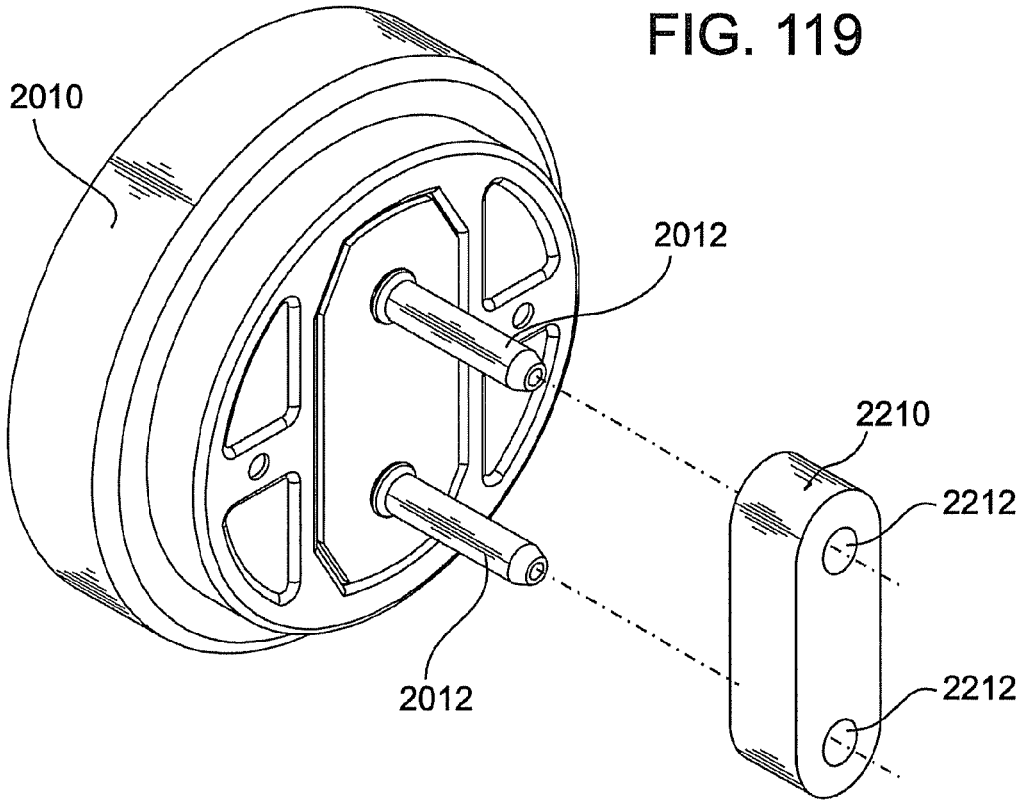
Figure 120:
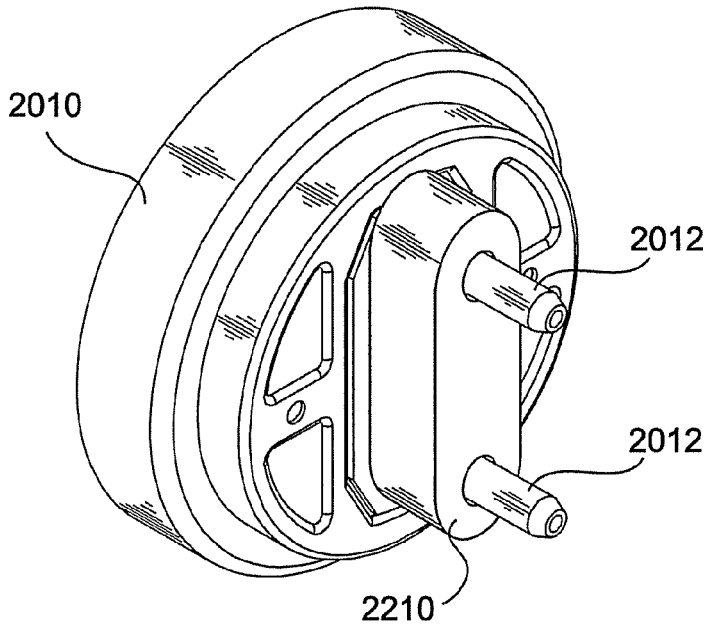

FIGS. 119-120 show one possible alternative embodiment of an adaptor. For example, in FIGS. 119-120, the adaptor can have a body portion 2210 with two holes 2212 extending through body portion 2210. To attach body portion 2212 to an end cap, contact pins 2012 are inserted through holes 2212. The adaptors 2200 and 2210 may be configured to a particular width so as to fit between the key ribs on a corresponding socket.

Figure 121:
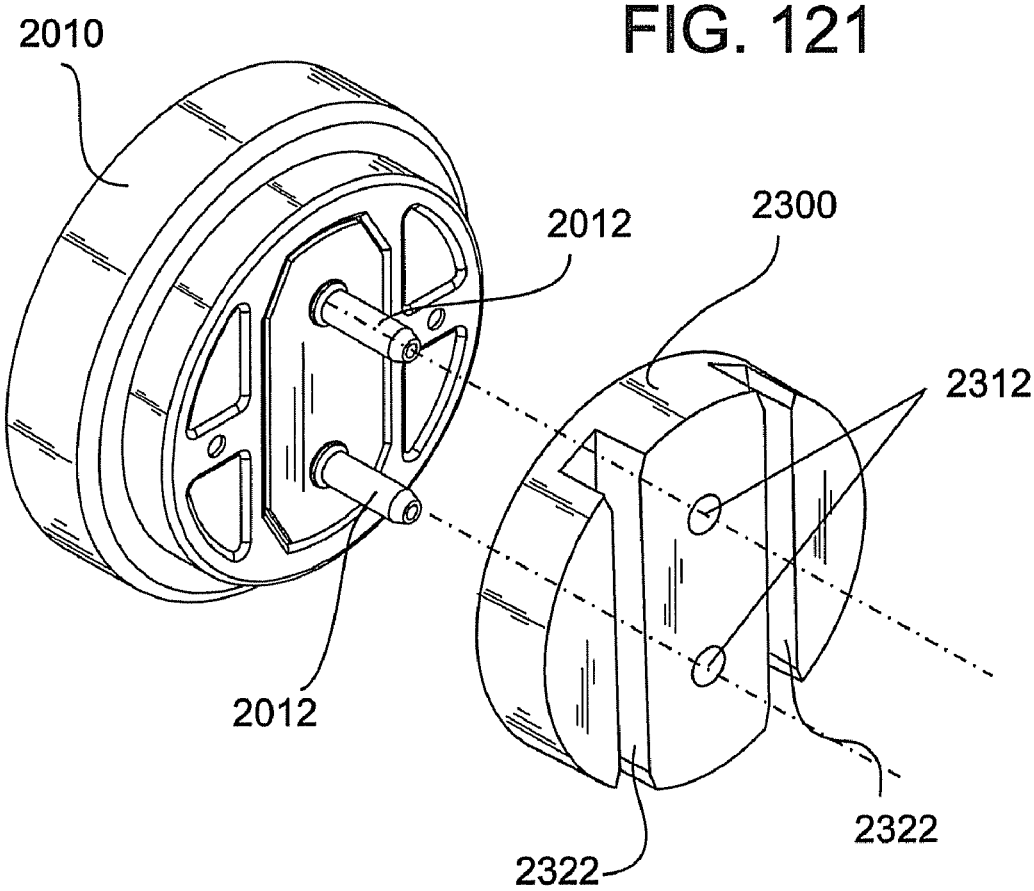
Figure 122:
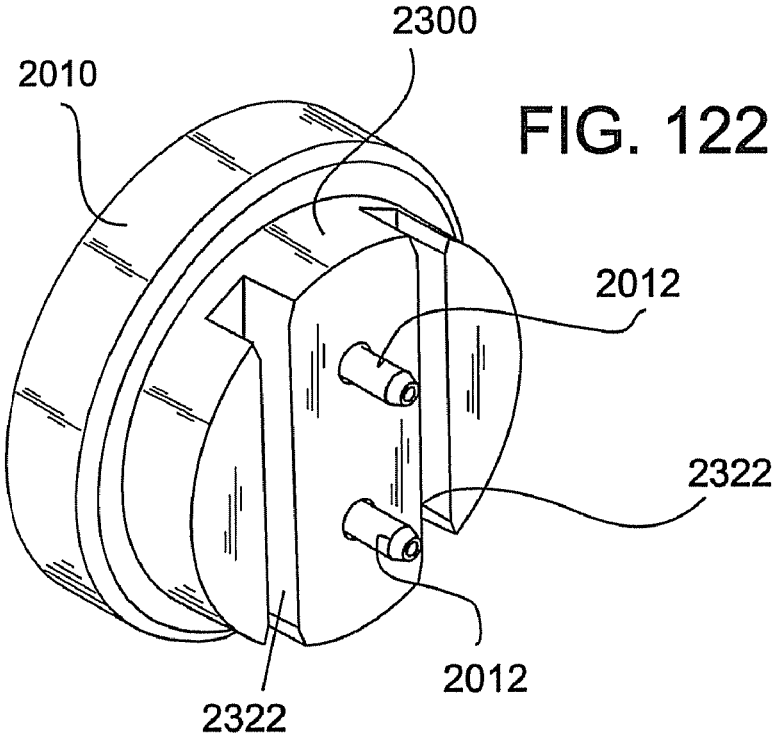

FIGS. 121-122 illustrate at least another embodiment of and end cap with an adaptor. For example, FIG. 121 shows an exploded view of a conventional end cap 2010 with pins 2012 and an adaptor body portion 2300. It will be appreciated that pins 2012 can be elongated pins in some embodiments. Adaptor body portion 2300 has holes 2312 that are structured to fit over pins 2012. In other words, pins 2012 are inserted through holes 2312. Adaptor body portion 2300 is also provided with key grooves 2322. As seen in FIG. 122, adaptor body portion 2300 can be fitted over pins 2010 and fastened to end cap 2010.

It is noted that in the embodiment shown in FIGS. 121-121, adaptor body portion 2300 corresponds to key disk 2020 shown in FIG. 97. However, it will be appreciated that many key disks can be used as the basis for adaptor body portion 2300, for example key disk 2021 shown in FIG. 98, any of disks 2100-2106, or any other appropriate key disk.

In addition to retrofitting old end caps, the adaptor embodiment shown in FIGS. 121-122 can be used in manufacturing new end caps as well. For example, existing manufacturing facilities can be used to manufacture end caps 2010 and then an adaptor body portion 2300 can be fastened to key disk 2010. This can provide significant time and cost advantages over retooling a manufacturing facility to produce end caps with integrated key disks.

The adaptors are an important feature because existing lamp bases can be upgraded through the use of an adaptor to ensure that the lamp base only couples in a particular way with appropriate sockets. This allows a user to achieve the operation and safety advantages described above without have to discard previously purchased lamps. Additionally, if an end cap with longer pins and no adaptor is used in a socket with a key piece, portions of the contact pins will be exposed outside the surface of the socket. This will create a risk of fire or shock that can cause property damage or injury to an operator. Additionally, the Figures described above show an end cap of size T12. However, it will be understood that other embodiments are possible with different sized end caps and sockets.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An end cap and socket system for use with a lamp bulb, the system comprising:

an end cap comprising:

a cylindrical portion;

an end face formed at a first end of the cylindrical portion;

a key disk provided on the end face and having a key groove cut into the key disk; and a plurality of contact pins extending from the key disk;

wherein the plurality of contact pins is structured to provide electrical to the lamp bulb; and a socket having a front face, a pin-receiving end, and a base end, the socket comprising:

an insertion groove structured to receive the contact pins therein, wherein the insertion groove begins at the pin-receiving end and extends in a direction toward the base end;

a rotation groove cut into the front face of the socket, wherein the rotation groove intersects with the insertion groove;

a plurality of electrical contacts positioned within the rotation groove; and a key piece inserted into the rotation groove and being rotatable within the rotation groove, the key piece being provided with a key rib;

wherein the key groove and the key rib are configured such that when the end cap is inserted into the socket, the key groove and the key rib are aligned so that the key rib can slide into the key groove.

2. The end cap and socket system of claim 1, wherein the key piece comprises:

a key piece body comprising a hollow cylinder having a first and second end and structured to fit within the rotation groove, the key piece body having a key piece body insertion groove extending from the first end of the key piece body and extending in a direction toward the second end of the key piece body;

a key piece face attached to the first end of the key piece body, the key piece face being approximately parallel to the front face of the socket and having a key piece face insertion groove aligned with the key piece body insertion groove and extending in a straight line through a center of the key piece face;

wherein the key rib extends from the key piece face in a direction away from the front face of the socket; and the key rib is parallel to the key piece face insertion groove.

3. The end cap and socket system of claim 1, wherein the key disk comprises two key grooves cut into the key disk; and the key piece comprises two key ribs;

wherein the key grooves and the key ribs are configured such that when the end cap is inserted into the socket, the key grooves and the key ribs are aligned so that the key ribs can slide into the key grooves.

4. The end cap and socket system of claim 1, wherein the key disk comprises four key grooves cut into the key disk;

the key piece comprises four key ribs;

wherein the key grooves and the key ribs are configured such that when the end cap is inserted into the socket, the key grooves and the key ribs are aligned so that the key ribs can slide into the key grooves.

5. An end cap for use with a lamp bulb, the end cap comprising:

a cylindrical portion;

an end face formed at a first end of the cylindrical portion;

a key disk provided on the end face and having a key groove cut into the key disk; and two contact pins extending from the key disk;

wherein the contact pins are structured to provide electrical connection to the lamp bulb; and a longitudinal axis of the key groove is parallel to a line connecting the contact pins.

6. The end cap of claim 5, wherein the key disk comprises two key grooves cut into the key disk, wherein the two key grooves are mutually parallel.

7. The end cap of claim 5, wherein the key disk comprises four key grooves cut into the key disk, wherein the four key grooves are mutually parallel.

8. An end cap adaptor for use with an end cap comprising a cylindrical portion, an end face formed at a first end of the cylindrical portion, and two contact pins extending from the end face, the end cap adaptor comprising:

a body portion;

two holes extending through the body portion; and a key groove cut into a face of the body portion;

wherein the holes are arranged such that the contact pins can be inserted through the hole;

wherein a longitudinal axis of the key groove is parallel to a line connecting the two holes;

the key groove intersects an outer circumferential edge of the body portion.

9. The end cap adaptor of claim 8, wherein two key grooves are cut into a face of the body portion; and the two key grooves are mutually parallel.

10. The end cap adaptor of claim 8, wherein four key grooves are cut into a face of the body portion; and the four key grooves are mutually parallel.

11. A socket structured to couple with an end cap comprising a cylindrical portion, an end face formed at a first end of the cylindrical portion, a key disk provided on the end face and having a key groove cut into the key disk, and a plurality of contact pins extending from the end face, the socket comprising:

a socket body having a front face, a pin-receiving end, and a base end; an insertion groove structured to receive the contact pins therein, wherein the insertion groove begins at the pin-receiving end and extends in a direction toward the base end;

a rotation groove cut into the front face of the socket, wherein the rotation groove intersects with the insertion groove;

a plurality of electrical contacts positioned within the rotation groove; and a key piece inserted into the rotation groove and being rotatable within the rotation groove, the key piece being provided with a key rib;

wherein the key rib is configured such that when the end cap is inserted into the socket, the key groove and the key rib are aligned so that the key rib can slide into the key groove.

12. The socket of claim 11, wherein the key piece comprises:

a key piece body comprising a hollow cylinder having a first and second end and structured to fit within the rotation groove, the key piece body having a key piece body insertion groove extending from the first end of the key piece body and extending in a direction toward the second end of the key piece body;

a key piece face attached to the first end of the key piece body, the key piece face being approximately parallel to the front face of the socket and having a key piece face insertion groove aligned with the key piece body insertion groove and extending in a straight line through a center of the key piece face;

wherein the key rib extends from the key piece face in a direction away from the front face of the socket; and the key rib is parallel to the key piece face insertion groove.

13. The socket of claim 12, wherein the key piece comprises two key ribs;

wherein the key ribs are configured such that when the end cap is inserted into the socket, the key grooves and the key ribs are aligned so that the key ribs can slide into the key grooves.

14. The socket of claim 12, wherein the key piece comprises two key ribs;

wherein the key ribs are configured such that when the end cap is inserted into the socket, the key grooves and the key ribs are aligned so that the key ribs can slide into the key grooves.

15. A key piece structured to be inserted into a rotation groove of a socket having a front face, the key piece comprising:

a key piece body comprising a hollow cylinder having a first and second end, the key piece body having a key piece body insertion groove extending from the first end of the key piece body and extending in a direction toward the second end of the key piece body;

a key piece face attached to the first end of the key piece body, the key piece face being approximately parallel to the front face of the socket and having a key piece face insertion groove aligned with the key piece body insertion groove and extending in a straight line through a center of the key piece face; and a key rib extending from the key piece face in a direction away from the front face of the socket;

wherein the key rib is parallel to the key piece face insertion groove; and the key piece is rotatable within the rotation groove of the socket.

16. The key piece of claim 15, wherein the key piece comprises a plurality of key ribs extending from the key piece face in a direction away from the front face of the socket;

and each of the plurality of key ribs is parallel to the key piece face insertion groove.

17. An end cap and socket system for use with a lamp bulb, the system comprising:

an end cap comprising:

a first cylindrical portion having a first diameter;

a second cylindrical portion having a second diameter different than the first diameter, the second cylindrical portion being positioned adjacent to the first cylindrical portion in an axial direction;

an end face formed at a first end of the end cap; and a plurality of contact pins extending perpendicular to the end face;

wherein the plurality contact pins is structured to provide electrical connections to the lamp bulb; and a socket having a front face, a pin-receiving end, and a base end, the socket comprising:

an insertion groove structured to receive the plurality of contact pins therein, wherein the insertion groove begins at the pin-receiving end and extends in a direction toward the base end;

a rotation groove cut into the front face of the socket, wherein the rotation groove intersects with the insertion groove;

a plurality of electrical contacts positioned within the rotation groove; and a key portion projecting from the front face, the key portion structured to couple with the second cylindrical portion of the end cap.

18. The end cap and socket system of claim 17, wherein a top surface of the key portion proximate to the rotation groove is in the shape of a circular arc.

19. The end cap and socket system of claim 17, wherein the second diameter is smaller than the first diameter.

20. The end cap and socket system of claim 19, wherein the end cap further comprises a third cylindrical portion having a third diameter approximately equal to the first diameter, the third cylindrical portion being positioned adjacent to the second cylindrical portion in an axial direction; and the key portion further comprises a first key segment adjacent to the front face and a second key segment adjacent to the first key segment in a direction away from the front face;

wherein the first key segment comprises a groove and the second key segment comprises a ridge; and the first key segment is structured to couple with the third cylindrical portion and the second key segment is structured to couple with the second cylindrical portion.

21. The end cap and socket system of claim 19, wherein the end cap further comprises:

a third cylindrical portion having a third diameter approximately equal to the first diameter, the third cylindrical portion being positioned adjacent to the second cylindrical portion in an axial direction; and a fourth cylindrical portion having a fourth diameter approximately equal to the second diameter, the fourth cylindrical portion being positioned adjacent to the third cylindrical portion in an axial direction;

the key portion further comprises:

a first key segment adjacent to the front face;

a second key segment adjacent to the first key segment in a direction away from the front face; and a third key segment adjacent to the second key segment in a direction away from the front face;

wherein the first key segment comprises a ridge, the second key segment comprises a groove, and the third key segment comprises a ridge; and the first key segment is structured to couple with the fourth cylindrical portion, the second key segment is structured to couple with the third cylindrical portion, and the third key segment is structured to couple with the second cylindrical portion.

22. The end cap and socket system of claim 19, wherein the end cap further comprises:

a third cylindrical portion having a third diameter approximately equal to the first diameter, the third cylindrical portion being positioned adjacent to the second cylindrical portion in an axial direction;

a fourth cylindrical portion having a fourth diameter approximately equal to the second diameter, the fourth cylindrical portion being positioned adjacent to the third cylindrical portion in an axial direction; and a fifth cylindrical portion having a fifth diameter approximately equal to the first diameter, the fifth cylindrical portion being positioned adjacent to the fourth cylindrical portion in an axial direction;

the key portion further comprises:

a first key segment adjacent to the front face;

a second key segment adjacent to the first key segment in a direction away from the front face;

a third key segment adjacent to the second key segment in a direction away from the front face; and a fourth key segment adjacent to the third key segment in a direction away from the front face;

wherein the first key segment comprises a groove, the second key segment comprises a ridge, the third key segment comprises a groove; and the fourth key segment comprises a ridge; and the first key segment is structured to couple with the fifth cylindrical portion; the second key segment is structured to couple with the fourth cylindrical portion; the third key segment is structured to couple with the third cylindrical portion; and the fourth key segment is structured to couple with the second cylindrical portion.

23. The end cap and socket system of claim 19, wherein the end cap further comprises:

a third cylindrical portion having a third diameter approximately equal to the first diameter, the third cylindrical portion being positioned adjacent to the second cylindrical portion in an axial direction;

a fourth cylindrical portion having a fourth diameter approximately equal to the second diameter, the fourth cylindrical portion being positioned adjacent to the third cylindrical portion in an axial direction;

a fifth cylindrical portion having a fifth diameter approximately equal to the first diameter, the fifth cylindrical portion being positioned adjacent to the fourth cylindrical portion in an axial direction; and a sixth cylindrical portion having a sixth diameter approximately equal to the second diameter, the sixth cylindrical portion being positioned adjacent to the fifth cylindrical portion in an axial direction;

the key portion further comprises:

a first key segment adjacent to the front face;

a second key segment adjacent to the first key segment in a direction away from the front face;

a third key segment adjacent to the second key segment in a direction away from the front face;

a fourth key segment adjacent to the third key segment in a direction away from the front face; and a fifth key segment adjacent to the fourth key segment in a direction away from the front face;

wherein the first key segment comprises a ridge, the second key segment comprises a groove, the third key segment comprises a ridge; the fourth key segment comprises a groove; and the fifth key segment comprises a ridge; and the first key segment is structured to couple with the sixth cylindrical portion; the second key segment is structured to couple with the fifth cylindrical portion; the third key segment is structured to couple with the fourth cylindrical portion; the fourth key segment is structured to couple with the third cylindrical portion; and the fifth key segment is structured to couple with the second cylindrical portion.

24. A socket structured to couple with an end cap, the socket comprising:

a socket body having a front face, a pin-receiving end, and a base end;

an insertion groove structured to receive the plurality of contact pins therein, wherein the insertion groove begins at the pin-receiving end and extends in a direction toward the base end;

a rotation groove cut into the front face of the socket, wherein the rotation groove intersects with the insertion groove;

a plurality of electrical contacts positioned within the rotation groove; and a key portion projecting from the front face.

25. The socket of claim 24, wherein a top surface of the key portion proximate to the rotation groove is in the shape of a circular arc.

26. The socket of claim 24, wherein the key portion further comprises:

a first key segment adjacent to the front face; and a second key segment adjacent to the first key segment in a direction away from the front face;

wherein the first key segment comprises a groove and the second key segment comprises a ridge.

27. The socket of claim 24, wherein the key portion further comprises:

a first key segment adjacent to the front face;

a second key segment adjacent to the first key segment in a direction away from the front face; and a third key segment adjacent to the second key segment in a direction away from the front face;

wherein the first key segment comprises a ridge, the second key segment comprises a groove, and the third key segment comprises a ridge.

28. The socket of claim 24, wherein the key portion further comprises:

a first key segment adjacent to the front face;

a second key segment adjacent to the first key segment in a direction away from the front face;

a third key segment adjacent to the second key segment in a direction away from the front face; and a fourth key segment adjacent to the third key segment in a direction away from the front face;

wherein the first key segment comprises a groove, the second key segment comprises a ridge, the third key segment comprises a groove; and the fourth key segment comprises a ridge.

29. The socket of claim 24, wherein the key portion further comprises:

a first key segment adjacent to the front face;

a second key segment adjacent to the first key segment in a direction away from the front face;

a third key segment adjacent to the second key segment in a direction away from the front face;

a fourth key segment adjacent to the third key segment in a direction away from the front face; and a fifth key segment adjacent to the fourth key segment in a direction away from the front face;

wherein the first key segment comprises a ridge, the second key segment comprises a groove, the third key segment comprises a ridge; the fourth key segment comprises a groove; and the fifth key segment comprises a ridge.

30. A socket adaptor structured to fit over a socket comprising a rotation groove cut into a front face of the socket, the socket adaptor comprising:

a hollow adaptor body;

an adaptor front face that sits adjacent to the front face of the socket; and a key portion provided on the adaptor front face.

31. The socket adaptor of claim 30, wherein a top surface of the key portion proximate to the rotation groove is in the shape of a circular arc.

32. The socket of claim 30, wherein the key portion further comprises:

a first key segment adjacent to the adaptor front face; and a second key segment adjacent to the first key segment in a direction away from the adaptor front face;

wherein the first key segment comprises a groove and the second key segment comprises a ridge.

33. The socket of claim 30, wherein the key portion further comprises:

a first key segment adjacent to the adaptor front face;

a second key segment adjacent to the first key segment in a direction away from the adaptor front face; and a third key segment adjacent to the second key segment in a direction away from the adaptor front face;

wherein the first key segment comprises a ridge, the second key segment comprises a groove, and the third key segment comprises a ridge.

34. The socket of claim 30, wherein the key portion further comprises:

a first key segment adjacent to the adaptor front face;

a second key segment adjacent to the first key segment in a direction away from the adaptor front face;

a third key segment adjacent to the second key segment in a direction away from the adaptor front face; and a fourth key segment adjacent to the third key segment in a direction away from the adaptor front face;

wherein the first key segment comprises a groove, the second key segment comprises a ridge, the third key segment comprises a groove; and the fourth key segment comprises a ridge.

35. The socket of claim 30, wherein the key portion further comprises:

a first key segment adjacent to the adaptor front face;

a second key segment adjacent to the first key segment in a direction away from the adaptor front face;

a third key segment adjacent to the second key segment in a direction away from the adaptor front face;

a fourth key segment adjacent to the third key segment in a direction away from the adaptor front face; and a fifth key segment adjacent to the fourth key segment in a direction away from the adaptor front face;

wherein the first key segment comprises a ridge, the second key segment comprises a groove, the third key segment comprises a ridge; the fourth key segment comprises a groove; and the fifth key segment comprises a ridge.

* * * * *